US008080782B2

(12) United States Patent
Hidalgo et al.

(10) Patent No.: US 8,080,782 B2
(45) Date of Patent: Dec. 20, 2011

(54) DITHERED MULTI-PULSING TIME-OF-FLIGHT MASS SPECTROMETER

(75) Inventors: August Hidalgo, San Francisco, CA (US); Brian D Setterberg, Menlo Park, CA (US); George Stennis Moore, Veradale, WA (US); Michael Manlove, Redwood City, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 321 days.

(21) Appl. No.: 12/511,965

(22) Filed: Jul. 29, 2009

(65) Prior Publication Data

US 2011/0024620 A1 Feb. 3, 2011

(51) Int. Cl.
*H01J 49/00* (2006.01)

(52) U.S. Cl. ..... 250/282; 250/281; 250/286; 250/287

(58) Field of Classification Search ..... 250/281, 250/283, 286, 287; 436/173
See application file for complete search history.

(56) References Cited

U.S. PATENT DOCUMENTS 5,396,065 A * 3/1995 Myerholtz et al. ..... 250/287
6,198,096 B1 3/2001 Le Cocq
6,300,626 B1 10/2001 Brock et al.
6,680,476 B1 * 1/2004 Hidalgo et al. ..... 250/286
7,412,334 B2 8/2008 Fjeldsted et al.
7,863,556 B2 * 1/2011 Hidalgo et al. ..... 250/281
2003/0055573 A1 3/2003 LeGore et al.
2007/0255532 A1 * 11/2007 Fjeldsted et al. ..... 702/189

OTHER PUBLICATIONS

August Hidalgo, pending U.S. Appl. No. 12/242,110, filed Sep. 30, 2008.
UK Intellectual Property Office, Combined Search and Examination Report dated Dec. 13, 2010.

* cited by examiner

*Primary Examiner* — Michael Maskell

(57) ABSTRACT

A detection signal generated in response to incident ions accelerated at temporally-irregular intervals having an average repetition rate greater than a reference repetition rate represents detection events each having an event time and an intensity. For each detection event, respective allowed TOFs between the event time and the transient times are calculated. Using respective initial probabilities, initial apportionments of the intensity of each detection event among the allowed TOFs linked thereto are determined. For each allowed TOF, the intensity apportionments thereto are accumulated to generate an intensity accumulation linked thereto. For each detection event, respective revised probabilities are iteratively determined using the intensity accumulations linked to the allowed TOFs linked thereto, and the respective intensity is iteratively reapportioned among the allowed TOFs linked thereto using the revised probabilities to transform the detection signal to a time-of-flight spectrum.

24 Claims, 23 Drawing Sheets

DITHERED MULTI-PULSING TIME-OF-FLIGHT MASS SPECTROMETER

BACKGROUND

In time-of-flight mass spectrometers (TOFMS), a sample to be analyzed is ionized, the resulting ions are accelerated in a vacuum by an electrical pulse having a known potential, and the time of flight of the ions of different masses to an ion detector are measured. The more massive the ion, the longer is the time of flight. The relationship between the time of flight and the mass, m, of ions of a given mass can be written in the form:

$$\text{time}=k\sqrt{m}+c$$

where k is a constant related to flight path and ion energy, and c is a small delay time that may be introduced by the signal cable and/or detection electronics. When the term mass is used in this disclosure in the context of mass spectrometry, it is to be understood to mean mass-to-charge ratio. The process of accelerating the ions of the sample and detecting the arrival times of the ions of different masses at the ion detector will be referred to herein as a mass scan operation.

The ion detector generates electrons in response to ions incident thereon. The electrons constitute an electrical signal whose amplitude is proportional to the number of electrons. There is only a statistical correlation between the number of electrons generated in response to a single ion incident on the ion detector. In addition, more than one ion at a time may be incident on the ion detector due to ion abundance.

In the mass spectrometer, an ion pulser generates a short burst of ions by applying what is referred to in the art as a transient to ions received from an ion source. A transient is a short-duration electrical pulse having a known voltage. Immediately after leaving the ion pulser, the ions are bunched together but, within the ion burst, ions of different masses travel at different speeds. The time of flight required for the ions of a given mass to reach the ion detector depends on the speed of the ions, which in turn, depends on the mass of the ions. Consequently, as the ion burst approaches the ion detector, the ion burst is separated in space and in time into discrete packets, each packet containing ions of a single mass. The packets reach the ion detector at different arrival times that depend on the mass of the ions therein.

The mass spectrometer generates what will be referred to as a mass scan signal in response to a single burst of ions accelerated by the ion pulser in response to a single transient. The mass scan signal is a digital signal that represents the output of the ion detector as a function of time. The time represents the time of flight of the ions from the ion pulser to the ion detector. The number of electrons generated by the ion detector in a given time interval constitutes an analog ion detection signal that is converted to the mass scan signal by an analog-to-digital converter (A/D converter). The mass scan signal represents the output of the ion detector as a function of the flight time taken by the ions to reach the ion detector. The mass scan signal is a temporal sequence of digital samples output by the A/D converter after the ions have been accelerated. The conversion time of the A/D converter effectively divides the time axis into discrete segments and the A/D converter outputs a single digital sample for each temporal segment.

Because the relationship between the amplitude of the ion detection signal output by the ion detector and the number of ions incident on the ion detector during the temporal segment is a statistical one, a single mass scan signal will not accurately represent the time-of-flight spectrum of the sample. In addition, the ion detection process is subject to noise from a number of different noise sources. Such noise causes the ion detector to generate an output signal even in the absence of ions incident on the ion detector. To overcome these problems, the mass spectrometer generates multiple mass scan signals and sums the most-recently generated mass scan signal with an accumulation of previously-generated mass scan signals to generate a time-of-flight spectrum having a defined statistical accuracy and signal-to-noise ratio. The time-of-flight spectrum is a set of data that represents the relationship between the accumulated ion intensities and time of flight. A mass spectrum is then obtained by subjecting the time-of-flight spectrum to processing such as that described in U.S. Pat. No. 7,412,334 of Fjeldsted et al., or in U.S. patent application Ser. No. 12/242,110 of Hidalgo et al., both assigned to the assignee of this disclosure.

In a conventional mass spectrometer, the ion pulser fires at a constant repetition rate chosen such that the minimum time that elapses between ion pulser firings is greater than the maximum time of flight of the mass spectrometer. This repetition rate will be referred to herein as a reference repetition rate. The maximum time of flight is typically the time of flight of the most massive ion species that the mass spectrometer is specified to measure. However, in embodiments in which the repetition rate can be adjusted, the maximum time of flight is the time of flight of the most massive ion species in the analyte. A repetition rate chosen as just described prevents a given mass scan signal from representing the times of flights of ions accelerated by different firings of the ion pulser, a phenomenon that will be referred to herein as aliasing.

A high mass resolution, a high sensitivity and a high productivity are desirable properties of a mass spectrometer. Increasing the distance between the ion pulser and the ion detector increases the mass resolution of the mass spectrometer, but undesirably increases the minimum time between consecutive firings of the ion pulser. A high sensitivity allows low-abundance ion species to be reliably detected. Increasing the number of mass scans contributing to each time-of-flight spectrum increases the sensitivity of the mass spectrometer but undesirably increases the acquisition time, i.e., the time needed to acquire each time-of-flight spectrum. Thus, in conventional mass spectrometers, mass resolution and sensitivity can be obtained only at the expense of decreased productivity.

Productivity-increasing techniques employing randomized firings of the ion pulser at an average repetition rate greater than the reference repetition rate together with active or passive de-aliasing have been known for many years. For example, U.S. Pat. No. 5,396,065 of Myerholtz et al, assigned to the assignee of this disclosure, discloses a mass spectrometer in which the minimum interval between consecutive firings of the ion pulser is less than that corresponding to the reference repetition rate. The ion pulser has a fixed repetition rate, but a random distribution is used to decide whether to fire the pulser or not. A de-aliasing technique employing a correlator is used to derive a time-of-flight spectrum from the detection signal produced by the ion detector. None of the known productivity-increasing techniques is currently in widespread use possibly because the increase in productivity is obtained at the expense of one or more of decreased accuracy, decreased sensitivity, decreased mass resolution and increased complexity.

Accordingly, what is needed is a mass spectrometer in which increased productivity is obtained without decreasing accuracy, sensitivity and mass resolution and with an acceptable increase in complexity.

DETAILED DESCRIPTION

Figure 1:
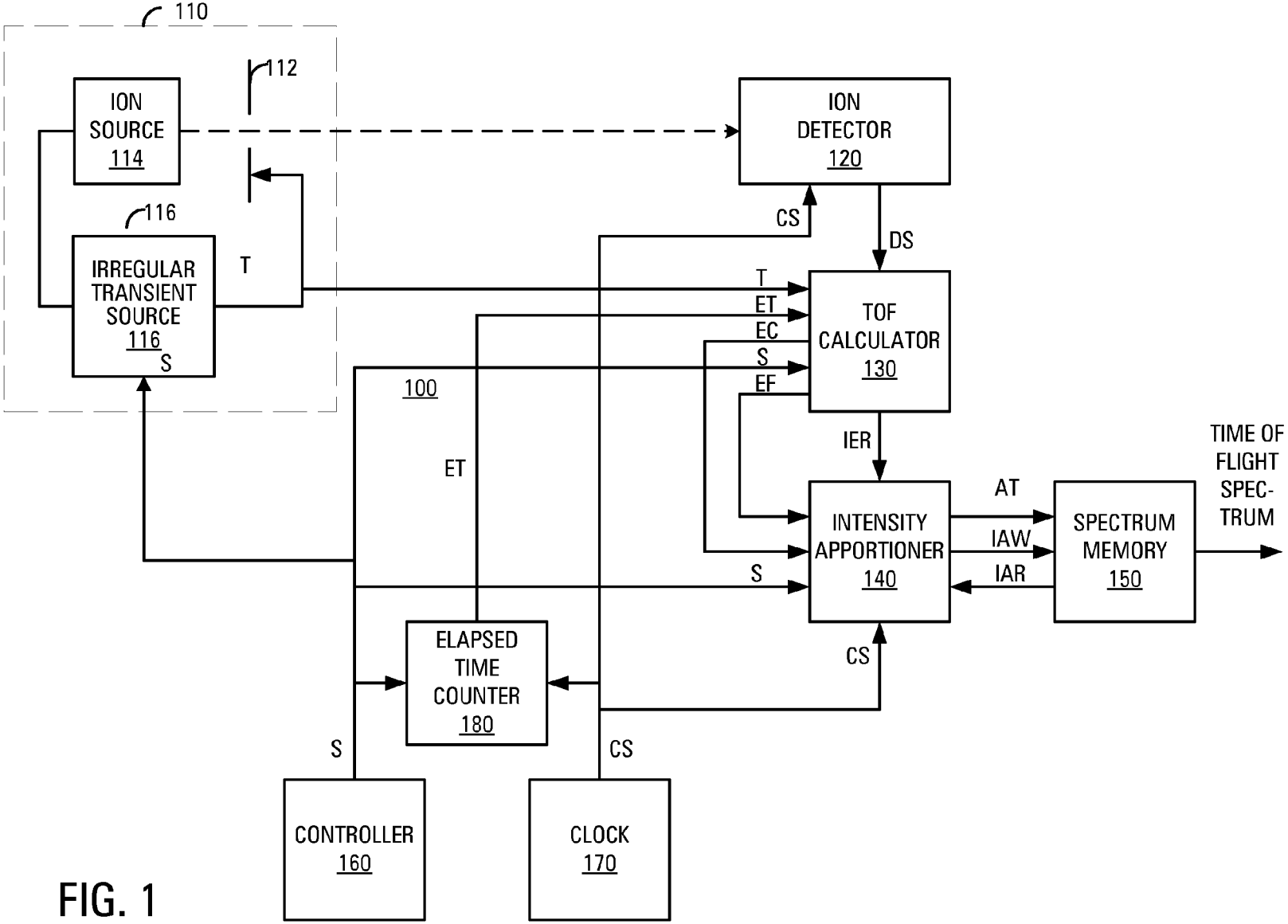
FIG. 1 is a block diagram showing an example of a time-of-flight mass spectrometer in accordance with an embodiment of the invention.

FIG. 1 is a block diagram showing a simplified example of a time-of-flight mass spectrometer 100 in accordance with an embodiment of the invention. The example shown is simplified in that conventional initialization, control, timing and buffering circuitry is omitted. FIG. 1 will be additionally referred to throughout this disclosure. In the example shown in FIG. 1, mass spectrometer 100 is composed of a temporally-irregular ion pulser 110, an ion detector 120, a time-of-flight (TOF) calculator 130, an intensity apportioner 140, and a spectrum memory 150. Also shown as separate elements in FIG. 1, but which may alternatively constitute integral parts of one or more of ion pulser 110, ion detector 120, TOF calculator 130, intensity apportioner 140 and spectrum memory 150 are a controller 160, a clock 170, and an elapsed-time counter 180.

Temporally-irregular ion pulser 110 operates in response to temporally-irregular transients to accelerate ions derived from an analyte sample along a flight path that ends at ion detector 120. The transients have an average repetition rate greater than the reference repetition rate of mass spectrometer 100, which causes ions accelerated by different firings of the ion pulser to overlap at detector 120. Typically, the average repetition rate is several times, e.g., ten times, the reference repetition rate. The reference repetition rate of mass spectrometer 100 is the reciprocal of the maximum time of flight between ion pulser 110 and ion detector 120. Typically, the maximum time of flight is the time of flight between ion pulser 110 and ion detector 120 of the most massive ion species that mass spectrometer 100 is specified to measure. However, in embodiments in which the average repetition rate can be adjusted, the maximum time of flight is the time of flight of the most massive ion species in the analyte. In response to each transient, ion pulser 110 accelerates a burst of ions along a path that ends at ion detector 120. Each of the transients has a respective transient time. The transients, or timing information regarding the transients, are additionally output to time of flight calculator 130 to provide the respective transient times of the transients to the intensity apportioner.

Ion detector 120 is operable to generate a detection signal DS in response to the ions accelerated towards it by ion pulser 1 10. Detection signal DS is composed of a series of digital samples. Typically, detection signal DS is composed of one sample for each period of clock signal CS received from clock 170. In an example in which the intensity of the ion detector output is statistically related to the number of ions incident on the detector on one period of clock signal CS, each sample has an intensity that represents the number of ions incident on ion detector 120 within one period of clock signal CS. Initially in this disclosure, each sample whose intensity is greater than a threshold value will be referred to as constituting a respective detection event. Each detection event has a respective intensity and a respective event time. The event time is the value of an elapsed time signal ET output by elapsed time counter 180 at the time that the ions detected by ion detector 120 as the detection event are detected. Later in this disclosure, embodiments in which each detection event is composed of multiple samples will be discussed.

Since the average repetition rate of the transients in ion source 110 is greater than that corresponding to the maximum time of flight of mass spectrometer 100, higher-mass ions accelerated by a given transient in ion pulser 110 may not have arrived at ion detector 120 by the time lower-mass ions accelerated by the next (or a later) transient applied to the ion pulser arrive at the ion detector. Consequently, detection signal DS output by ion detector 120 represents a number of superimposed mass scan signals temporally offset from one another in accordance with the timings of the transients. A time-of-flight spectrum that unambiguously represents the relationship between ion abundance and time of flight cannot be determined from detection signal DS in a manner similar to that used in the conventional mass spectrometer described above. In mass spectrometer 100, TOF calculator 130, intensity apportioner 140 and spectrum memory 150 operate to generate a time-of-flight spectrum from the superimposed mass scan signals represented by detection signal DS. The mass spectrum of the sample can then be obtained by subjecting the time-of-flight spectrum to conventional processing.

Spectrum memory 150 is structured to store a time-of-flight spectrum, i.e., a set of intensity accumulations, one for each possible time of flight between ion pulser 110 and ion detector 120. The time of flight of the ions of each ion species provides a measure of the mass of the ions of the ion species, as described above. Spectrum memory 150 is composed of a number of memory locations each corresponding to a respective time of flight. Each of such memory locations will be referred to herein as a time-of-flight bin, typically abbreviated herein as TOF bin. Each TOF bin stores an intensity accumulation obtained by accumulating intensity apportionments corresponding to the time of flight of the TOF bin. In the example shown, correspondence between the time-of-flight bins of spectrum memory 150 and respective times of flight is established by an addressing scheme. In an example, each time of flight directly addresses a respective time-of-flight bin. In another example, each time of flight is mapped to a respective time-of-flight bin. Other ways of establishing correspondence are possible and can be used.

TOF calculator 130 is connected to receive detection signal DS, transients T and elapsed time signal ET, and is operable in response to the transient times of the transients and the respective event time of the detection event to determine, for each detection event represented by the detection signal, respective allowed times of flight linked to the detection event. The allowed times of flight address respective TOF bins in spectrum memory 150. TOF calculator 130 can also be described as performing the function of calculating, using the transient times and a respective event time, respective allowed times of flight linked to each of the detection events represented by the detection signal. An exemplary structure for TOF calculator 130 will be described below with reference to FIGS. 10A and 10B.

Intensity apportioner 140 is initially operable to use initial probabilities to determine an apportionment of the respective intensity of each detection event among the allowed times of flight linked to the detection event and, hence, among the TOF bins linked to the detection event. In some embodiments, the initial probabilities are the same for each of the allowed times of flight linked to the detection event. In other embodiments, the initial probabilities are respective probabilities for the times of flight linked to the detection event and are typically non-equal, as will be described in more detail below.

Intensity apportioner 140 is also initially operable to accumulate the apportionments of the intensities to each allowed time of flight to generate a respective intensity accumulation. The intensity accumulation for each allowed time of flight is stored in the respective TOF bin of spectrum memory 150 corresponding to the allowed TOF. In an example, intensity apportioner 140 causes spectrum memory 150 to read out the intensity accumulation stored in the TOF bin addressed by the allowed TOF, sums the intensity apportionment and the intensity accumulation received from the spectrum memory to generate a new intensity accumulation, and causes spectrum memory 150 to store the new intensity accumulation in the TOF bin addressed by the allowed TOF, replacing the old intensity accumulation. When no intensity accumulation has previously been stored in the TOF bin, the intensity accumulation read out from the TOF bin has a value of zero.

With reference to a detection event exclusively due to ions of the same ion species, only one of the allowed times of flight linked to a given detection event is the time of flight of the ions detected in the detection event. This time of flight will be referred to as the real time of flight for the detection event, and the TOF bin addressed by the real time of flight will be referred to the real TOF bin linked to the detection event. The remaining times of flight linked to the detection event differ from the time of flight of the ions. These times of flight will be referred to as alias times of flight, and the TOF bins respectively addressed by the alias times of flight will be referred to as alias TOF bins. Accordingly, the initial time-of-flight spectrum stored in spectrum memory 150 after the initial intensity apportionments and apportionment accumulations have been performed will typically appear quite different from the time-of-flight spectrum accumulated by a conventional mass spectrometer as described above. Specifically, due to the above-described aliasing, the initial time-of-flight spectrum will typically exhibit many more peaks than a conventional time-of-flight spectrum. Moreover, the major peaks will be smaller in amplitude and the smaller peaks will be hidden among the peaks due to the alias times of flight. The above description additionally applies to detection events that are due to ions of more than one, e.g., n ion species, except that there is one respective true allowed time of flight for each of the n ion species. The remaining allowed times of flight are alias times of flight.

Intensity apportioner 140 is additionally iteratively operable, for each detection event, to calculate revised probabilities using the intensity accumulations linked to the allowed times of flight, and to reapportion the respective intensity of the detection event among the allowed times of flight linked to the detection event using the revised probabilities. Reapportioning the intensity of the detection event changes intensity accumulations stored in the TOF bins of spectrum memory 150 linked to the detection event. For each detection event, each time the intensity apportioner performs the revised probability determining and intensity reapportioning processes, parts of the intensity apportionments are typically removed from the alias TOF bins linked to the detection event, and the removed intensity apportionments are typically contributed to the real TOF bin linked to the detection event. Intensity apportioner 140 performs the revised probability determining and intensity reapportioning processes iteratively until a termination condition is met.

Intensity apportioner 140 performs the function of determining, in accordance with initial probabilities, initial apportionments of the respective intensity of each of the detection events among the allowed TOFs linked thereto; accumulating the initial apportionments of the intensities to each one of the allowed times of flight to generate a respective intensity accumulation for storage in a respective one of the TOF bins corresponding to the one of the allowed times of flight; iteratively determining revised probabilities for each detection event using the intensity accumulations stored in the respective TOF bins corresponding to the allowed times of flight linked to the detection event; and reapportioning the respective intensity among the TOF bins corresponding to the allowed times of flight using the revised probabilities. Exemplary structures for intensity apportioner 140 and its constituent components will be described below with reference to FIGS. 11 and 13-20.

Intensity apportioner 140 performs the revised probability determining and intensity reapportioning processes iteratively until a termination is met. Then, the intensity accumulations stored in the TOF bins of spectrum memory 150 constitute a final time-of-flight spectrum of the sample from which the ions were derived. As the number of iterations increases, the final time-of-flight spectrum will typically converge with the time-of-flight spectrum generated by a conventional mass spectrometer having the same mass resolution and sensitivity. However, the measurement runs performed by mass spectrometer 100 typically have a duration that is a fraction of that of the measurement runs performed by a conventional mass spectrometer. Moreover, depending on the operational speed of TOF calculator 130, intensity apportioner 140 and spectrum memory 150, the total time required for mass spectrometer 100 to generate the final time-of-flight spectrum can be less than that required for a conventional mass spectrometer to generate the conventional time-of-flight spectrum. Even when the operational speed of TOF calculator 130, intensity apportioner 140 and spectrum memory 150 is less than that needed to generate a final time-of-flight spectrum in real time, at least the initial intensity apportioning can be performed in real time to enable real-time visualization of the initial time-of-flight spectrum.

Mass spectrometer 100 will now be described in greater detail. Temporally-irregular ion pulser 110 is composed of an electrode 112, an ion source 114 and a temporally-irregular transient source 116. Transient source 116 generates transients at temporally-irregular timings having an average repetition rate greater than the reference repetition rate corresponding to the reciprocal of the maximum time of flight of mass spectrometer 100. Typically, transient source 116 generates the transients with respective timings each of which differs from a timing corresponding to the average repetition rate by a difference within a specified difference range. The differences can be truly random, pseudo random, or irregular in some other way. In an example, a uniform distribution of pulser intervals between a minimum and a maximum is used. Circuits and software routines suitable for generating such transients are known in the art and can be used. Each transient is a short-duration, high-voltage electrical pulse.

Transient source 116 outputs the transients or timing information regarding the transients to TOF calculator 130 to provide the respective transient times of the transients for the TOF calculator to use in calculating the allowed times-of-flight corresponding to each transient. Transient source 116 additionally applies the transients between ion source 114 and electrode 112. Each transient applied between ion source 114 and electrode 112 accelerates a burst of ions along a path that ends at ion detector 120. In the example shown, the path is a straight line path. In other examples, the path is a zigzag path, a precessing elliptical path, or another path that starts at ion pulser 110 and ends at ion detector 120.

Transient source 116 operates in response to a start signal S received from controller 160. Controller 160 also supplies start signal S to intensity apportioner 140 and to elapsed time counter 180. In the absence of start signal S, elapsed time counter 180 is held in a reset state. At the start of each measurement run performed by mass spectrometer 100, controller 160 generates start signal S and provides the start signal to transient source 116, intensity apportioner 140 and elapsed time counter 180. Receipt of start signal S releases elapsed time counter 180 from its reset state and allows counter 180 to count clock signal CS received from clock 170 to generate elapsed time signal ET. Start signal S additionally causes transient source 116 to start generating transients T.

Elapsed time counter 180 supplies elapsed time signal ET to time of flight calculator 130. In some embodiments (not shown), elapsed time counter 180 additionally supplies elapsed time signal ET to transient source 116 to enable the transient source to provide transient times instead of transients to TOF calculator 130.

Ion detector 120 is implemented as a device such as a Faraday cup, a multichannel plate (MCP), an electron multiplier (continuous structure as well as dynode structure), a conversion dynode, a Daly ion detector, a combination thereof, or another suitable device that generates a signal whose intensity depends on the number of ions incident thereon in a defined interval of time. Typically, ion detector 120 generates an analog signal whose amplitude statistically depends on the number of ions incident on the ion detector during the defined time interval and includes an analog-to-digital converter (not shown) that converts the analog signal to the above-described digital detection signal DS whose intensity represents the amplitude of the analog signal. The analog-to-digital converter has a conversion rate and sampling time defined by clock signal CS received from clock 170.

Typically, the output of ion detector 120 is subject to thresholding in either the analog or digital domain to remove noise. As a result of such thresholding, in some embodiments, each non-zero intensity in detection signal DS can be regarded as constituting a respective detection event. In other embodiments, detection signal DS is subject to a more sophisticated analysis to identify the detection events. As noted above, each detection event has a respective intensity and a respective event time. The event time is the value of elapsed time signal ET output by elapsed time counter 180 at the time that the ions detected as the detection event are detected by ion detector 120. The intensity represents the number of ions incident on the ion detector during a defined time interval starting at the event time. As noted above, yet other embodiments employ multi-sample detection events in which each detection event is composed of a series of consecutive samples in detection signal DS, each sample having a respective intensity. The event time of a multi-sample detection event is the event time of one of the samples constituting the detection event. In an example, the event time is the event time of the first sample in the set. The number of samples constituting a multi-sample detection event is typically no more than that needed to represent the pulse width of the analog signal generated by ion detector 120.

Time of flight calculator 130 has a detection signal input connected to receive detection signal DS from ion detector 120, a transient input connected to receive transients T from irregular transient source 116, an elapsed time input connected to receive elapsed time signal ET from elapsed time counter 180, an event count output connected to provide event count EC to intensity apportioner 140, a start input connected to receive start signal S from controller 160, and an event flag output connected to provide event flags EF to intensity apportioner 140. Time of flight calculator 130 additionally has an event record output connected to provide an initial event record IER for each detection event to intensity apportioner 140.

Figure 2:
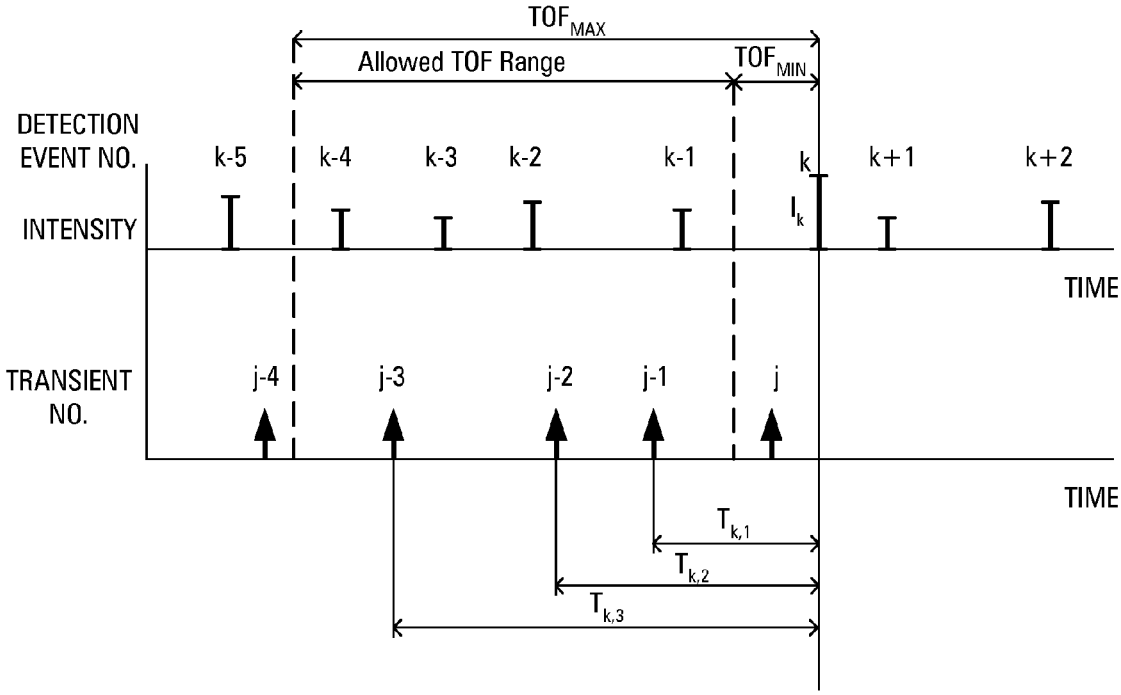
FIG. 2 is a graph that schematically illustrates the operation of the ion pulser, the ion detector and the time-of-flight calculator of the mass spectrometer shown in FIG. 1.

FIG. 2 is a graph that schematically illustrates the operation of ion pulser 110, ion detector 120 and time-of-flight calculator 130. The lower row of FIG. 2 shows the temporally-irregular transients in response to which ion pulser 110 accelerates ions derived from an analyte sample towards ion detector 120. The transients are labelled j through j-4. It can be seen that consecutive transients are separated by differing intervals of time. The upper row of FIG. 2 schematically shows the detection events represented by detection signal DS output by ion detector 120. The detection events are labelled k−5 through k+2. In the example shown, each detection event is depicted a momentary event having a duration equal to one period of clock signal CS. In other embodiments, as will be described in greater detail below, each detection event is a multi-sample detection event composed of a series of samples having an overall duration spanning several periods of clock signal CS. In the example shown, all of the detection events are due to ions of the same ion species.

Consider the detection event labelled k. Hypothetically, detection event k could be the result of detecting the ions accelerated by one any of the transients occurring at a time earlier than detection event k. However, mass spectrometer 100 is characterized by three time-of-flight parameters: a minimum time of flight $TOF_{MIN}$, which is the time taken for a hydrogen ion to travel from ion pulser 110 to ion detector 120, a maximum time of flight $TOF_{MAX}$, defined above, and an allowed time-of-flight range between the minimum time of flight and the maximum time of flight. The minimum time of flight, the maximum time of flight and the allowed time of flight range are shown above the upper row of FIG. 2. Accordingly, detection event k can only be the result of detecting ions accelerated by one of the transients that occur during the allowed time of flight range before detection event k, i.e., at a time earlier than the minimum time of flight before detection event k and later than the maximum time of flight before detection event k. Such transients will be referred to herein as allowed transients and the times of flight calculated by TOF calculator 130 between such transients and a given detection event will be referred to as allowed times of flight for the detection event. Only one of the allowed transients in the allowed time of flight range before detection event k is the true transient that accelerated the ions whose impact on ion detector 120 generated detection event k. The remaining allowed transients are alias transients. The time of flight between the true transient and detection event k is the time of flight that provides the measure of the mass of the ions. The times of flight between the alias transients and detection event k are alias times of flight.

In the example shown in FIG. 2, transients j through j-4 occur before detection event k. However, transient j-4 occurs earlier than the maximum time of flight before detection event k and transient j occurs later than the minimum time of flight before detection event k. Thus, only transients j-1, j-2 and j-3 are allowed transients that occur within the allowed time of flight range of detection event k, and only times of flight $T_{k,1}$, $T_{k,2}$ and $T_{k,3}$ are identified by TOF calculator 130 as allowed times of flight. Intensity apportioner 140 initially operates using initial probabilities to apportion the intensity $I_k$ of detection event k among time of flight bins corresponding to the allowed times of flight $T_{k,1}$, $T_{k,2}$ and $T_{k,3}$ between transients j-1,j-2 and j-3, respectively. Intensity apportioner 140 additionally operates to reapportion the intensity $I_k$ of detection event k among time of flight bins corresponding to allowed times of flight $T_{k,1}$, $T_{k,2}$ and $T_{k,3}$ so that intensity $I_k$ is predominantly apportioned to the time of flight bin corresponding to the true time of flight between the true transient and detection event k and is minimally apportioned to the alias time of flight bins corresponding to the alias times of flight between the alias transients and detection event k. In the example shown, transient (j-2) is the true transient, and intensity apportioner 140 operates to reapportion intensity $I_k$ so that intensity $I_k$ is predominantly apportioned to the time of flight bin corresponding to the true time of flight $T_{k,2}$ between true transient (j-2) and detection event k and is minimally apportioned to the alias time of flight bins corresponding to the alias times of flight $T_{k,1}$ and $T_{k,3}$ between the alias transients (j-1) and (j-3) and detection event k. The number of allowed times of flight is typically substantially larger than the three allowed times of flight shown.

Each TOF bin constituting spectrum memory 150 corresponds to a respective time of flight in the allowed TOF range. For a given detection event, such as detection event k, TOF calculator 130 links to the detection event only those TOF bins of spectrum memory 150 that correspond to the allowed times of flight linked to the detection event.

Referring again to FIG. 1, mass spectrometer 100 operates to determine the time-of-flight spectrum of a sample as follows. The analyte sample is converted to a gaseous form and is ionized to generate sample ions. Prior to the beginning of a measurement run, the intensity accumulation stored in each of the TOF bins is set to zero, the elapsed time represented by elapsed time signal ET is held at zero and the sample ions are introduced into irregular pulser 110. At the beginning of the measurement run, controller 160 provides start signal S to irregular transient source 116, elapsed time counter 180 and TOF calculator 130. In response to start signal S, elapsed time counter 180 counts clock signal CS and provides the resulting elapsed time signal ET to TOF calculator 130. Elapsed time signal ET represents the number of periods of clock signal CS counted since start signal S was received by elapsed time counter 180. Start signal S additionally causes irregular transient source 116 within ion pulser 110 to apply transients between ion source 114 and electrode 112 to accelerate respective pulses of sample ions towards ion detector 120. In response to the ions incident thereon, ion detector 120 generates detection signal DS and outputs the detection signal to TOF calculator 130. As described above, detection signal DS is composed of samples each of which has a respective intensity that represents the number of ions incident on ion detector 120 in a respective period of clock signal CS.

Ion pulser 110 continues to accelerate bursts of ions towards ion detector 120 until the end of the measurement run. The measurement run ends when ion pulser 110 has performed a sufficient number of pulsing operations for a time-of-flight spectrum having a specified accuracy to be obtained. In a conventional mass spectrometer, a measurement run that will provide a time-of-flight spectrum of a specified accuracy has a duration of approximately $n\times TOF_{MAX}$, where n is the number of pulsing operations needed to obtain the specified accuracy and $TOF_{MAX}$ is the maximum time of flight of mass spectrometer 100. In an embodiment of mass spectrometer 100 in accordance with an embodiment of the invention, a measurement run that will provide a time of flight mass spectrum of approximately the same specified accuracy is approximately $TOF_{MAX}+n\tau$, where $\tau$ is the average period of irregular transient source 116. Since $\tau$ is a relatively small fraction of $TOF_{MAX}$, the time required to obtain a time-of-flight spectrum of a given accuracy using mass spectrometer 100 is substantially less than that using a conventional mass spectrometer.

In mass spectrometer 100, TOF calculator 130, intensity apportioner 140 and spectrum memory 150 generate a time-of-flight spectrum by processing detection signal DS output by ion detector 120 during the measurement run. As noted above, detection signal DS represents detection events each having a respective intensity and event time.

Figure 3:
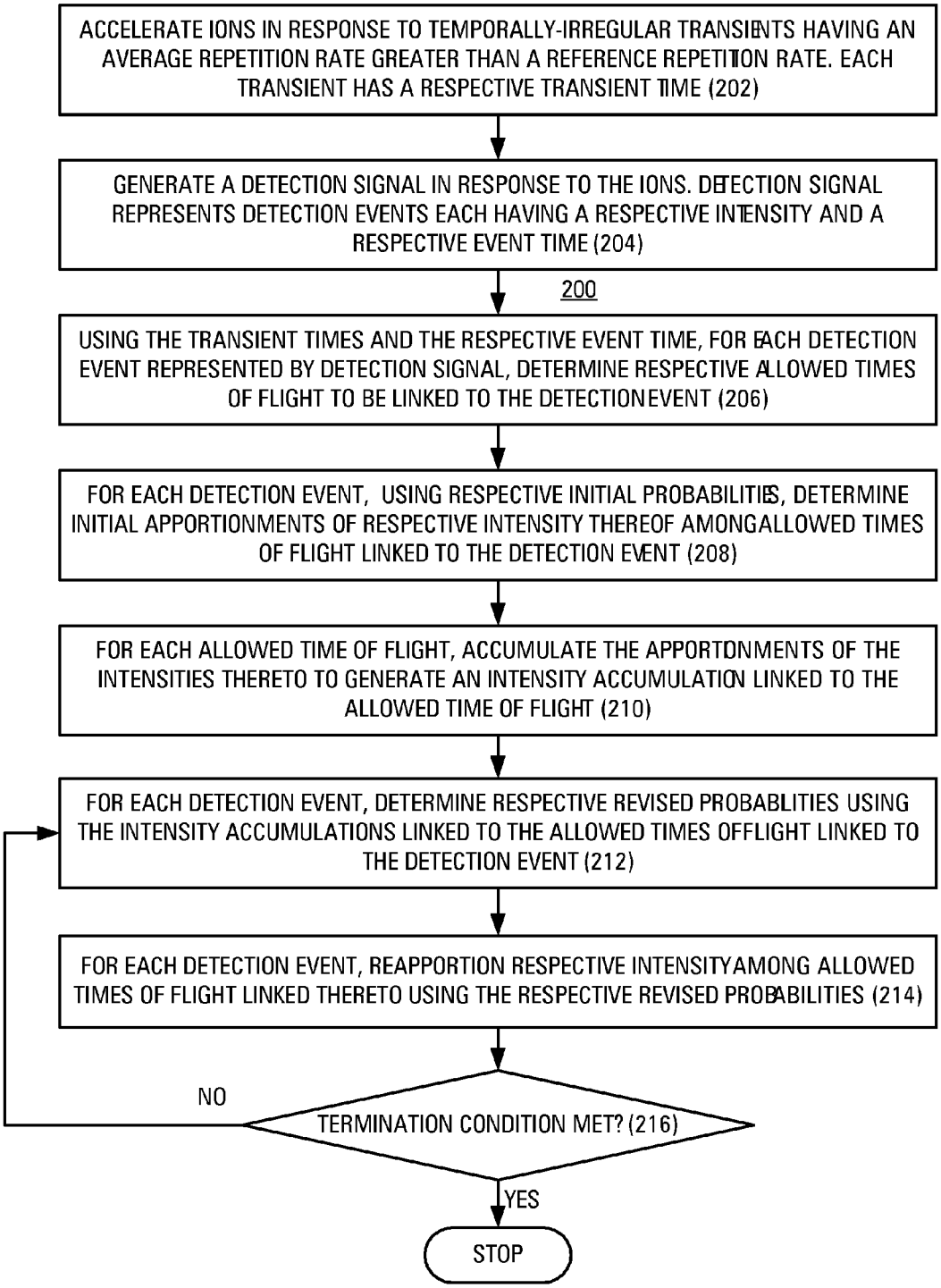
FIG. 3 is a flow chart showing an example of a mass spectrometry method in accordance with an embodiment of the invention.

FIG. 3 is a flow chart showing an example 200 of a mass spectrometry method in accordance with an embodiment of the invention. In an example, mass spectrometer 100 performs method 200 to generate a time-of-flight spectrum. In block 202, ions derived from an analyte sample are accelerated in response to temporally-irregular transients having an average repetition rate greater than the above-described reference repetition rate that depends on the maximum time of flight of the mass spectrometer. The transients each have a respective transient time. In block 204, a detection signal is generated in response to the ions. The detection signal represents detection events each of which has a respective intensity and a respective event time. In block 206, for each detection event represented by the detection signal, respective allowed times of flight between the respective event time and the transient times are determined. In block 208, for each detection event, initial probabilities are used to determine initial apportionments of the intensity of the detection event among the allowed times of flight linked to the detection event. In block 210, for each allowed time of flight, the apportionments of the intensities of the detection events to the allowed time of flight are accumulated to generate an intensity accumulation linked to the allowed time of flight. In block 212, for each detection event, respective revised probabilities are determined using the intensity accumulations linked to the allowed times of flight linked to the detection event. In block 214, for each detection event, the respective intensity is reapportioned among the allowed times of flight linked to the detection event using the respective revised probabilities determined in block 212.

In block 216, a test is performed to determine whether a termination condition has been met. A YES result in block 216 causes execution to stop. A NO result in block 216 causes execution to return to block 212, and blocks 212, 214 and 216 are repeated at least once until the termination condition is met in block 216.

In mass spectrometer 100, block 202 is performed by ion pulser 110, block 204 is performed by ion detector 120, and the detection signal is detection signal DS. Block 206 is performed by TOF calculator 130, and blocks 208, 210, 212, 214 and 216 are performed by intensity apportioner 140 and spectrum memory 150.

Allowed times of flight determining process 206, initial intensity apportioning process 208 and apportionment accumulating process 210 are typically performed more or less concurrently with the measurement run that generates detection signal DS, and revised probability determining process 212 and intensity reapportioning process 214 are performed after the end of the measurement run. Alternatively, the intensity and event time of each detection event and the transient time of each transient are stored during the measurement run, allowed times of flight determining process 206, initial intensity apportioning process 208, apportionment accumulating process 210, revised probability determining process 212 and intensity reapportioning process 214 are all performed after the measurement run using the stored intensities, event times and transient times. In another alternative, allowed times of flight determining process 206, initial intensity apportioning process 208 and apportionment accumulating process 210 are performed concurrently with the measurement run and the resulting intensity and allowed times of flight for each detection event are stored. Revised probability determining process 212 and intensity reapportioning process 214 are then performed after the end of the measurement run (or later) using the stored intensities and allowed times of flight.

Regardless of whether initial intensity apportioning process 208 and apportionment accumulating process 210 are performed concurrently with or after the measurement run, initial intensity apportioning process 208 and apportionment accumulating process 210 generate an approximation of the time-of-flight spectrum of the sample. The approximation of the time-of-flight spectrum is composed of a respective intensity accumulation linked to each of the allowed times of flight determined in block 206. As the number of detection events subject to initial intensity apportioning process 208 and apportionment accumulating process 210 increases, constructive reinforcement of the true times of flight causes the intensity accumulations linked to the allowed times of flight that are the true times of flight of relatively high-abundance ion species to become substantially larger than those linked to allowed times of flight that are alias times of flight of all ion species or are true times of flight of low-abundance ion species. Thus, the time-of-flight spectrum that is generated as the initial intensity apportioning process and apportionment accumulating process are performed exhibits peaks corresponding to the times of flight of the high-abundance ion species even though the intensities of such peaks are approximately equal to the true intensities divided by the average number of alias times of flight linked to each detection event. The remaining apportionments of the intensities that should have been apportioned to the true times of flight are randomly distributed among the remaining allowed times of flight by the irregular firing of ion pulser 110. This generates a noise-like floor that hides the peaks that represent the lower-abundance ion species. The revised probability determining and intensity reapportioning processes performed in blocks 212 and 214 reapportion the intensity accumulations linked to the alias times of flight to the true allowed times of flight to increase the amplitude of the true peaks and to reduce the noise represented by the intensity accumulations linked to the alias times of flight.

To reduce the time needed to generate a time-of-flight spectrum of a defined accuracy, the ion acceleration process of block 202 is performed at irregular intervals to accelerate pulses of ions derived from an analyte sample. The transients that accelerate the ions have an average repetition rate greater than the above-described reference rate defined by the maximum time of flight. Consequently, the detection signal generated by detecting the ions represents a number of superimposed mass scan signals temporally offset from one another by temporal offsets that depend on the irregular timing of the transients used to accelerate the ions. The superimposition of the mass scan signals effectively obscures useful information regarding the sample conveyed by the detection signal. The processes described above with reference to blocks 206-216 of FIG. 3 transform the detection signal into a time-of-flight spectrum that clearly exhibits useful information regarding the sample.

Figure 4:
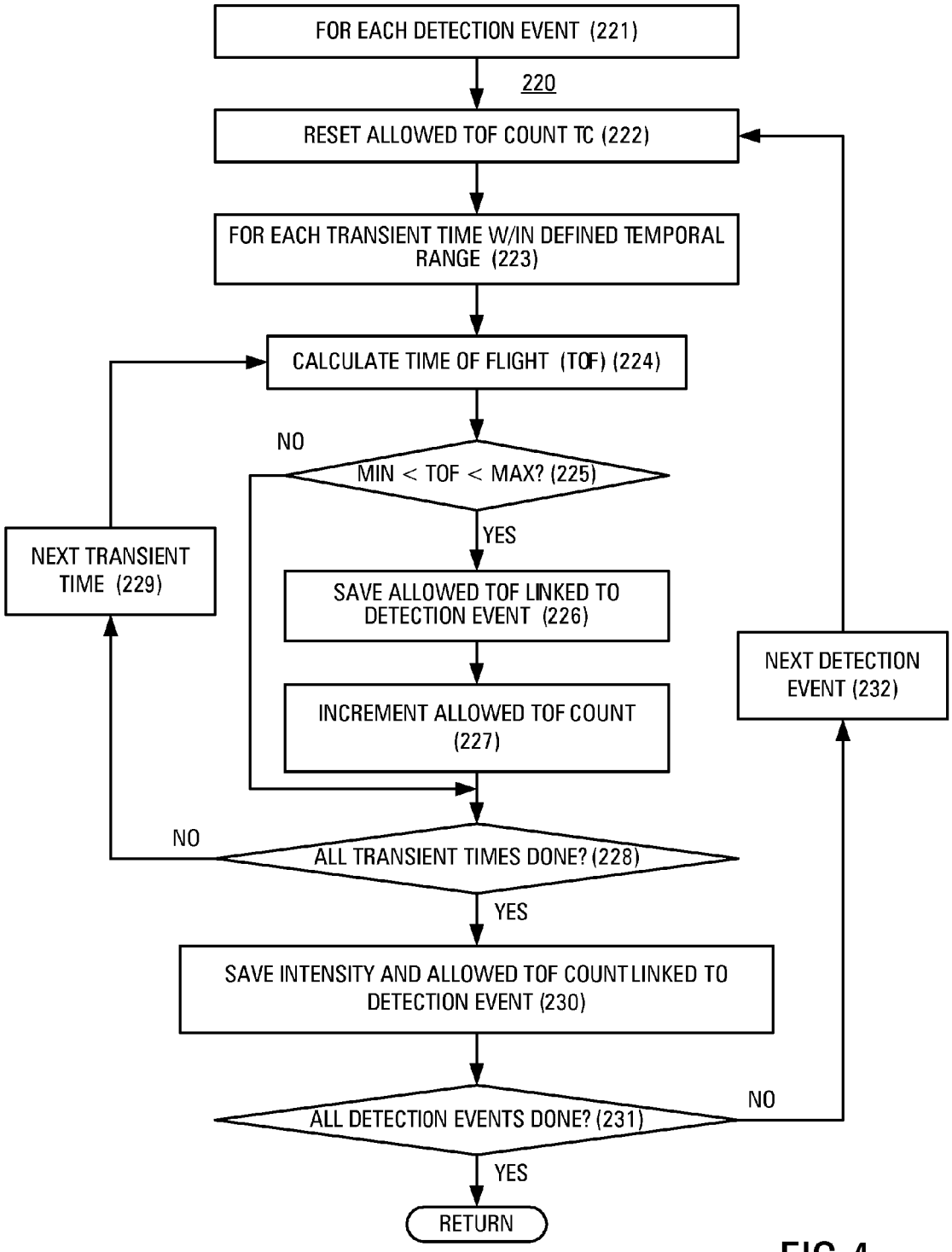
FIG. 4 is a flow chart showing an example of the operations performed in the allowed time of flight determining process shown in block 206 of FIG. 3.

Time-of-flight spectrum generating process 200 described above with reference to FIG. 3 will now be described in greater detail with reference to the flow charts shown in FIGS. 4, 6, 7A, 7B, 7C, 7D, 7E, 8 and 9 and the memory map shown in FIG. 5. FIG. 4 is a flow chart showing an example of the operations 220 performed in the allowed times of flight determining process described above with reference to block 206 of FIG. 3. The allowed times of flight determining process determines the allowed times of flight for each detection event represented by detection signal DS.

Referring to FIG. 4, blocks 221, 231 and 232 establish a per-detection-event loop that is performed for each detection event. A reference to the detection event in this description of FIG. 4 is a reference to the detection event whose allowed times of flight are determined in the current execution of the per-detection-event loop. Within the per-detection-event loop, in block 222, a allowed time of flight (TOF) count TC for the detection event is reset, and blocks 223, 228 and 229 establish a per-transient-time loop that is performed for each transient time within a defined temporal range of the event time of the detection event. The temporal range is greater than above-described maximum time of flight $TOF_{MAX}$. In some embodiments, the temporal range is defined simply by defining a fixed number of transients such that the earliest of them occurs more than maximum time of flight $TOF_{MAX}$ before the event time of the detection event. A reference to the transient time in this description of FIG. 4 is a reference to the transient time used to determine an allowed time of flight in the current execution of the per-transient-time loop.

Within the per-transient-time loop, in block 224, a time of flight between the transient time of the transient and the event time of the detection event is calculated. In an embodiment, this is done by registering the value of elapsed time signal ET at the transient time of the transient to provide the transient time, registering the value of elapsed time signal ET at the time the detection event occurs to provide the event time, and subtracting the registered transient time from the registered event time. The resulting time of flight is expressed in terms of a number of cycles of clock signal CS.

In block 225, a test is performed to determine whether the time of flight calculated in block 224 is an allowed time of flight, i.e., a time of flight greater than the above-described minimum time of flight $TOF_{MIN}$ and less than above-described maximum time of flight $TOF_{MAX}$. A time of flight less than $TOF_{MIN}$ need not be tested for exceeding $TOF_{MAX}$. A NO result in block 225 causes the operation that will be described below with reference to block 228 to be performed. A YES result in block 225 causes the operations that will be described next with reference to blocks 226 and 227 to be performed.

In block 226, the time of flight calculated in block 224 is saved as an allowed time of flight linked to the detection event. In embodiments of mass spectrometer 100 in which the allowed time of flight calculated in block 224 directly addresses a respective one of the TOF bins in spectrum memory 150, the allowed time of flight calculated in block 224 is saved as an allowed TOF linked to the detection event. In embodiments of mass spectrometer 100 in which the time of flight calculated in block 224 is mapped to the address of a respective one of the TOF bins in spectrum memory 150, the address of the TOF bin to which the allowed time of flight calculated in block 224 is mapped is saved as an allowed TOF linked to the detection event. The address of the TOF bin is then used as a surrogate for the allowed time of flight. Regardless of whether the allowed TOF directly addresses a TOF bin or is mapped to the address of a TOF bin, the allowed TOF will be regarded addressing the TOF bin. Ways other than addressing may be used to link each allowed time of flight to its corresponding TOF bin.

In block 227, allowed TOF count TC is incremented. The allowed TOF count TC represents the number of allowed times of flight that have thus far been calculated for the detection event. The count is incremented each time the time of flight calculated in block 224 is determined in block 225 to be an allowed time of flight.

In block 228, a test is performed to determine whether a respective time of flight has been calculated for each of the transients within the defined temporal range described above with reference to block 223. A NO result causes execution to return to block 224 via block 229. Block 229 causes block 224 to calculate a respective time of flight for the next transient time.

A YES result in block 228 causes execution to advance to block 230, where intensity I and allowed TOF count TC for the detection event are stored linked to the detection event.

In block 231, a test is performed to determine whether allowed times of flight have been determined for all of the detection events represented by the detection signal. A NO result causes execution to return to block 222 via block 232. Block 232 causes allowed times of flight to be determined for the next detection event represented by the detection signal. A YES result causes execution to return to the main routine.

In another example, an additional test block (not shown) is interposed between blocks 224 and 225, a different test is performed in block 225, and block 228 is omitted. In this example, in block 223, the transient times are presented in temporal order with the most-recent transient time first so that the times of flight calculated for the detection event in block 224 increase as the number of executions of block 224 increases. In the additional test block, a test is performed to determine whether the time of flight calculated in block 224 is less than the above-described minimum time of flight $TOF_{MIN}$. A YES result in the additional test block causes execution to return to block 224 via block 229. A NO result causes execution to advance to block 225. In block 225, a test is performed to determine whether the time of flight calculated in block 224 is greater than the above-described maximum time of flight $TOF_{MAX}$. A YES result causes execution to advance to block 230. A NO result causes execution to advance to blocks 226 and 227, and then to return to block 224 via block 229.

Figure 5:
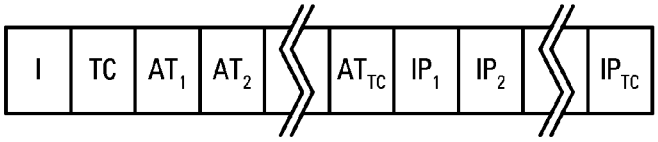
FIG. 5 is a schematic diagram showing an example of the structure of an event record pertaining to a single detection event.

FIG. 5 is a schematic diagram showing an example of an event record that may be used to store the intensity, the allowed TOF count, the allowed times of flight and respective previous intensity apportionments for a single detection event. The intensity, the allowed TOF count and the allowed TOFs are generated by allowed times of flight determining process 220 described above with reference to FIG. 4. In an example that will be referred to throughout this disclosure, the event record is stored in a respective memory location in a detection event memory that constitutes part of intensity apportioner 140. An example 502 of such detection event memory will be described below with reference to FIG. 11 and will be referred to in the following description. In the event record shown, the intensity I, allowed TOF count TC, allowed times of flight and previous intensity apportionments pertaining to a single detection event are stored in respective fields. A respective event record for each of the detection events represented by the detection signal is stored in detection event memory 502 or in another suitable memory structure. The event records are arranged in temporal order or another suitable order.

The example of the event record for a single detection event shown is composed of the following fields: an intensity field I, an allowed TOF count field TC, allowed time of flight fields $AT_1$ through $AT_{TC}$ equal in number to allowed TOF count TC, and intensity apportionment fields $IP_1$ through $IP_{TC}$ also equal in number to allowed TOF count TC. The allowed TOF fields store the allowed times of flight linked to the detection event. Each intensity apportionment field and its respective allowed TOF field are addressed by a TOF index TI whose value ranges from 1 to allowed TOF count TC (or zero to TC−1). Each allowed TOF field AT contains a respective one of the allowed times of flight linked to the detection event. The intensity field, the allowed TOF count field and the allowed TOF fields are populated when the event record for the detection event is initially stored in detection event memory 502. Each intensity apportionment field contains a respective previous apportionment of the intensity I of the detection event. The intensity apportionment fields are populated with previous intensity apportionments after the event record has been stored in detection event memory 502, as will be described below with reference to block 255 of FIGS. 7A-7D and block 280 of FIGS. 7C and 7D.

Another example of the event record has a fixed number of allowed TOF fields and a fixed number of intensity apportionment fields. The fixed number of fields is greater than or equal to the maximum value of allowed TOF count TC. In event records in which the number of allowed times of flight is less than the maximum, not all of the allowed TOF fields and intensity apportionment fields are occupied. A fixed number of allowed TOF fields and intensity apportionment fields requires that detection event memory 502 be larger than when a variable number of fields is used, as described above, but using a fixed number of fields may simplify the operation of the detection event memory. In another example of the event record, probability fields are used instead of the above-described intensity apportionment fields. Probability fields are required to store fewer bits than corresponding intensity apportionment fields and therefore using probability fields reduces the size of detection event memory 502. However, an additional multiplication operation is needed to convert each probability read from the event record to a respective intensity apportionment. The possibility of this alternative should be borne in mind when reading the descriptions below.

Figure 6:
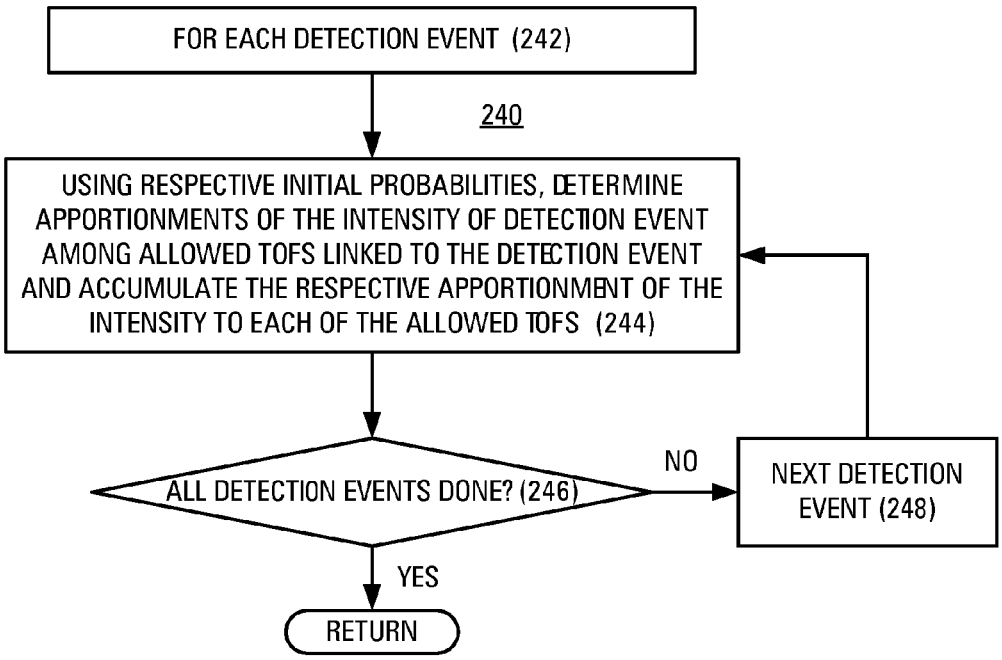
FIG. 6 is a flow chart showing an example of the operations performed in the initial intensity apportioning and apportionment accumulating processes shown in blocks 208 and 210 of FIG. 3.

FIG. 6 is a flow chart showing an example of the operations 240 performed in the initial intensity apportioning process and the apportionment accumulating process described above with reference to blocks 208 and 210 of FIG. 3. Blocks 242, 246 and 248 establish a per-detection-event loop that is performed for each detection event represented by the detection signal and for which an intensity and at least one linked allowed TOF has been saved as described above with reference to FIG. 4. A reference to the detection event in this description of FIG. 6 and in the descriptions of FIGS. 7A-7E, 8 and 9 below is a reference to the detection event whose intensity is initially apportioned in the current execution of the per-detection-event loop.

In block 244, respective initial probabilities are used to determine apportionments of the intensity of the detection event among the allowed times of flight linked to the detection event and the apportionment of the intensity to each of the allowed times of flight is accumulated. Examples of the operations performed in block 244 will be described below with reference to FIGS. 7A-7D. These examples refer to an event record stored in detection event memory 502. However, other storage structures capable of storing the intensity, allowed time of flight count, allowed times of flight and intensity apportionments pertaining to each detection even can alternatively be used.

In block 246, a test is performed to determine whether apportionments of the intensities of all the detection events have been determined using respective initial probabilities. A NO result in block 246 causes execution to return to block 244 via block 248. Block 248 causes block 244 to be performed for the next detection event. A YES result in block 246 causes execution to return to the main routine.

Figure 12:
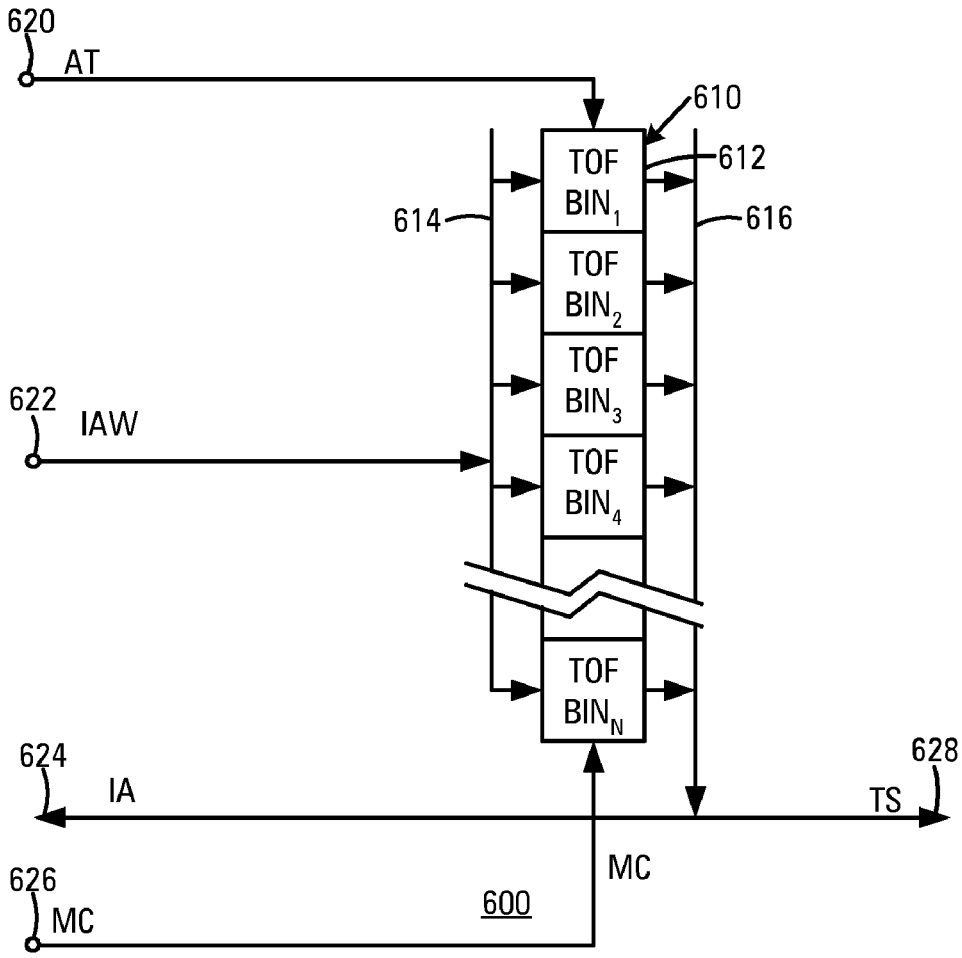
FIG. 12 is a block diagram showing an example of the spectrum memory of the mass spectrometer shown in FIG. 1.

After the allowed time of flight determining process described above with reference to FIG. 4 and block 206 of FIG. 3, the initial intensity apportioning and apportionment accumulating processes described above with reference to FIG. 6 and blocks 208 and 210 of FIG. 3 have been performed, detection event memory 502 described below with reference to FIG. 12 is populated with the following data pertaining to each detection event: intensity I, allowed TOF count TC and each allowed TOF AT linked to the detection event. Moreover, accumulations of the apportionments of intensities of the detection events among the allowed TOFs linked thereto have been saved linked to the allowed TOFs, e.g., in spectrum memory 150.

Figure 7A:
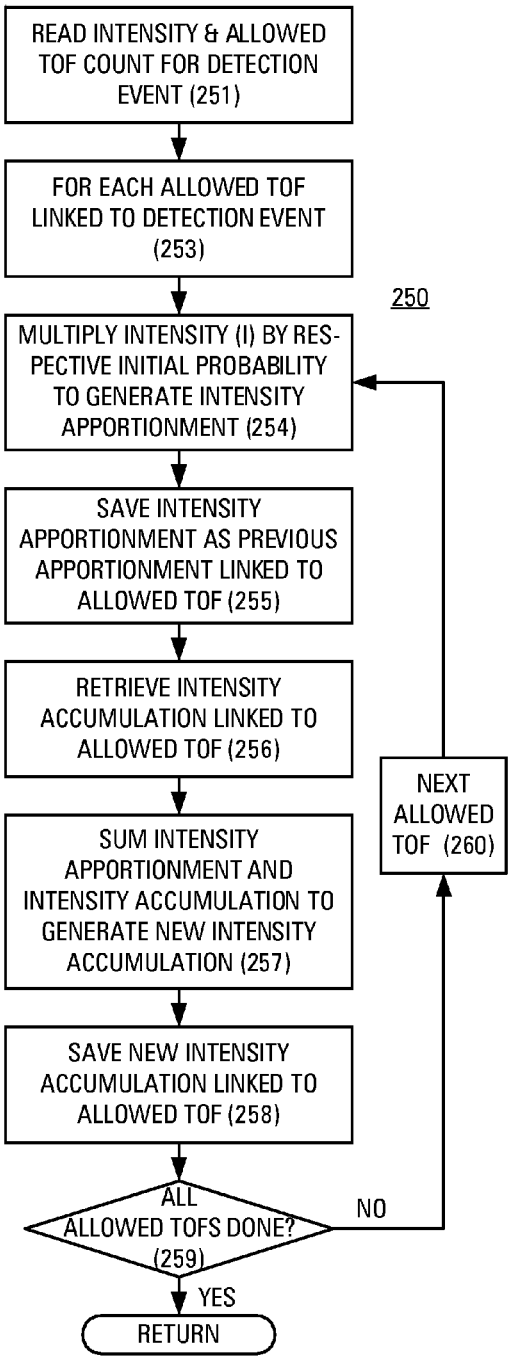
FIG. 7A is a flow chart showing an example of the operations performed in the initial intensity apportioning process shown in block 244 of FIG. 6 using respective initial probabilities.

FIG. 7A is a flow chart showing an example of the operations 250 performed in the initial intensity apportioning and apportionment accumulating processes described above with reference to block 244 of FIG. 6. The initial intensity apportioning process uses initial probabilities to determine initial apportionments of the intensity I of the detection event among the allowed times of flight linked to the detection event. Examples of the way operations 250 are performed by an example of mass spectrometer 100 will also be described.

Referring to FIG. 7A, in block 251, the intensity I and the allowed TOF count TC for the detection event are read, e.g., from the respective fields of the event record in detection event memory 502 pertaining to the detection event. Blocks 253, 259 and 260 establish a per-allowed-TOF loop that is performed for each allowed TOF linked to the detection event. The number of allowed times of flight is indicated by allowed TOF count TC. A reference to the allowed time of flight or the allowed TOF in the descriptions of FIGS. 7A-7E is a reference to the allowed TOF for which an initial intensity apportionment is being determined in the current execution of the loop. The per-allowed-TOF loop is composed of operations that determine an apportionment of intensity I of the detection event to the allowed TOF, add such intensity apportionment to the intensity accumulation (if any) linked to the allowed TOF to generate a new intensity accumulation, and save the new intensity accumulation linked to the respective allowed TOF. In mass spectrometer 100, the intensity accumulations are stored in respective TOF bins of spectrum memory 150 addressed by the allowed times of flight linked to the detection event.

In block 254, the intensity I for the detection event is multiplied by a respective initial probability to generate a respective intensity apportionment. The respective initial probability is respective to the allowed TOF.

In block 255, the intensity apportionment calculated in block 254 is saved as a previous intensity apportionment linked to the allowed TOF. In an example, the intensity apportionment is stored as a previous intensity apportionment in the intensity apportionment field $IP_n$ of the event record in detection event memory 502 pertaining to the detection event. Intensity apportionment field $IP_n$ is linked to allowed TOF field $AT_n$. The previous intensity apportionment is previous in the sense that it provides a record of the previous apportionment of the intensity of the detection event to the intensity accumulation linked to the allowed TOF for use in the subsequently-performed revised probability determining process described above with reference to block 212 of FIG. 3.

In block 256, the intensity accumulation (if any) linked to the allowed TOF is retrieved. Such intensity accumulation has been generated by accumulating intensity apportionments obtained from detection events whose intensities have been initially apportioned to the allowed TOF earlier in the measurement run. If the no detection event has had its intensity apportioned to the allowed TOF earlier in the measurement run, no intensity accumulation is linked to the allowed TOF, and an intensity accumulation of zero is retrieved. In an example, the allowed TOF is read out from the respective allowed TOF field of the event record of detection event memory 502 pertaining to the detection event and is output to spectrum memory 150 to provide the address of one of the TOF bins therein. The intensity accumulation (if any) is then read out from the TOF bin addressed by the allowed TOF.

In block 257, the intensity apportionment calculated in block 254 and the intensity accumulation retrieved in block 256 are summed to generate a new intensity accumulation.

In block 258, the new intensity accumulation generated in block 257 is saved. In an example, the new intensity accumulation written to the TOF bin in spectrum memory 150 from which the intensity accumulation was read out in the example set forth above in the description of block 256.

In block 259, a test is performed to determine whether a respective intensity apportionment has been made for each of the allowed times of flight linked to the detection event. A NO result causes execution to return to block 254 via block 260. Block 260 causes an intensity apportionment to be made for the next allowed TOF linked to the detection event. A NO result causes execution to return to the main routine shown in FIG. 4.

Blocks 256, 257 and 258, in which the intensity apportionment linked to the allowed TOF and the retrieved intensity accumulation linked to the allowed TOF are summed and saved linked to the allowed TOF, constitute part of apportionment accumulating process 210 that accumulates the apportionments of the intensities of the detection events to each allowed TOF to generate a respective intensity accumulation linked to the allowed TOF. The intensity accumulations linked to the real allowed TOFs progressively increase as the number of detection events processed increases.

In another example, each intensity apportionment generated in block 254 is individually cached linked to the allowed TOF, and blocks 256, 257 and 258 are omitted. Then, when all the detection events represented by the detection signal have been processed, the intensity apportionments cached linked to each of the allowed TOFs are summed to generate the respective intensity accumulation linked to the allowed TOF. Each intensity accumulation is then saved linked to the respective allowed TOF. In an example, the allowed TOF is saved in the TOF bin of spectrum memory 150 addressed by the allowed TOF. This alternative is also suitable for use in the initial intensity apportioning processes described below with reference to FIGS. 7B, 7D and 7E. This alternative is not suitable for use in the initial intensity apportioning process to be described below with reference to FIG. 7C because it does not generate the intensity accumulations used by the process to determine the initial probabilities until the end of the initial intensity apportioning process.

In yet another example, each intensity apportionment determined in block 254 is individually cached linked to the allowed TOF, and blocks 256, 257 and 258 are omitted. Then, when a predetermined number of the detection events represented by the detection signal have been processed, for each of the allowed TOFs, the respective intensity apportionments cached linked thereto are summed to generate a respective intensity accumulation linked to the allowed TOF, and the intensity accumulation is saved linked to the allowed TOF. Then, when further predetermined number of the detection events have been processed, for each of the allowed TOFs, the intensity apportionments cached linked thereto are summed together with the previous intensity accumulation (if any) linked thereto to generate a respective new intensity accumulation linked thereto, and the new intensity accumulation is saved linked to the respective allowed TOF. The operation just described is repeated until all the detection events represented by the detection signal have been processed. This alternative is suitable for use in the initial intensity apportioning processes described below with reference to FIGS. 7B, 7D and 7E, and also for use in the initial intensity apportioning process to be described below with reference to FIG. 7C because it determines the intensity accumulations used by the process to determine the initial probabilities at intervals during the initial intensity apportioning process.

Figure 7B:
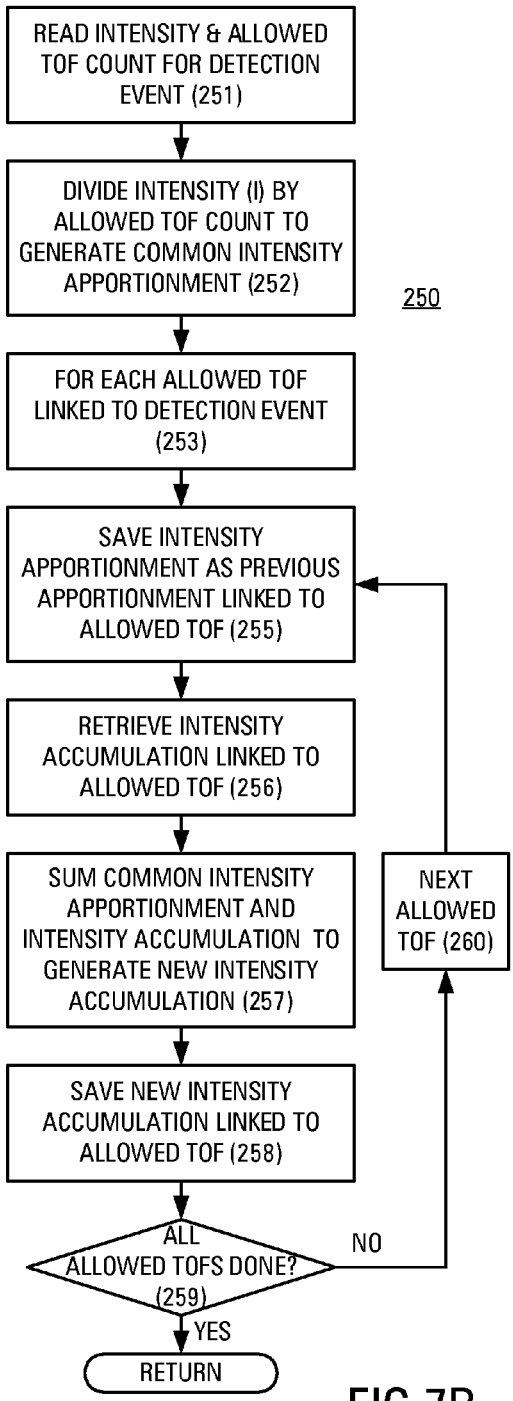
FIG. 7B is a flow chart showing a second example of the operations performed in the initial intensity apportioning process shown in block 244 of FIG. 6 using a common initial probability.

In some embodiments, the only initial probabilities that can be used in the initial intensity apportioning and apportionment accumulating processes are those that equally apportion the intensity for the detection event among the allowed times of flight linked to the detection event. FIG. 7B is a flow chart showing an example of the operations 250 performed in an example of the initial intensity apportioning and apportionment accumulating processes described above with reference to block 244 of FIG. 6 in which equal initial probabilities used to apportion the intensity of each detection event. Elements of FIG. 7B corresponding to those described above with reference to FIG. 7A are indicated using the same reference numerals and will not be described again in detail. Referring to FIG. 7B, block 252 is performed prior to block 253 that establishes the per-allowed-TOF loop. In block 252, the intensity I for the detection event is divided by the allowed TOF count TC to generate a common intensity apportionment. The common intensity apportionment is common in the sense that it is used as the initial intensity apportionment for each of the allowed times of flight linked to the detection event.

In the example shown, intensity I is divided by allowed TOF count TC to generate the common intensity apportionment directly. Alternatively, a common initial probability is calculated by dividing unity (1) by allowed TOF count TC, and intensity I is then multiplied by such common initial probability to generate the common intensity apportionment. The common initial probability is common in the sense that it is the initial probability used to determine the intensity apportionment for each of the allowed times of flight linked to the detection event.

Block 254 (FIG. 7A) is omitted from the per-allowed-TOF loop. In block 255, the common intensity apportionment calculated in block 252 is saved as a previous intensity apportionment linked to the allowed TOF. In block 257, the common intensity apportionment calculated in block 252 and the intensity apportionment (if any) retrieved in block 256 are summed. In block 258, the resulting new intensity accumulation is saved linked to the allowed TOF.

Other embodiments of the initial intensity apportioning process described above with reference to block 206 of FIG. 3 perform the initial intensity apportioning using unequal initial probabilities in preference to equal initial probabilities wherever possible. Equal initial probabilities have to be used for apportioning the intensity of the first detection event. Thereafter, equal initial probabilities are used only when an intensity accumulation of zero is linked to each of the allowed times of flight linked to the detection event. Using unequal initial probabilities speeds up the time-of-flight spectrum generation process by reducing the number of times blocks 212-216 of FIG. 3 have to be performed before the termination condition is met.

Figure 7C:
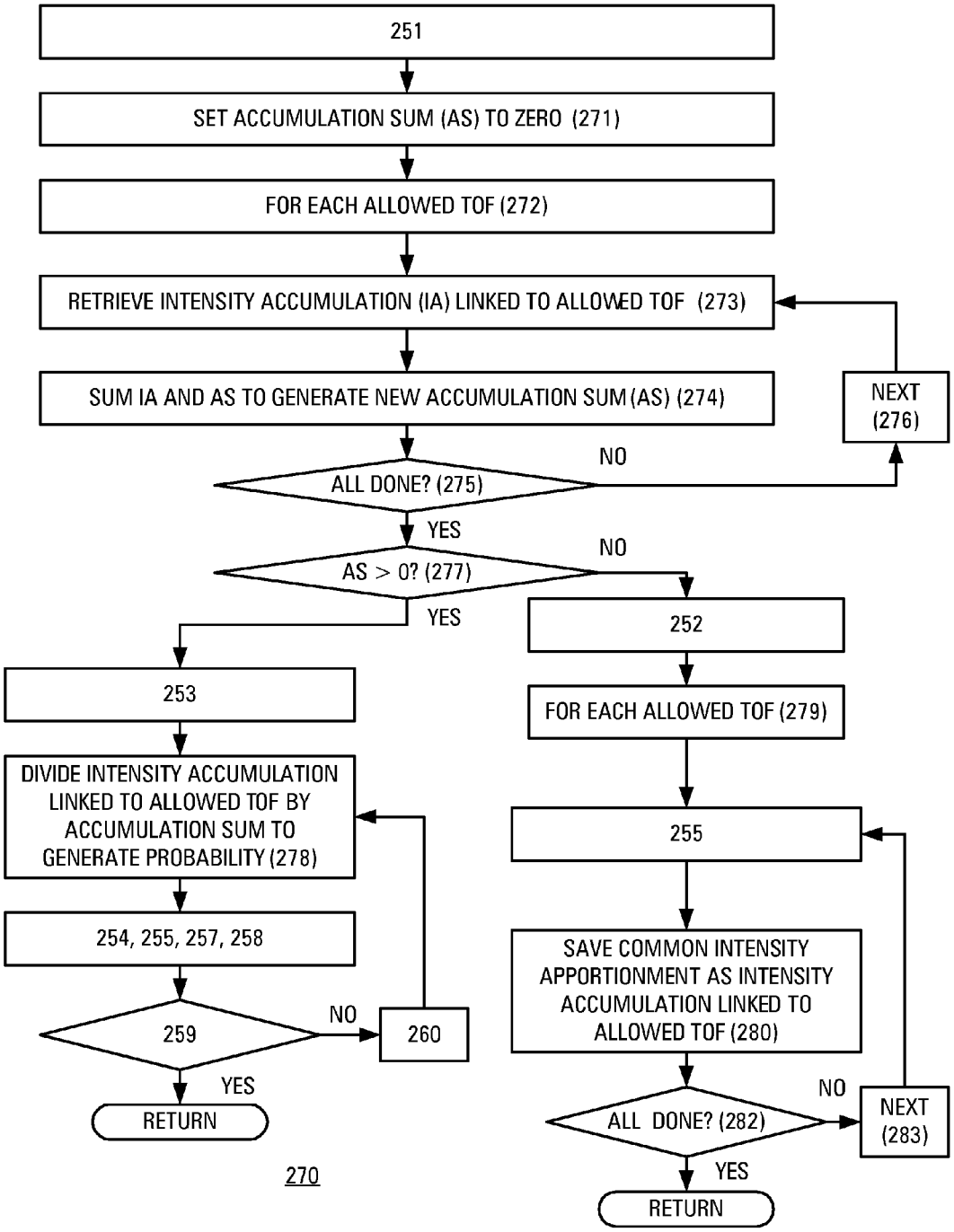
FIG. 7C is a flow chart showing a second example of the operations performed in the initial intensity apportioning process shown in block 244 of FIG. 6 selectively using respective initial probabilities or a common initial probability.

FIG. 7C is a flow chart showing an example of processing 270 performed in an example of the initial intensity apportioning process described above with reference to block 244 of FIG. 6 in which unequal initial probabilities are applied where possible. At the beginning of each measurement run, prior to performing processing 270, an intensity accumulation of zero is linked to each of the allowed times of flight linked to each of the detection events represented by the detection signal. In an example, an intensity accumulation of zero is written to each of the TOF bins of spectrum memory 150. In FIG. 7C, blocks similar to those described above with reference to FIGS. 7A and 7B are indicated using the same reference numerals and will not be described in detail again. Processing 270 can be applied to all detection events since it will automatically apply equal initial probabilities to the first detection event.

After block 251 is performed to read the intensity I and allowed TOF count TC for the detection event, block 271 sets an accumulation sum AS to zero. Blocks 272, 275 and 276 then establish a per-allowed-TOF loop that is performed for each allowed TOF linked to the detection event. In block 273, the intensity accumulation (if any) linked to the allowed TOF is retrieved. In an example, the allowed TOF is read out from the respective allowed TOF field of the event record of detection event memory 502 pertaining to the detection event and is output to spectrum memory 150 to provide the address of one of the TOF bins therein. The intensity accumulation (if any) stored in the TOF bin addressed by the allowed TOF is read out and. Typically, the retrieved intensity accumulation is cached linked to the allowed TOF for use in block 278, to be described below. Additionally, the allowed TOF is cached to provide the address of the TOF bin to which the revised intensity accumulation generated from the intensity accumulation retrieved in block 273 is written, as will be described below with reference to block 258. Alternatively, the allowed TOF is not cached, but is read out once more from detection event memory 502 in block 258.

In block 274, the intensity accumulation retrieved in block 273 and accumulation sum AS are summed to generate a new accumulation sum AS. The value of accumulation sum AS generated the final time block 274 is performed for the detection event will be referred to as the final value of accumulation sum AS.

In block 275, a test is performed to determine whether respective intensity accumulations have been retrieved for all of the allowed times of flight linked to the detection event. A NO result causes execution to return to block 273 via block 276. Block 276 causes blocks 273 and 274 to be performed for the next allowed TOF.

A YES result in block 275 causes execution to advance to block 277, where a test is performed to determine whether the final value of accumulation sum AS generated in block 274 is greater than zero. A final value of accumulation sum AS greater than zero indicates that a respective intensity accumulation greater than zero is linked to at least one of the allowed times of flight linked to the detection event, and that unequal initial probabilities can be used. A final value of accumulation sum AS equal to zero indicates that none of the allowed times of flight has an intensity accumulation greater than zero linked thereto, and that equal initial probabilities should be used.

A YES result in block 277 causes execution to advance to block 253, described above, which, together with blocks 259 and 260, described above, establish a per-allowed-TOF loop that is performed for each allowed TOF linked to the detection event. Within the loop, in block 278, the intensity accumulation linked to the allowed TOF is divided by the final value of accumulation sum AS generated in block 274 to generate a respective initial probability for the allowed TOF. In an example, the intensity accumulation cached linked to the allowed TOF in block 273 is used in this operation. Then, blocks 254, 255, 257 and 258 described above with reference to FIG. 7A are performed to generate a respective intensity apportionment for the allowed TOF (block 254), to store the intensity apportionment as a previous intensity apportionment linked to the allowed TOF (block 255), to sum the intensity apportionment generated in block 254 and the intensity accumulation retrieved in block 273 and linked to the allowed TOF to generate a new intensity accumulation (block 257), and to save the new intensity accumulation linked to the allowed TOF (block 258). In block 254, the intensity apportionment is obtained by multiplying the initial probability generated in block 278 by the intensity of the detection event. Thus, the intensity of the detection event is apportioned among the allowed times of flight linked to the detection event using the respective initial probabilities calculated in block 278. In an example, in block 258, the allowed TOF cached in block 273 is read and is output to spectrum memory 150. Alternatively, the allowed TOF is read out from the respective allowed TOF field in the event record of detection event memory 502 pertaining to the detection event and is output to spectrum memory 150. The revised intensity accumulation generated in block 257 is then written to the TOF bin addressed by the allowed TOF. The revised intensity accumulation overwrites the intensity accumulation previously stored in the TOF bin.

A NO result in block 277 causes execution to advance to above-described block 252 where a common intensity apportionment is calculated by dividing intensity I for the detection event by allowed TOF count TC. As noted above, this operation is equivalent to calculating a common initial probability and multiplying intensity I by the common initial probability. Next, block 279, together with blocks 282 and 283 establish a per-allowed-TOF loop that is performed for each allowed TOF linked to the detection event. Within the loop, the operation described above with reference to block 255 of FIG. 7B is performed using the common intensity apportionment determined in block 252 as the initial intensity apportionment. Additionally, operations similar to those described above with reference to blocks 256, 257 and 258 of FIG. 7B can be performed using the common intensity apportionment calculated in block 252. However, since the NO result in block 277 indicates that respective intensity accumulations of zero are linked to all of the allowed times of flight linked to the detection event, the simpler operation shown in block 280 can be performed instead. This operation simply saves the common intensity apportionment linked to the respective allowed TOF instead of performing an accumulation operation. Specifically, in block 280, the common intensity apportionment is saved as an intensity accumulation linked to the allowed TOF. In this case, block 280 is a first operation constituting above-described apportionment accumulating process 210.

In an example, the common intensity apportionment is written to the TOF bin of spectrum memory 150 addressed by the allowed TOF.

In block 282, a test is performed to determine whether an instance of the common intensity apportionment has been saved linked to each of the allowed times of flight linked to the detection event. A NO result causes execution to return to block 280 via block 283. Block 283 causes blocks 280 and 281 to be performed for the next allowed TOF. A YES result causes execution to return to the main routine.

In some applications, multiple measurement runs are sequentially performed using the same sample, or a sample that slowly evolves over time. For example, multiple measurement runs are sequentially performed as the sample elutes from a liquid chromatograph. In such applications, because of the basic similarities between the time-of-flight spectra generated from the consecutive measurement runs, the time-of-flight spectrum generated from a given measurement run can be used to determine the initial probabilities used to determine the apportionments of the intensities of the detection events represented by the detection signal generated in the next measurement run.

Figure 7D:
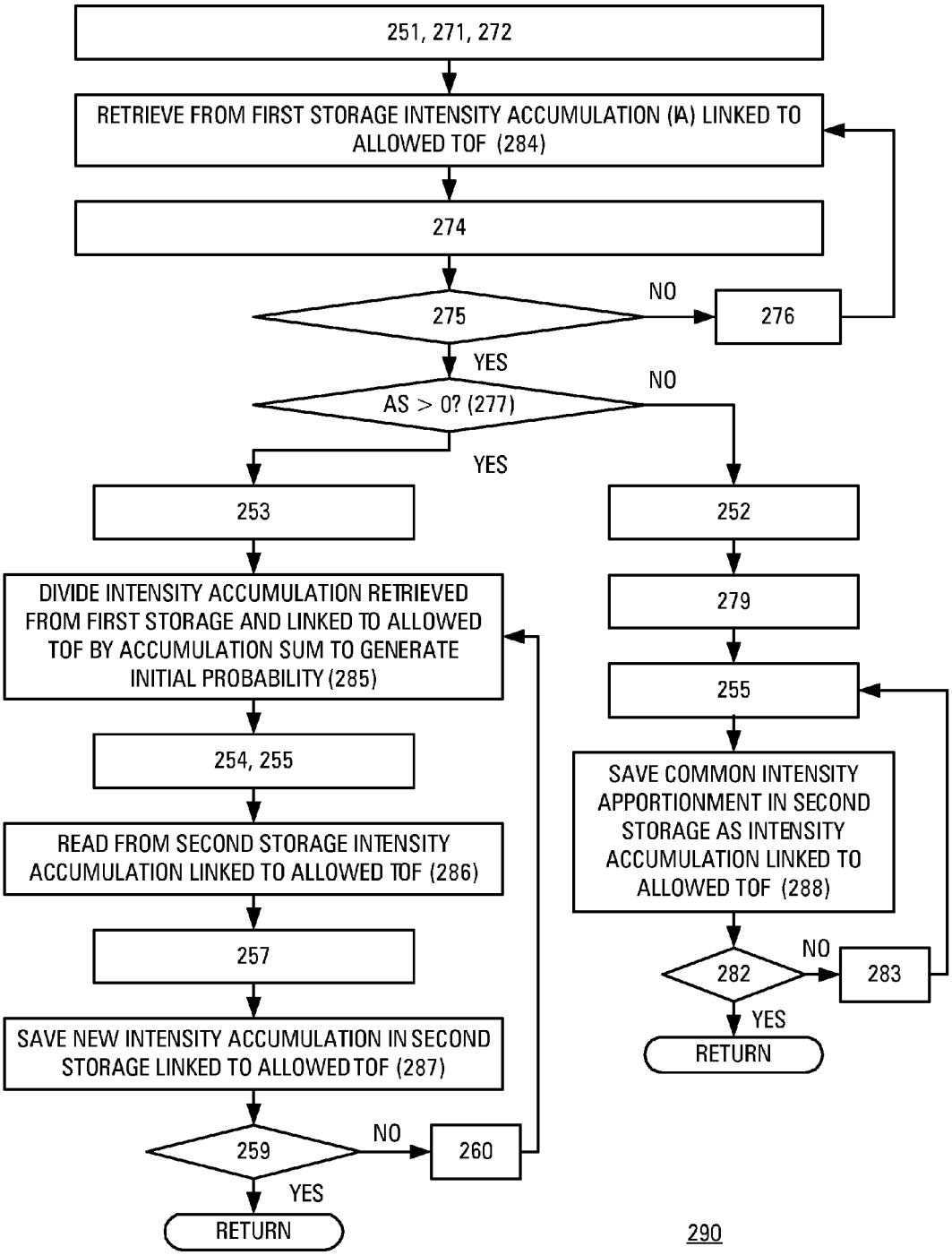
FIG. 7D is a flow chart showing a first example of the operations performed in the initial intensity apportioning process shown in block 244 of FIG. 6 selectively using respective initial probabilities based on a previously-generated time-of-flight spectrum or a common initial probability.

FIG. 7D is a flow chart showing an example of the operations 290 performed in an example of the initial intensity apportioning and apportionment accumulating process described above with reference to block 244 of FIG. 6 in which apportionments of the intensities of the detection events are determined using initial probabilities calculated using the time-of-flight spectrum generated from a previous measurement run. Blocks corresponding to those described above with reference to FIGS. 7A, 7B and 7C are indicated using the same reference numerals and will not be described in detail again.

To generate initial probabilities from the time-of-flight spectrum generated from the previous measurement run, the intensity accumulations generated from the previous measurement run are saved independently of the intensity accumulations generated from the current measurement run. To simplify the following explanation, the former will be said to be saved in first storage and the latter will be said to be saved in second storage. An example of mass spectrometer 100 capable of performing such an initial intensity apportioning process incorporates an additional spectrum memory nominally identical to spectrum memory 150 to provide the second storage. The spectrum memories are identically addressed such that a given allowed TOF provided to the spectrum memories will address corresponding TOF bins in both spectrum memories.

In the following description, it will be assumed that the time-of-flight spectrum generated from the previous measurement run is stored in the first storage, and that a value of zero was stored in each TOF bin in the second storage as the revised probability determining and intensity reapportioning processes were being performed following the previous measurement run. The operations shown in FIG. 7D are then performed. In this initial probabilities are determined from the time-of-flight spectrum stored in the first storage and such initial probabilities are used to determine apportionments of the intensities of the detection events represented by the detection signal generated in the current measurement run. The intensity apportionments to each allowed TOF are accumulated and the resulting intensity accumulations are stored in the second storage linked to their respective allowed times of flight. Then, the intensity accumulations stored in second storage are subject to a sufficient number of iterations of revised probability determining and intensity reapportioning processes to generate a time-of-flight spectrum that is saved in the second storage. During the next measurement run, the operations shown in FIG. 7D are again performed to determine initial probabilities from the time-of-flight spectrum stored in the second storage, and such initial probabilities are used to generate intensity accumulations that are stored in the first storage. The roles of the first storage and the second storage alternate as just described in successive measurement runs.

Referring now to FIG. 7D, the operations described above with reference to blocks 251, 271 and 272 of FIG. 7C are performed. Block 272, together with blocks 275 and 276 establish a per-allowed-TOF loop. In block 284, an operation similar to that described above with reference to block 273 of FIG. 7C is performed to retrieve from the first storage the intensity accumulation linked to the allowed TOF. Thus, the respective intensity accumulation generated during the previous measurement run is retrieved. In an example, the intensity accumulation is retrieved from a TOF bin in the first storage addressed by the allowed TOF. Then, the operations described above with reference to blocks 274, 275 and 276 of FIG. 7C are performed. The per-allowed-TOF loop established by blocks 272, 275 and 276 is performed until accumulation sum AS includes contributions from all of the intensity accumulations linked to the allowed times of flight linked to the detection event. Such intensity accumulations were retrieved from the first storage in block 284. In block 277 a test is performed to determine whether the final value of the accumulation sum is greater than zero.

A YES result in block 277 causes execution to advance to block 253 that, together with blocks 259 and 260, establishes a per-allowed-TOF loop in a manner similar to that described above with reference to FIG. 7A. In block 285, the intensity accumulation retrieved from the first storage and linked to the allowed TOF is divided by the final accumulation sum generated in block 274 to generate a respective initial probability linked to the allowed TOF. The operations described above with reference to blocks 254 and 255 of FIG. 7C are then performed using the initial probability to generate a respective intensity apportionment for the allowed TOF and to save the intensity apportionment as a previous intensity apportionment linked to the allowed TOF. In block 286, the intensity accumulation (if any) linked to the allowed TOF is retrieved from the second storage. In an example, the intensity accumulation is read from a respective TOF bin in the second storage addressed by the allowed TOF. Then, the operation described above with reference to block 257 of FIG. 7A is performed to sum the intensity apportionment generated in block 285 and the intensity accumulation retrieved from the second storage in block 286 to generate a new intensity accumulation. In block 287, an operation similar to that described above with reference to block 258 of FIG. 7A is performed to save the new intensity accumulation in the second storage linked to the allowed TOF. In an example, the intensity accumulation is saved in the TOF bin in the second storage addressed by the allowed TOF.

Blocks 257 and 287, in which the intensity apportionment linked to the allowed TOF and the intensity accumulation linked to the allowed TOF retrieved from the second storage are summed and are saved in the second storage linked to the allowed TOF, constitute part of apportionment accumulating process 210 that accumulates the apportionments of the intensities of the detection events to the allowed TOF to generate a respective intensity accumulation.

Finally, the operations described above with reference to blocks 259 and 260 of FIG. 7A are performed. The per-allowed-TOF loop established by blocks 253, 259 and 260 is performed until the initial apportionment operation has been performed for all the allowed times of flight linked to the detection event.

A NO result in block 277 causes operations similar to those described above with reference to blocks 252, 279 and 255 of FIG. 7C to be performed. Block 279, together with blocks 282 and 283, establish a per-allowed-TOF loop. In block 288, an operation similar to that described above with reference to block 281 of FIG. 7C is performed to save the common intensity apportionment in the second storage as an intensity accumulation linked the allowed TOF. Block 288 is a first operation constituting above-described apportionment accumulating process 210. In an example, the intensity accumulation is written to the TOF bin in the second storage addressed by the allowed TOF. Finally, the operations described above with reference to blocks 282 and 283 of FIG. 7C are performed. The per-allowed-TOF loop is performed until the initial apportionment operation has been performed for all the allowed times of flight linked to the detection event.

The operations just described are repeated until the intensities of all of the detection events represented by the detection signal generated during the current measurement run have been initially apportioned and the resulting intensity accumulations have been saved in the second storage. One or more iterations of the revised probability determining and intensity reapportioning processes described above with reference to blocks 212 and 214 of FIG. 3 are performed to generate a final time-of-flight spectrum from the initial time-of-flight spectrum stored in the second storage. The final time-of-flight spectrum is also stored in the second storage. Then, during the next measurement run, the roles of the first storage and the second storage are reversed. Alternatively, the intensity reapportioning process stores the final time-of-flight spectrum in the first storage, or the final time-of-flight spectrum stored in the second storage is copied to the first storage before the beginning of the next measurement run. In these alternative operational modes, the roles of the first and second storage do not reverse between consecutive measurement runs.

Figure 7E:
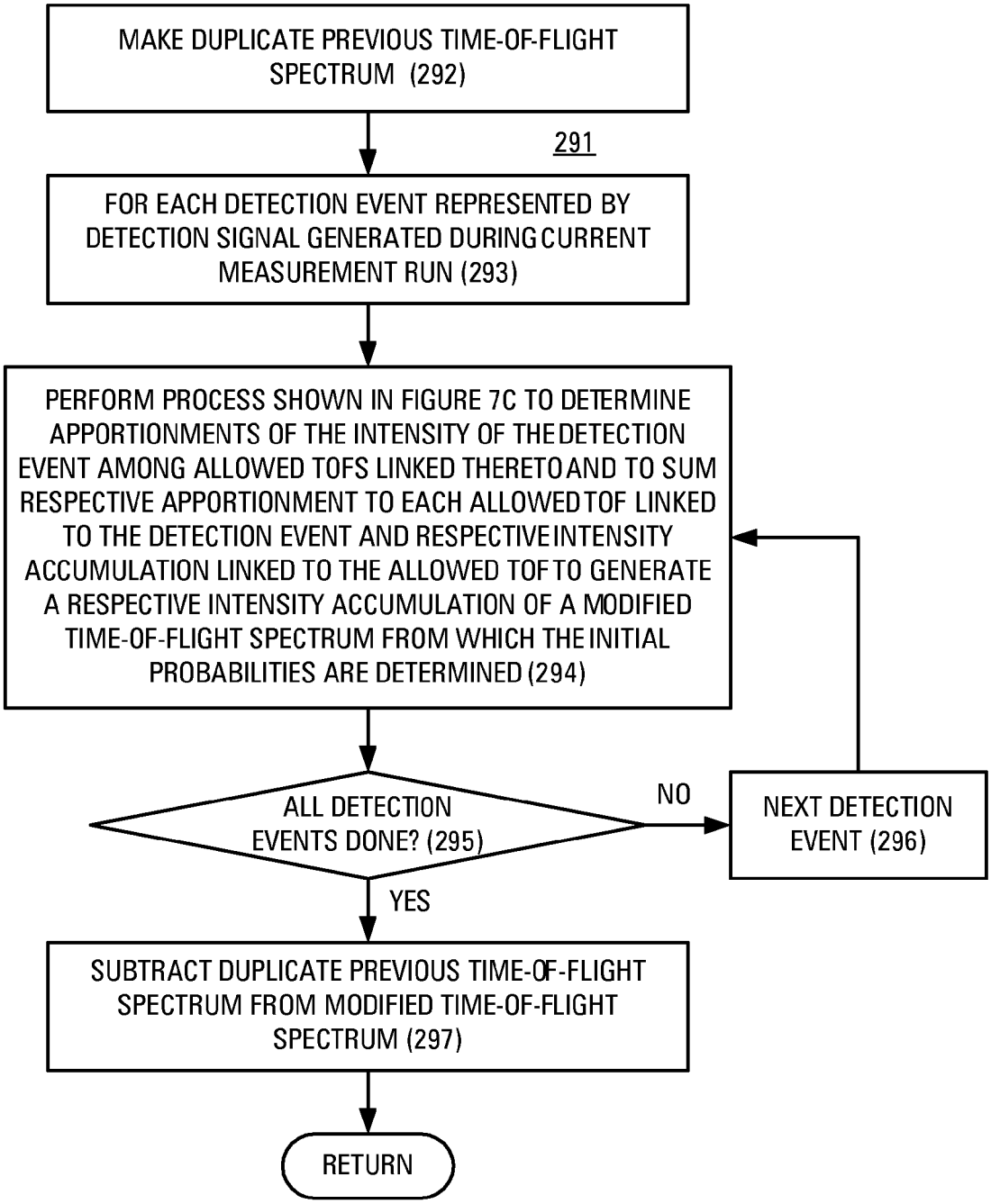
FIG. 7E is a flow chart showing an example of the operations performed in the initial intensity apportioning and apportionment accumulating processes shown in blocks 208 and 210 of FIG. 3 selectively using respective initial probabilities based on a previously-generated time-of-flight spectrum or a common initial probability.

In the various examples described above with reference to FIG. 7D, the intensity accumulations generated during the current measurement run remain separate from those generated during the previous measurement run and from which the initial probabilities used in determining the initial intensity apportionment are derived. Consequently, the intensity accumulations generated from the current measurement run are not taken into account in determining the initial probabilities. FIG. 7E is a flow chart showing another example 291 of the operations performed in the initial intensity apportionment process and the apportionment accumulating process described above with reference to blocks 208 and 210 of FIG. 3 in which the initial probabilities are determined based on a modified time-of-flight spectrum that includes contributions from the time-of-flight spectrum generated from the previous measurement run and the intensity accumulations generated from the current measurement run. The time-of-flight spectrum generated from the previous measurement run will be referred to as a previous time-of-flight spectrum and the detection signal obtained during the previous measurement run will be referred to as a previous detection signal.

Referring to FIG. 7E, in block 292, a duplicate previous time-of-flight spectrum is made. In the example shown in FIG. 7E, the duplicate previous time-of-flight spectrum is made by making a copy of the previous time-of-flight spectrum and also retaining the previous time-of-flight spectrum. In an implementation of this example, mass spectrometer 100 is additionally composed of an auxiliary memory (not shown) similar in size and addressing to spectrum memory 150. The duplicate previous time-of-flight spectrum is made by copying the contents of spectrum memory 150 to the auxiliary memory and additionally retaining the previous time-of-flight spectrum in the spectrum memory. Since the auxiliary memory is subject only to sequential read and write operations, it can be constructed using slower and less expensive memory devices than spectrum memory 150.

Blocks 293, 295 and 296 establish a per-detection-event loop that is performed for each detection event represented by the detection signal generated during the current measurement run and for which an intensity and at least one linked allowed TOF has been saved as described above with reference to FIG. 4. Such detection signal will be referred to as a current detection signal. In block 294, the process described above with reference to FIG. 7C is performed to determine apportionments of the intensity of the detection event among allowed TOFs linked thereto and to sum the respective apportionment to each allowed TOF linked to the detection event and the respective intensity accumulation linked to the allowed TOF to generate a respective intensity accumulation of a modified time-of-flight spectrum. The modified time-of-flight spectrum is modified in the sense that it is the previous time-of-flight spectrum to which has been added the apportionments of the intensities of the detection events represented by the current detection signal. With respect to most detection events, the process described above with reference to FIG. 7C generates the initial probabilities based on the modified time-of-flight spectrum, which includes the previous time-of-flight spectrum. Thus, the initial probabilities are based not only on the previous time-of-flight spectrum but also the intensity accumulations generated from the current measurement run.

In block 295, a test is performed to determine whether apportionments of the intensities of all the detection events represented by the current detection signal have been determined. A NO result in block 295 causes execution to return to block 294 via block 296. Block 296 causes the process described above with reference to FIG. 7C to be performed for the next detection event represented by the current detection signal. A YES result in block 246 causes execution to advance to block 297.

In block 297, the duplicate previous time-of-flight spectrum is subtracted from the modified time-of-flight spectrum generated by repetitively performing block 294. This effectively generates an initial intensity accumulation linked to each allowed TOF linked to each detection event represented by the current detection signal. In an example, blocks of the auxiliary memory and corresponding blocks of spectrum memory 150 are read, each block of the auxiliary memory is subtracted from the corresponding block of spectrum memory 150 and the resulting block of differences is stored back in spectrum memory 150. This is equivalent to, but faster than, subtracting the respective intensity accumulation stored in the TOF bin addressed by each allowed TOF in the auxiliary memory from the respective intensity accumulation stored in the TOF bin addressed by the same allowed TOF in spectrum memory 150 to leave in the TOF bin of spectrum memory 150 addressed by the allowed TOF the respective initial intensity accumulation obtained by accumulating the apportionments to the allowed TOF of the intensities of the detection events represented by the current detection signal.

In another example, in block 292, the duplicate previous time-of-flight spectrum is made by not clearing the detection event records generated during the previous measurement run prior to the current measurement run, and storing the detection event records generated during the current measurement run in addition thereto. The detection event records generated during the previous measurement run will be referred to as previous event records and those generated during the current measurement run will be referred to as current event records. The previous intensity apportionments (or the intensities and probabilities) stored in the previous event records linked to each allowed TOF, when accumulated, generate a respective intensity accumulation of the prior TOF spectrum. Thus, the previous intensity apportionments stored in the previous event records collectively constitute the duplicate previous time-of-flight spectrum.

Block 294 is performed as described above using initial probabilities generated from the modified time-of-flight spectrum that includes the previous time-of-flight spectrum. Then, in block 297, the duplicate previous time-of-flight spectrum is subtracted from the modified time-of-flight spectrum as follows: for each allowed TOF linked to each detection event, the previous intensity apportionment linked to the allowed TOF in the previous event record pertaining to the detection event is subtracted from the intensity accumulation linked to the allowed TOF in the modified time-of-flight spectrum. This effectively generates a respective initial intensity accumulation for each of the allowed TOFs linked to the detection events represented by the current detection signal.

In an example, the detection event memory in which the detection event records are stored is increased in size to accommodate both the previous event records and the current event records, and a single spectrum memory 150 is employed. Each previous intensity apportionment is read from the intensity apportionment field linked to the allowed TOF in the previous event record pertaining to the detection event, and the respective intensity accumulation is read from the TOF bin in spectrum memory 150 addressed by the allowed TOF.

In yet another example based on the example just described, the previous time-of-flight spectrum is generated from a predetermined number X of firings of ion pulser 110, and the detection event records from which the previous time-of-flight spectrum was generated are retained as previous detection records, as described above. Moreover, those of the previous detection event records that resulted from the first Y of those firings are identified as older event records and the detection event records that resulted from the remaining pulser firings are identified as newer event records. In an example, $Y=X/2$. In another example, $Y=0.4X$.

Then, during the current measurement run, Y pulser firings are performed and the detection event records for the resulting detection events are stored as additional event records in addition to the previous event records. In block 294, the intensities of the detection events represented by the additional event records are subject to the process described above with reference to FIG. 7C. This apportions the intensities of the detection events among the allowed times of flight linked thereto using initial probabilities obtained from the previous time-of-flight spectrum. Then, in block 297, for each allowed TOF linked to each detection event stored in a respective older event record, the previous intensity apportionment stored therein linked to the allowed TOF is subtracted from the intensity accumulation linked to the allowed TOF. Additionally, the older event records are cleared.

The event records that remain, i.e., the newer event records and the additional event records, are then subject to iterations of the revised probability determining and intensity reapportioning processes described above with reference to blocks 212 and 214 of FIG. 3 until a termination condition is met to generate a new time-of-flight spectrum. The new time-of-flight spectrum is generated in part from the previous measurement run (the new event records) and in part from the current measurement run (the additional event records). The process just described can then be repeated with another measurement run to generate additional time-of-flight spectra. When $Y \geqq X/2$, only two measurement runs contribute to each TOF spectrum, but when $Y < X/2$, three or more measurement runs contribute to each TOF spectrum.

Other ways of deriving the initial probabilities from a previously-generated time-of-flight spectrum are possible and may be used.

Regardless of the operations used to perform initial intensity apportioning and apportionment accumulating processes 208 and 210, at the completion of the initial intensity apportioning and apportionment accumulating processes, apportionments of the intensity of each of the detection events represented by the detection signal among the allowed times of flight linked thereto have been determined, and the respective intensity apportionments to each allowed time of flight have been accumulated to generate a respective intensity accumulation linked to the allowed time of flight. Typically, a majority of the possible times of flight have no intensity accumulations linked thereto.

Figure 8:
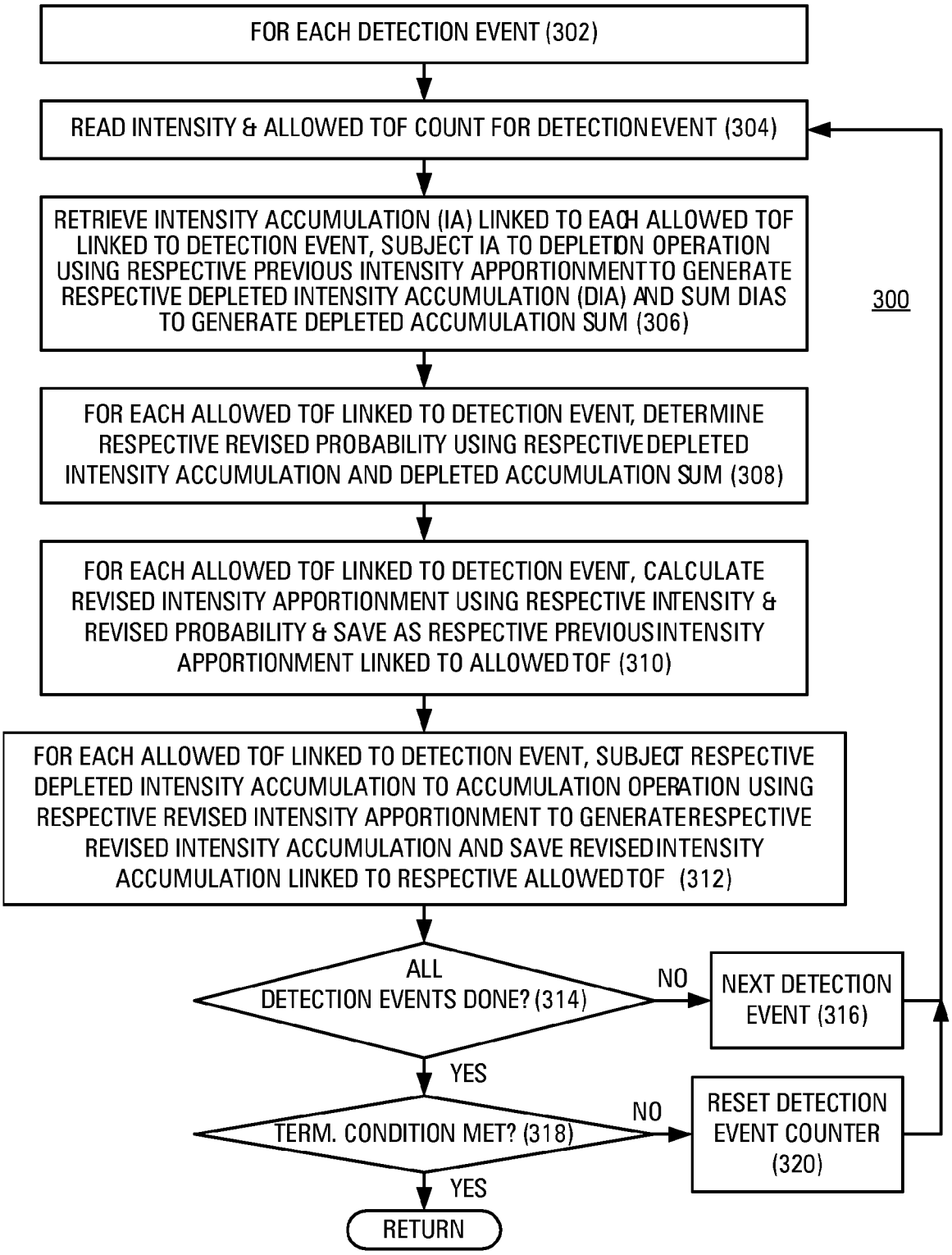
FIG. 8 is a flow chart showing an example of the operations performed in the revised probability determining process and the intensity reapportioning process respectively shown in blocks 212 and 214 of FIG. 3.

FIG. 8 is a flow chart showing an example of the operations 300 performed in the revised probability determining process and the intensity reapportioning process respectively described above with reference to blocks 212 and 214 of FIG. 3. In an example, the revised probability determining and intensity reapportioning processes are performed by the intensity apportioner 140 of mass spectrometer 100. The revised probability determining process determines respective revised probabilities for reapportioning the intensity of each detection event among the allowed TOFs linked to the detection event. The respective revised probability for apportioning the intensity of the detection event to each allowed TOF linked to the detection event is proportional to a depleted intensity accumulation linked to the allowed TOF. The depleted intensity accumulation is the sum of the apportionments to the allowed TOF of the respective intensities of all the detection events, other than the detection event whose intensity is being reapportioned, whose intensities are apportioned to the allowed TOF. In an example in which the intensities of the detection event and nine other detection events are apportioned to the allowed TOF, the depleted intensity accumulation is the sum of the apportionments of the intensities of the nine other detection events to the allowed TOF. The apportionment of the intensity of the detection event whose intensity is being reapportioned is excluded from the depleted intensity accumulation. The depleted intensity accumulation provides a measure of the extent to which the allowed TOF is a real TOF or an alias TOF from an aggregate point of view of all the detection events whose respective intensities are apportioned to the allowed TOF other than the detection event whose intensity is being reapportioned. In the examples described herein, the depleted intensity accumulation linked to each allowed TOF is derived from the intensity accumulation linked to the allowed TOF simply by subtracting the most recent apportionment of the intensity of the detection event from the intensity accumulation linked to the allowed TOF. The intensity accumulation represents the sum of the apportionments of the intensities of all the detection events (e.g., all 10 detection events) whose intensities are apportioned to the allowed TOF. Other ways of generating the depleted intensity accumulation exist and can be used instead.

In other examples, intensity accumulations are used instead of depleted intensity accumulations to increase the speed of operation, but this typically yields a sub-optimum result. Alternatively, intensity accumulations are used in the initial iterations and depleted intensity accumulations are used in the final iterations to produce a closer-to-optimum result more quickly than when depleted intensity accumulations are used throughout.

The intensity reapportioning process reapportions the respective intensity of each detection event among the allowed times of flight linked to the detection event in accordance with the revised probabilities generated by the revised probability determining process. The intensity reapportioning process reapportions the intensity of each detection event away from the alias times of flight and towards the true time of flight linked to the detection event. The operations described with reference to FIG. 8 will be described in greater detail below with reference to FIG. 9.

Referring to FIG. 8, blocks 302, 314 and 316 establish a per-detection-event loop that is performed for each detection event represented by detection signal DS. A reference in the description of FIG. 8 to the detection event is a reference to the detection event for which revised probabilities are determined and whose intensity is reapportioned in the current execution of the loop. Examples of the performance of these operations by mass spectrometer 100 will also be described. These examples will refer to detection event memory 502, to be described below with reference to FIGS. 11 and 13, on the understanding that another suitable storage structure can alternatively be used. In block 304, intensity I and allowed TOF count TC for the detection event are read. In an example, intensity I and allowed TOF count TC are read from respective fields in the event record in detection event memory 502 pertaining to the detection event. Allowed TOF count TC read in block 304 defines the number of allowed times of flight linked to the detection event. In mass spectrometer 100, allowed TOF count TC additionally defines the number of TOF bins in spectrum memory 150 linked to the detection event. In an example, allowed TOF count TC is read from the allowed TOF count field of the event record in detection event memory 502 that pertains to the detection event.

In block 306, the respective intensity accumulation linked to each allowed TOF linked to the detection event is retrieved, the intensity accumulation is subject to a depletion operation that generates a respective depleted intensity accumulation, and the depleted intensity accumulations generated for all the allowed times of flight linked to the detection event are summed to generate a depleted accumulation sum. In the depletion operation, the previous apportionment of the intensity of the detection event to the allowed TOF is subtracted from the intensity accumulation linked to the allowed TOF to generate the respective depleted intensity accumulation. In an example, the intensity accumulation linked to the allowed TOF is read from the respective TOF bin of spectrum memory 150 addressed by the allowed TOF and the previous intensity apportionment is read from the intensity apportionment field of the event record in detection event memory 502 pertaining to the detection event. The intensity apportionment field from with the previous intensity apportionment is read is that linked to the allowed TOF.

Each depleted intensity accumulation generated by the depletion operation is the intensity accumulation linked to the respective allowed TOF from which is subtracted the previous intensity apportionment PIP previously contributed by the detection event to the intensity accumulation linked to the allowed TOF. The previous intensity apportionment is the intensity apportionment linked to the allowed TOF that was added to the intensity accumulation when block 257 of FIG. 7A was performed or the most-recent time block 366 of FIG. 9B (to be described below) was performed for the detection event and the allowed TOF to which the intensity accumulation is linked.

In block 308, for each allowed TOF linked to the detection event, a respective revised probability is determined using the respective depleted intensity accumulation generated in block 306 for the allowed TOF and the depleted accumulation sum also generated in block 306 for the detection event. The revised probabilities are used to reapportion the intensity of the detection event among the allowed times of flight linked to the detection event.

In block 310, for each allowed TOF linked to the detection event, a revised intensity apportionment is calculated using the respective revised probability calculated in block 310 for the allowed TOF, and the revised intensity apportionment is saved as a previous intensity apportionment PIP linked to the allowed TOF, overwriting any previous intensity apportionment linked thereto.

In block 312, for each allowed TOF linked to the detection event, the respective depleted intensity accumulation calculated in block 306 is subject to an accumulation operation using the respective revised intensity apportionment calculated in block 310 and the resulting revised intensity accumulation is saved linked to the allowed TOF. In an example, the revised intensity accumulations are stored in the respective TOF bins of spectrum memory 150 addressed by the allowed TOFs linked to the detection event.

The operations performed in block 306 using the previous intensity apportionment and in block 312 using the revised intensity apportionment modify the intensity accumulations linked to the allowed times of flight linked to the detection event and hence reapportion the intensity of the detection event among the allowed times of flight linked thereto. Predominantly, the overall effect of these operations is to increase the intensity accumulation linked to the real allowed TOF linked to the detection event, and to decrease the intensity accumulations linked to the alias allowed TOFs linked to the detection event.

In block 314, a test is performed to determine whether revised probability determining and intensity reapportioning operations have been performed for all the detection events represented by the detection signal. A NO result causes execution to return to block 304 via block 316. Block 316 causes block 304 to read the intensity I and the allowed TOF count TC for the next detection event. A YES result causes execution to advance to block 318.

In block 318, a test is performed to determine whether a defined termination condition has been met. For example, in block 318, the test may determine whether it has been performed a predetermined number of times. In another example, a statistical criterion is tested to determine whether the termination condition has been met. For example, such criteria as an $L_1$ norm, an $L_2$ norm or an $L_{infinity}$ norm are applied to changes in the intensity apportionments or the probabilities between successive executions of blocks 212 and 214 of FIG. 3. A NO result in block 318 causes execution to return to block 304 via block 320. Block 320 resets the detection event counter so that the intensity and the allowed TOF count for the first detection event represented by detection signal DS are read once more in block 304. However, due to the operations performed in blocks 306-312, the respective intensity accumulations linked to many of the allowed TOFs differ in value from the previous time the allowed TOF count for the first detection event was read in block 304.

A YES result in block 318 causes execution to return to the main routine. Then, a read-out command will cause the time-of-flight spectrum composed of a respective intensity accumulation stored linked to each allowed TOF to be read out for conversion into a mass spectrum. Processes and systems for converting a time-of-flight spectrum to a mass spectrum are known in the art and will therefore not be described here.

In another example of operations 300, block 312 is omitted and the previous intensity apportionment that was subtracted from the intensity accumulation linked to the allowed TOF in block 306 is subtracted from the revised intensity apportionment calculated in block 310 to generate an apportionment difference that is individually cached linked to the allowed TOF. Then, when all the detection events represented by the detection signal have been processed (a YES result is obtained in block 314, described below), for each allowed TOF, the intensity apportionment saved linked thereto and the respective apportionment differences cached linked thereto are summed to generate the revised intensity accumulation linked thereto and the revised intensity accumulation is then saved linked to the allowed TOF. In an example, the revised intensity accumulation is saved in the TOF bin of spectrum memory 150 addressed by the allowed TOF. This alternative causes processing 300 to converge on the termination condition more slowly than when the processing includes block 312 because the intensity accumulations do not change until the summing operation just described has been performed after all the detection events have been processed.

In yet another example in which probabilities are saved instead of intensity apportionments, blocks 310 and 312 are omitted, and the previous probability linked to the allowed TOF and retrieved in block 306 is subtracted from the revised probability linked to the allowed TOF and determined in block 308 to generate a probability difference linked to the allowed TOF. The intensity for the detection event is multiplied by the probability difference linked to the allowed TOF to generate the above-mentioned apportionment difference that is cached linked to the allowed TOF, as described above. Other ways of calculating the revised intensity apportionments are possible and can be used.

Figure 9A:
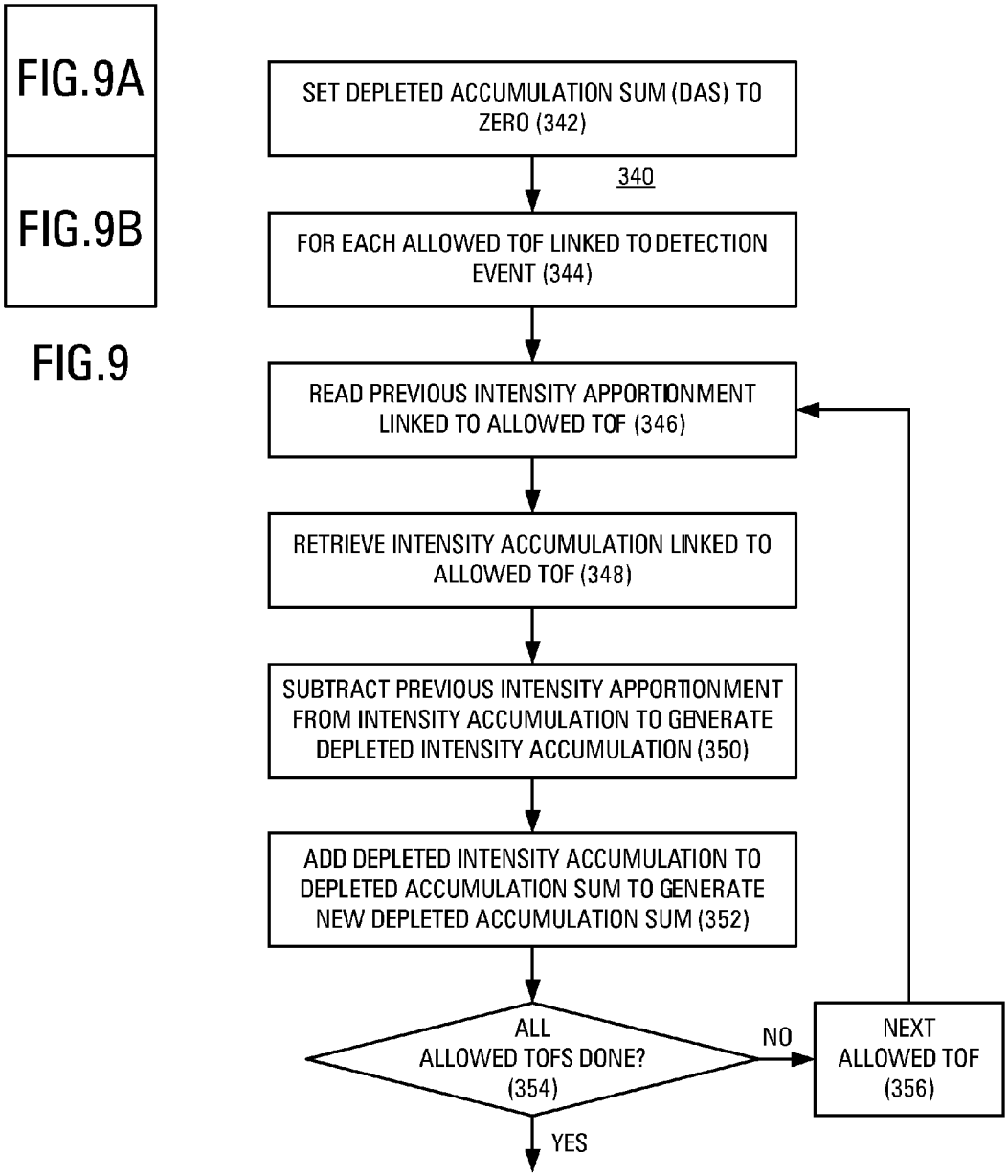
FIG. 9 is a flow chart showing an example of the operations performed in blocks 306, 308, 310 and 312 shown in FIG. 8.

FIG. 9 is a flow chart showing an example 340 of the operations performed in blocks 306, 308, 310 and 312 of FIG. 8. The processing shown in FIG. 9 is performed for each detection event represented by detection signal DS. Referring first to the portion of FIG. 9 shown in FIG. 9A, in block 342, a depleted accumulation sum DAS is set to zero.

Blocks 344, 354 and 356 establish a per-allowed-TOF loop that is performed for each allowed TOF linked to the detection event. A reference in the description of FIG. 9A to the allowed TOF or the allowed time of flight is a reference to the allowed TOF to which is linked the intensity apportionment that is subject to a depletion operation in the current execution of the loop.

Within the per-allowed-TOF loop, in block 346, the previous intensity apportionment linked to the allowed TOF is read. In an example, the previous intensity apportionment is read out from the respective field of the event record in detection event memory 502 pertaining to the detection event. The previous intensity apportionment was stored in the event record either during the initial intensity apportionment process described above with reference to block 244 of FIG. 6, or during a previous iteration of the intensity reapportioning process described above with reference to block 310 of FIG. 8. Alternatively, in an example in which a previous probability is saved instead of a previous intensity apportionment, the previous intensity apportionment is obtained by multiplying the previous probability read out in block 346 by intensity I read in block 304 of FIG. 8.

In block 348, the intensity accumulation linked to the allowed TOF is retrieved. In an example, the allowed TOF is read out from the respective allowed TOF field in the event record of detection event memory 502 pertaining to the detection event and is output to spectrum memory 150. The intensity accumulation is read out from the TOF bin in spectrum memory 150 addressed by the allowed TOF. Additionally, the allowed TOF is cached to provide the address of the TOF bin to which the revised intensity accumulation generated from the intensity accumulation retrieved in block 348 is written, as will be described below with reference to block 368. Alternatively, the allowed TOF is not cached, but is read out once more from detection event memory 502 in block 368.

In block 350, a depletion operation is performed in which the previous intensity apportionment read in block 346 is subtracted from the intensity accumulation retrieved in block 348 to generate a respective depleted intensity accumulation. In an example, the depleted intensity accumulation is cached linked to the allowed TOF for later use in blocks 360 and 366, to be described below.

In block 352, the depleted intensity accumulation generated in block 350 for the allowed TOF is added to the depleted accumulation sum to generate a new depleted accumulation sum. When the depleted accumulation sum is the sum of the depleted intensity accumulations for all the allowed times of flight linked to the detection event, it will be referred to as a final depleted accumulation sum that is used in determining revised probabilities for the detection event.

In block 354, a test is performed to determine whether depleted intensity accumulations have been generated for all the allowed times of flight linked to the detection event. A NO result causes execution to return to block 346 via block 356. Block 356 causes a depleted intensity accumulation to be generated for the next allowed TOF linked to the detection event. A YES result causes execution to advance to block 358 shown in FIG. 9B.

Figure 9B:
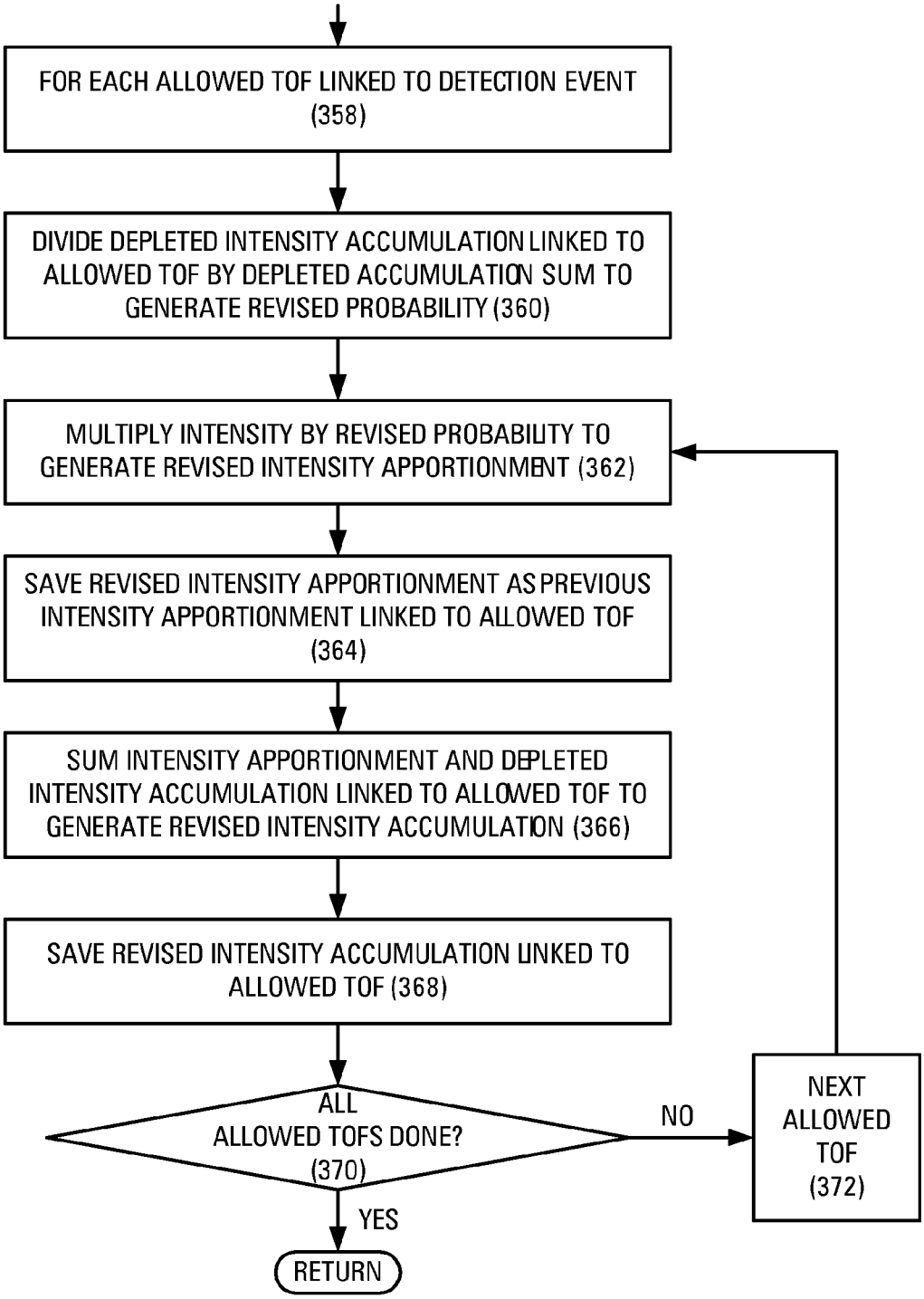

Referring now to the portion of FIG. 9 shown in FIG. 9B, blocks 358, 370 and 372 establish a per-allowed-TOF loop that is performed for each allowed TOF linked to the detection event. A reference in the description of FIG. 9B to the allowed TOF or the allowed time of flight is a reference to the allowed TOF for which a revised probability is determined and for which a revised intensity apportionment is made in the current execution of the loop.

Within the per-allowed-TOF loop, in block 360, the depleted intensity accumulation generated for the allowed TOF in block 350 is divided by the final depleted accumulation sum generated in block 352 to generate a respective revised probability for use in calculating a revised apportionment of the intensity of the detection event to the allowed TOF. In an example, the depleted intensity accumulation that was cached linked to the allowed TOF in block 350 is used in this operation.

In block 362, intensity I for the detection event is multiplied by the revised probability calculated in block 360 to generate a revised intensity apportionment. In block 364, the revised intensity apportionment calculated in block 362 is saved as a previous intensity apportionment linked to the allowed TOF. In an example, the revised intensity apportionment is stored as a previous intensity apportionment in the event record in detection event memory 502 pertaining to the detection event. Within the event record, the revised intensity apportionment is stored as a previous intensity apportionment in the intensity apportionment field $IP_n$ linked to the allowed TOF field $AT_n$ in which the allowed TOF is stored. The previous intensity apportionment overwrites the previous intensity apportionment stored in the same field in block 255 of FIG. 7A, 7B, 7C or 7D, or the previous intensity apportionment stored in the same field in block 364 of FIG. 9B during a previous iteration of the revised probability determining and intensity reapportioning processes respectively described above with reference to blocks 212 and 214 of FIG. 3. Alternatively, the revised probability determined in block 360 can be saved.

In block 366, an accumulation process is performed in which the revised intensity apportionment generated in block 362 and the depleted intensity accumulation linked to the allowed TOF generated in block 350 are summed to generate a revised intensity accumulation. In an example, the depleted intensity accumulation that was cached in block 350 linked to the allowed TOF is used in this operation.

In block 368, the revised intensity accumulation calculated in block 366 is saved linked to the allowed TOF. In an example, the allowed TOF cached in block 348 is read and is output to spectrum memory 150. Alternatively, the allowed TOF is read out from the respective allowed TOF field in the event record of detection event memory 502 pertaining to the detection event and is output to spectrum memory 150. The revised intensity accumulation generated in block 366 is then written to the TOF bin addressed by the allowed TOF. The revised intensity accumulation overwrites the intensity accumulation previously stored in the TOF bin.

In block 370, a test is performed to determine whether revised probabilities have been determined for all the allowed times of flight linked to the detection event. A NO result causes execution to return to block 362 via block 372. Block 372 causes a revised probability to be determined and an intensity reapportionment to be made for the next allowed TOF linked to the detection event. A YES result causes execution to return to the main routine described above with reference to FIG. 8.

As noted above, in some embodiments, intensity accumulations may be used instead of depleted intensity accumulations and an accumulation sum is used instead of a depleted accumulation sum in at least some of the iterations of the revised probability determining process just described with reference to FIG. 9. In such embodiments, blocks 346 and 350 are omitted, and, in FIG. 9 and its description, each occurrence of depleted intensity accumulation should be read as intensity accumulation, and each occurrence of depleted accumulation sum should be read as accumulation sum.

Each time the operations described above with reference to FIGS. 8 and 9 are performed for the allowed times of flight linked to a given detection event, the depletion operations performed in block 350 on the intensity accumulations linked to the allowed times of flight, and the accumulation operations performed in block 366 that generate the revised intensity accumulations that are saved linked to the respective allowed times of flight collectively effect a reapportioning of the intensity of the detection event among the allowed times of flight linked to the detection event.

In the example described above with reference to FIG. 9, the intensity reapportioning process is implemented by operations in which the previous intensity apportionment linked to the allowed TOF is subtracted from the intensity accumulation linked to the same allowed TOF to generate a depleted intensity accumulation, a revised probability is calculated using the depleted intensity accumulation and a depleted accumulation sum for the detection event, a revised intensity apportionment is calculated using the revised probability and is saved as a previous intensity apportionment linked to the allowed TOF, the revised intensity apportionment and the depleted intensity accumulation are summed to generate a revised intensity accumulation and the revised intensity accumulation is saved linked to the allowed TOF. In an embodiment in which a previous probability is stored instead of the previous intensity apportionment, the intensity of the detection event is multiplied by the previous probability to generate the previous intensity apportionment used in the above-described process. In another embodiment in which the previous probability is stored, the intensity of the detection event is multiplied by the previous probability to generate the previous intensity apportionment, the previous intensity apportionment is subtracted from the intensity accumulation linked to the allowed TOF to generate a depleted intensity accumulation, a revised probability is calculated using the depleted intensity accumulation and a depleted accumulation sum, the previous probability is subtracted from the revised probability to generate a probability difference, the intensity is multiplied by the probability difference to generate an intensity apportionment difference, the intensity apportionment difference and the intensity accumulation are summed to generate a revised intensity accumulation and the revised intensity accumulation is saved linked to the allowed TOF. Other reapportioning processes can be used.

Common to all viable intensity reapportioning processes that employ depleted intensity accumulations is that the depletion operation performed in a given iteration of the process subtracts from the intensity accumulation exactly the same intensity apportionment as was added to the intensity accumulation by the accumulation operation performed in the previous iteration of the process. This property of the depletion and accumulation operations prevents residuals from the depletion and accumulation operations from undesirably accumulating in the intensity accumulation. However, in practice, differences in the subtractions and additions can be tolerated provided that they are sufficiently small that the residuals that accumulate in the intensity accumulations over the total number of iterations remain negligible.

A simplified example 400 of time of flight calculator 130 described above with reference to FIG. 1 will now be described with reference to the block diagrams shown in FIGS. 10A and 10B. Time of flight calculator 400 is simplified in that conventional initialization, control, timing and buffering circuitry is omitted. The following description additionally refers to FIG. 1.

Time of flight calculator 400 is composed of an event detector 410, a transient time register 412, a flight time calculator 414, a summing circuit 416, a data compactor 418, an event record register 420, an allowed flag bus 426 and an event counter 428. Time of flight calculator 400 additionally has a detection signal input 440, a transient input 442, an elapsed time input 444, an event count output 446, a start input 447, an event flag output 448 and an event record output 450.

Event detector 410 has a detection signal input, an intensity output and an event flag output. The detection signal input is connected to receive detection signal DS from detection signal input 440. The event flag output is connected to event flag output 448. Event detector 410 operates to detect each of the detection events represented by detection signal DS. In response to each detection event represented by the detection signal, event detector 410 outputs a respective intensity I and a respective event flag EF. Event detector 410 outputs event flag EF to event flag output 448.

Transient time register 412 is composed of a number of nominally-identical stages, an exemplary one of which is indicated by reference numeral 422. Reference numeral 422 will additionally be used to refer to the stages of transient time register 412 collectively. The number of stages 422 is greater than or equal to the maximum number S of allowed times of flight that the detection events can have. The maximum number of allowed times of flight depends on the maximum time of flight $TOF_{MAX}$ of mass spectrometer 100 and the minimum time between consecutive firings of the irregular pulse source 116 of mass spectrometer 100. Each of the stages 422 has a transient time output. Transient time register 412 additionally has a clock input and an elapsed time input. The clock input is connected to receive transients T from transient input 442. The elapsed time input is connected to receive elapsed time signal ET from elapsed time input 444. In the example shown, transient time register 412 is implemented using a serial in, parallel out, shift register having S stages 422.

The example of flight time calculator 414 shown is composed of nominally-identical blocks equal in number to the stages 422 constituting transient time register 412. An exemplary block is indicated by reference numeral 424, and reference numeral 424 will additionally be used to refer to the blocks collectively. Each of the blocks 424 has an elapsed time input, a transient time input, an allowed time of flight output and an allowed flag output. The elapsed time input of each block is connected to receive elapsed time ET from elapsed time input 444. The transient time input of each block is connected to receive a transient time TT from the transient time output of the respective stage 422 of transient time register 412.

Summing circuit 416 has allowed flag inputs (not individually shown) and an output. The allowed flag output of each block 424 of flight time calculator 414 is connected via a respective conductor of allowed flag bus 426 to a respective one of the allowed flag inputs.

Data compactor 418 has inputs and outputs equal in number to the stages of transient time register 412. Each input is connected to receive a respective allowed time of flight AT from the allowed time of flight output of a respective block 424 of flight time calculator 414. Data compactor 418 removes all invalid allowed times of flight from the times of flight AT received from flight time calculator 414. Invalid allowed times of flight are allowed times of flight having a value of zero or another value outside the permitted range of the times of flight. Additionally, data compactor 418 shifts the remaining allowed times of flight towards the left so that only the left-most TC allowed times of flight output by the data compactor are valid allowed times of flight. TC is the number of allowed times of flight. This minimizes the number of allowed time of flight fields that need be provided in the event record and ensures that each allowed time of flight field is occupied by a valid (>0) allowed time of flight. In embodiments in which the event records output by event record register 420 have a fixed number of allowed time of flight fields, data compactor 418 may be omitted.

In the example shown, the allowed times of flight AT output by flight time calculator 414 map directly to the address space of spectrum memory 150, and the allowed time of flight output of each block 424 is directly connected to deliver a respective allowed time of flight AT to a respective input of data compactor 418. In another example in which the allowed times of flight output by flight time calculator 414 do not map directly to the address space of spectrum memory 150, a mapping circuit (not shown) is interposed between the allowed time of flight output of each block 424 of flight time calculator 414 and the respective input of data compactor 418 to map the respective allowed time of flight output by flight time calculator 414 to the address of a respective TOF bin in the address space of the spectrum memory.

Event record register 420 has an intensity input, an allowed TOF count input, allowed TOF inputs equal in number to the stages of transient time register 412, an event flag input and an event record output. The intensity input is connected to receive the intensity of each detection event represented by detection signal DS from the intensity output of event detector 410. The allowed TOF count input is connected to receive allowed TOF count TC from the output of summing circuit 416. The event flag input is connected to receive event flag EF from the event flag output of event detector 410. The output is connected to provide an initial event record IER for each detection event to event record output 450. Each allowed TOF input is connected to receive an allowed time of flight from a respective output of data compactor 418.

Event counter 428 has a first input, a second input, a strobe input, a reset input and an event count output. The first input is connected to receive a representation of unity. The strobe input is connected to receive successive event flags EF from the event flag output of event detector 410. The reset input is connected to receive a start signal S from start input 447. The event count output is connected to deliver an event count EC to event count output 446 and to the second input of the event counter. At the end of each measurement run performed by mass spectrometer 100, event count EC represents the number of detection events detected by event detector 410 during the measurement run and, hence, the number of detection events whose initial event records are stored in detection event memory 502.

Figure 10A:
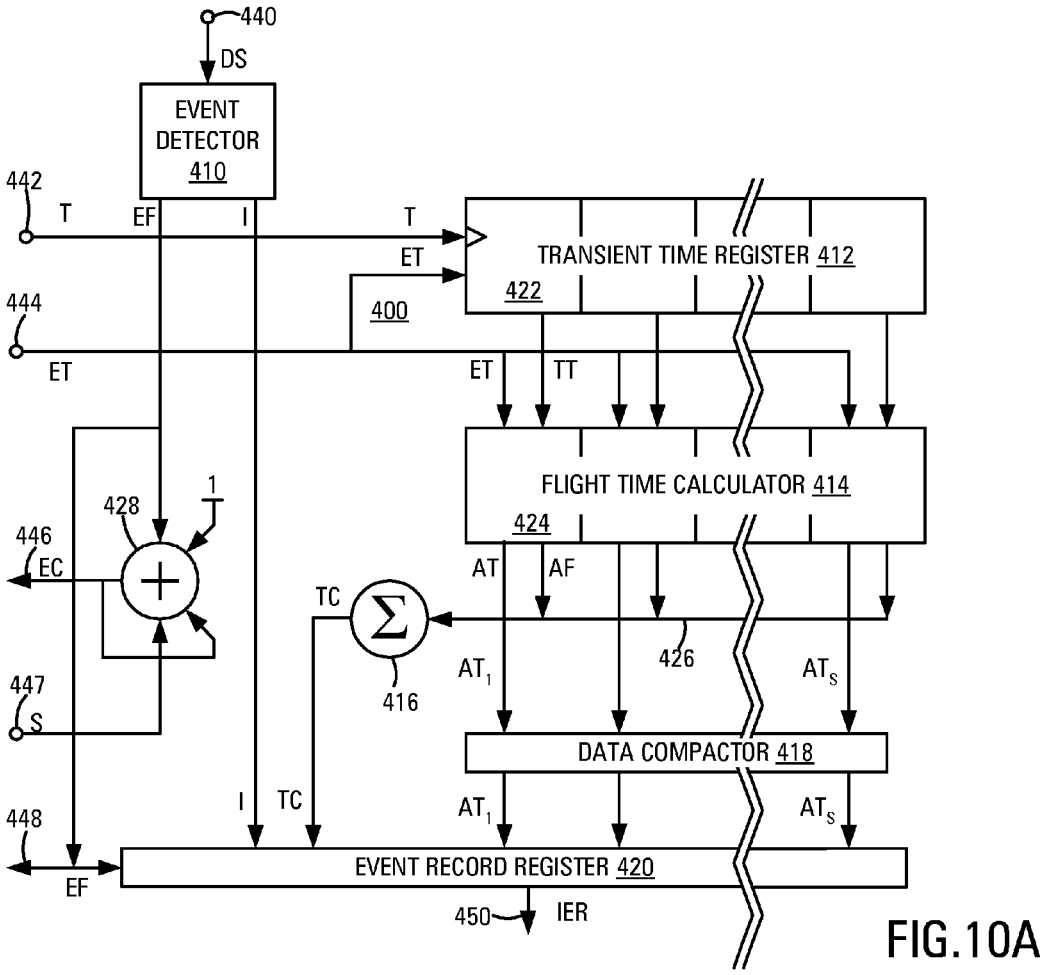
FIG. 10A is a block diagram showing a simplified example of the time of flight calculator of the mass spectrometer shown in FIG. 1.
Figure 10B:
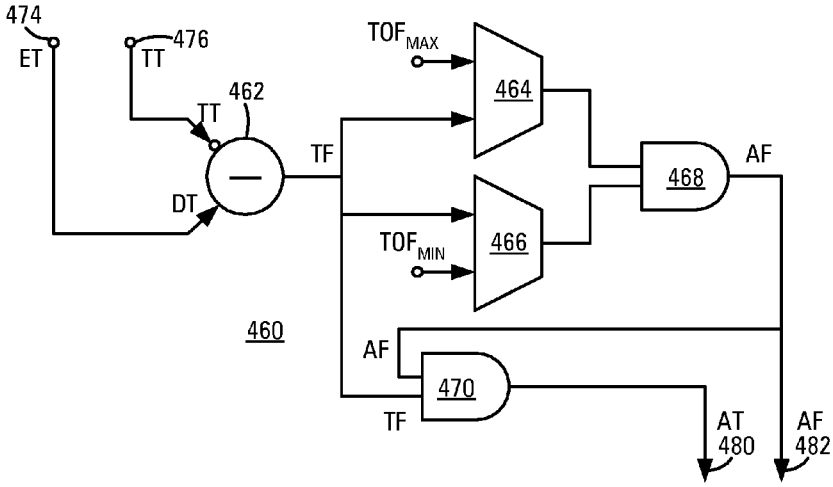
FIG. 10B is a block diagram showing a simplified example of an exemplary block of the allowed time of flight calculator of the time of flight calculator shown in FIG. 10A.

FIG. 10B is a block diagram showing a simplified example 460 of exemplary block 424 of flight time calculator 414 described above with reference to FIG. 10A. The remaining blocks of flight time calculator 414 are similar and will not be separately described. Flight time calculator block 460 is composed of a differencing circuit 462, comparators 464, 466, an AND logic gate 468 and an AND data gate 470. Flight time calculator block 460 also has an elapsed time input 474, a transient time input 476, an allowed time of flight output 480 and an allowed flag output 482.

Referring additionally to FIG. 10A, differencing circuit 462 has a non-inverting input, an inverting input and an output. The non-inverting input is connected to receive elapsed time ET from elapsed time input 474. Comparators 464, 466 each have a reference input, a time of flight input and a comparison output. The time of flight inputs of comparators 464, 466 are connected to receive a time of flight TF from the output of differencing circuit 462. The reference inputs of comparators 464, 466 are respectively connected to receive representations of the maximum time of flight $TOF_{MAX}$ and the minimum time of flight $TOF_{MIN}$ of mass spectrometer 100. The representations are representations in terms of periods of clock signal CS generated by clock 170. AND logic gate 468 has two inputs and an output. The inputs of AND logic gate 468 are connected to the comparison outputs of comparators 464, 466, respectively. The output of AND logic gate 468 is connected to provide allowed flag AF to allowed flag output 482 that in turn is connected to a respective conductor of allowed flag bus 426. AND data gate 470 has a data input, a control input and a data output. The data input is connected to receive time of flight TF from the output of differencing circuit 462. The control input is connected to receive allowed flag AF from the output of AND logic gate 468. The data output is connected to provide allowed time of flight AT to allowed time of flight output 480.

Referring again to FIG. 10A, in operation, prior to the start of each measurement run, start signal S received at start input 447 holds event counter 428 in a reset state. Additionally, summing circuit 416 is reset. At the start of the measurement run, start signal S releases event counter 428 from its reset state. Thereafter, during the measurement run, each instance of event flag EF input to the strobe input of event counter 428 increments event count EC at event count output 446 by unity. The value of event count EC at the end of the measurement run represents the number of detection events detected by event detector 410 during the measurement run.

During the measurement run, time of flight calculator 400 receives detection signal DS at detection signal input 440, successive transients T at transient input 442, and elapsed time signal ET at elapsed time input 444. Event detector 410 receives detection signal DS from detection signal input 440 and detects the detection events represented by the detection signal. In an example, event detector 410 detects each sample of detection signal DS whose intensity is greater than a threshold value as a respective detection event. For each detection event detected by event detector 410, the event detector outputs event flag EF to the strobe input of event counter 428, to the event flag input of event record register 420 and to event flag output 448. Event detector 410 additionally outputs the respective intensity I for each detection event to event record register 420, where the intensity populates the intensity field of initial event record IER.

Additionally, transient time register 412, flight time calculator 414 and summing circuit 416 operate to input to event record register 420 respective allowed times of flight and an allowed time of flight count for each distinct value of elapsed time ET. Each transient T received at transient input 442 is input to the clock input of transient time register 412. Each transient causes transient time register 412 to perform a right shift operation in which the contents of each stage 422 are transferred to the next stage and the value of elapsed time signal ET is loaded into the now-vacant first stage 422. Each stage 422 outputs the elapsed time stored therein as a respective transient time TT to the transient time input of a respective block 424 of flight time calculator 414. The transient times output by transient time register 412 are those of the S most-recent transients generated by transient source 116, where S is the number of stages 422 of transient time register 412.

Referring now to FIG. 10B, exemplary block 460 of flight time calculator 414 receives elapsed time signal ET at elapsed time input 474 and transient time TT from the respective stage 422 of transient time register 412 at transient time input 476. Differencing circuit 462 subtracts the respective transient time TT from elapsed time ET to generate a respective time of flight TF. Differencing circuit 462 outputs time of flight TF to the time of flight inputs of comparators 464, 466 and to the data input of AND data gate 470.

Comparator 464 compares time of flight TF with maximum time of flight $TOF_{MAX}$, *outputs a* 1 state when time of flight TF is less than or equal to maximum time of flight $TOF_{MAX}$, and otherwise outputs a 0 state. Comparator 466 compares time of flight TF with minimum time of flight $TOF_{MIN}$, outputs a 1 state when time of flight TF is greater than or equal to minimum time of flight $TOF_{MIN}$, and otherwise outputs a 0 state. AND logic gate 468 combines the outputs of comparators 464 and 466 to generate allowed flag AF. AND logic gate 468 generates allowed flag AF in a 1 state when time of flight TF is an allowed time of flight, and otherwise generates allowed flag AF in a 0 state. Time of flight TF is an allowed time of flight when it is greater than or equal to minimum time of flight $TOF_{MIN}$, and is less than or equal to maximum time of flight $TOF_{MAX}$, indicated by the comparison outputs of both comparators 464, 466 being in the 1 state. Only when time of flight TF is an allowed time of flight does AND gate 468 provide allowed flag AF to allowed flag output 482 and to the control input of AND data gate 470.

AND data gate 470 receives allowed flag AF at its control input and time of flight TF at its data input. Only when allowed flag AF is in its 1 state will AND data gate 470 output time of flight TF as a valid allowed time of flight AT to the allowed time of flight output 480 of block 460. Otherwise, allowed flag AF causes AND data gate 468 to output a value of zero as an invalid allowed time of flight AT to the allowed time of flight output 480 of block 460. Alternatively, AND data gate outputs another value outside the valid range of the allowed times of flight in response to allowed flag AF in its 0 state.

Referring again to FIG. 10A, in those of the blocks 424 of flight time calculator 414 that additionally output allowed flag AF, allowed flag AF causes AND data gate 470 to output time of flight TF as a respective allowed time of flight AT to a respective allowed TOF input of data compactor 418. Data compactor 418 removes all invalid allowed times of flight from the times of flight AT received from flight time calculator 414 and also shifts the remaining allowed times of flight towards the left so that only the TC left-most allowed times of flight output to event record register 420 are valid allowed times of flight. Invalid allowed times of flight are allowed times of flight having a value of zero or another value outside the permitted range of the allowed times of flight.

Additionally, respective conductors of allowed flag bus 426 convey the allowed flags AF received from the respective allowed flag outputs 482 of the blocks 424 of flight time calculator 414 to the input of summing circuit 416. Summing circuit 416 sums the allowed flags AF to determine allowed TOF count TC, which represents the number of allowed times of flight, and, hence, the number of allowed times of flight linked to the detection event. Summing circuit 416 outputs allowed TOF count TC to event record register 420.

For each period of clock signal CS (FIG. 1), event record register 420 receives an allowed time of flight count from summing circuit 416 and a corresponding number of allowed times of flight from data compactor 418. Moreover, for periods of clock signal CS in which detection signal DS represents a detection event, event record register additionally receives the intensity I and the event flag EF for the detection event from event detector 410. One or more delay circuits (not shown) ensure that the event flag, the intensity, the allowed time of flight count TC and each allowed time of flight AT pertaining to each detection event arrive at the respective inputs of event record register 420 within the same cycle of clock signal CS. In an example, such one or more delay circuits are located in one or more of the following locations: between the event flag output of event detector 410 and the event flag input of event record register 420, between the intensity output of event detector 410 and the intensity input of event record register 420, between the output of summing circuit 416 and the allowed time of flight count input of event record register 420, and between each allowed time of flight output of data compactor 418 and the respective allowed time of flight input of event record register 420.

In response to each event flag EF, event record register 420 forms the initial event record IER for the respective detection event and outputs the initial event record to intensity apportioner 140 via event record output 450. Initial event record IER is composed of an intensity field, an allowed time of flight count field, allowed time of flight fields equal in number to allowed time of flight count TC and intensity apportionment fields equal in number to allowed time of flight count TC. Event record register 420 inserts the intensity I received from event detector 410 into the intensity field and the allowed time of flight count TC received from summing circuit 416 into the allowed time of flight count field. Event record register 420 additionally inserts the valid allowed times of flight $AT_1$-$AT_{TC}$ received from the TC left-most outputs of data compactor 418 into respective ones of the TC allowed time of flight fields, and inserts a value of zero into each of the TC intensity apportionment fields. Time of flight calculator 400 additionally outputs event flag EF to intensity apportioner 140 (FIG. 1) via event flag output 448. The event flag causes intensity apportioner 140 to store initial event record IER.

The allowed times of flight included in the initial event record for a given detection event are obtained by subtracting the transient times stored in transient time register 412 from the value of elapsed time ET that exists when event detector 410 outputs the respective event flag EF for the detection event. Such value of elapsed time ET is the event time of the detection event: consequently, the allowed times of flight are obtained by subtracting transient times TT from the event time for the detection event.

Figure 11:
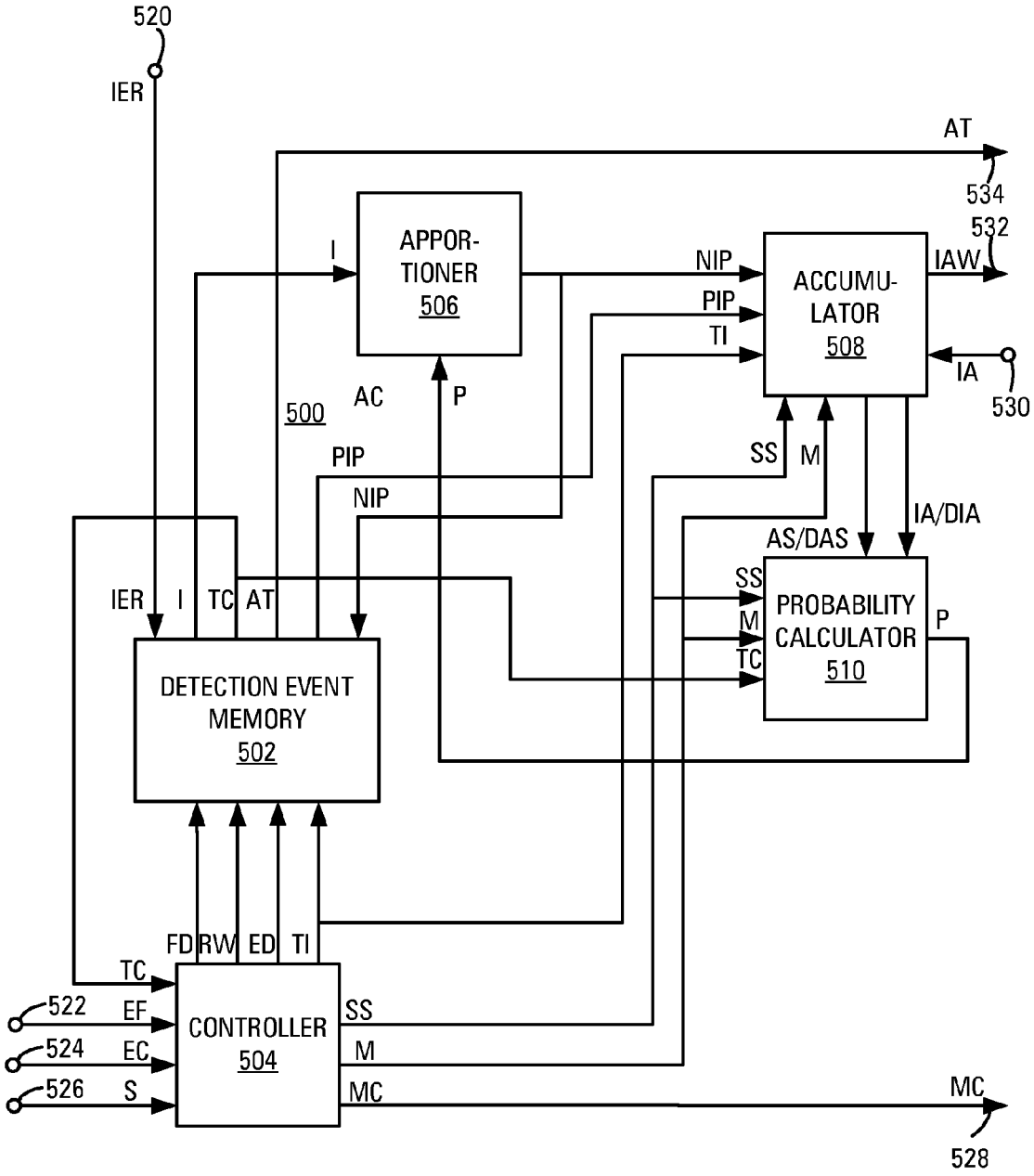
FIG. 11 is a block diagram showing a simplified example of the intensity apportioner of the mass spectrometer shown in FIG. 1.

FIG. 11 is a block diagram showing a simplified example 500 of an implementation of intensity apportioner 140 described above with reference to FIG. 1. FIG. 11 is simplified in that conventional initialization, control, timing and buffering circuitry is omitted. Intensity apportioner 500 is composed of a detection event memory 502, a controller 504, an apportioner 506, an accumulator 508 and a probability calculator 510. Intensity apportioner 500 additionally has an event record input 520, an event flag input 522, an event count input 524, a start input 526, a memory control output 528, a read input 530, a write output 532 and a memory address output 534. Event record input 520 is connected to receive an initial event record IER for each detection event from time of flight calculator 130. Each initial event record is composed of the intensity I, the allowed TOF count TC and each allowed TOF AT for the detection event.

Detection event memory 502 performs the function of storing a respective event record pertaining to each of the detection events represented by the detection signal. The event record stores data comprising the intensity, the allowed TOFs linked to the detection event and, linked to each of the allowed TOFs, a respective previous intensity apportionment or a respective previous probability. Detection event memory 502 has an event record input connected to receive an initial event record IER for each detection event from event record input 520. Detection event memory 502 additionally has an intensity output, an allowed TOF count output, an allowed TOF output, a previous intensity apportionment output and a new intensity apportionment input. Finally, detection event memory 502 has a function designator input, a read/write input, an event designator input and a TOF index input. The allowed TOF output is connected to provide each allowed TOF AT read out from detection event memory 502 for each detection event to the address input of spectrum memory 150 via memory address output 534. In spectrum memory 150, the allowed TOF provides the address of a respective TOF bin from which a respective intensity accumulation IA is read or to which a respective intensity accumulation IAW is written. In some implementations, allowed TOF AT directly addresses the storage locations within spectrum memory 150 that constitute respective TOF bins; in other implementations, allowed TOF is mapped to the address space of spectrum memory 150 to address the storage locations therein.

Controller 504 has a start input, an event count input, an event flag input and an allowed TOF count input. The start input is connected to receive start signal S from start input 526. The event count input is connected to receive event count EC from time of flight calculator 130 via event count input 524. The event flag input is connected to receive event flags EF from the event flag output of time of flight calculator 130 via event flag output 522. The allowed TOF count input is connected to receive a respective allowed TOF count TC for each detection event from the allowed TOF count output of detection event memory 502. Controller 504 additionally has a function designator output, a read/write output, an event designator output, and a TOF index output respectively connected to like-named inputs of detection event memory 502 to provide addressing instructions and read/write instructions thereto. Controller 504 additionally has a strobe output, a mode output and a memory control output. The memory control output is connected to provide memory control signal MC to the control input of spectrum memory 150 via memory control output 528.

Apportioner 506 performs the function of apportioning, in accordance with the probabilities supplied by probability calculator 510, the respective intensity of each one of the detection events among the allowed TOFs linked to the detection event to generate the respective apportionments of the intensity among the allowed TOFs. Apportioner 506 has an intensity input, a probability input and intensity apportionment output. The intensity input is connected to receive the respective intensity I of each detection event from the intensity output of detection event memory 502. The intensity apportionment output is connected to the new intensity apportionment input of detection event memory 502 to provide each new intensity apportionment NIP generated by apportioner 506 to the detection event memory for storage therein linked to the detection event and the allowed TOF. New intensity apportionment NIP is an initial intensity apportionment or a revised intensity apportionment generated by apportioner 506 for each allowed TOF linked to each detection event.

Accumulator 508 performs the function of subjecting the intensity accumulation linked to each allowed TOF linked to the detection event to a respective depletion operation to generate a depleted intensity accumulation linked to the allowed TOF. Each depletion operation involves subtracting the previous intensity apportionment PIP received from detection event memory 502 and linked to the allowed TOF from the intensity accumulation received from spectrum memory 150 and linked to the allowed TOF. Accumulator 508 additionally performs the function of accumulating the intensity apportionments to each one of the allowed TOFs to generate a respective intensity accumulation for storage in a respective one of the TOF bins addressed by the one of the allowed TOFs. In an example, accumulator 508 performs successive accumulation operations using depleted intensity accumulations cached therein and new intensity apportionments NIP received from apportioner 506. In another example, accumulator 508 performs the function of summing the depleted intensity accumulation linked to the allowed TOF and the revised intensity apportionment linked to the allowed TOF to generate the revised intensity accumulation linked to the allowed TOF. Finally, accumulator 508 performs the function of accumulating the depleted intensity accumulations linked to all the allowed TOFs linked to the detection event to generate a depleted accumulation sum.

Accumulator 508 has a new intensity apportionment input, a previous intensity apportionment input, a TOF index input, a strobe input, a mode input, an accumulation sum output, an intensity accumulation output, a read input and a write output. The new intensity apportionment input is connected to receive from the intensity apportionment output of apportioner 506 the new intensity apportionment NIP generated by the apportioner for each allowed TOF linked to each detection event. Accumulator 508 uses each new intensity apportionment in a respective accumulation operation. New intensity apportionment NIP received from apportioner 506 is an initial apportionment or a revised apportionment. The previous intensity apportionment input is connected to receive from the previous intensity apportionment output of detection event memory 502 the respective previous intensity apportionment PIP stored in the detection event memory linked to each allowed TOF linked to each detection event. Accumulator 508 uses each previous intensity apportionment in a respective depletion operation.

The TOF index input is connected to receive the respective TOF index TI for each allowed TOF linked to each detection event from the TOF index output of controller 504. The strobe input and the mode input are connected to receive a strobe signal SS and a mode control signal M, respectively, from the strobe output and the mode output, respectively, of controller 504. The read input is connected receive from the read output 624 (FIG. 12) of spectrum memory 150 via read input 530 the respective intensity accumulation IA for each allowed TOF linked to each detection event. The write output is connected to provide to the write input 622 (FIG. 12) of spectrum memory 150 via write output 532 the respective intensity accumulation IAW for each allowed TOF linked to each detection event.

Probability calculator 510 performs the function of determining probabilities in accordance with which the respective intensity of each detection event is apportioned among the allowed TOFs linked to the detection event. Probability calculator 510 initially performs the function of determining the respective initial probabilities, and subsequently performs the function of iteratively determining the revised probabilities using the intensity accumulations stored in the respective TOF bins corresponding to the allowed TOFs linked to the detection event. Probability calculator 510 has an allowed TOF count input, a mode input, a strobe input, an accumulation sum input, an intensity accumulation input and a probability output. The allowed TOF count input is connected to receive a respective allowed TOF count TC for each detection event from the allowed TOF count output of detection event memory 502. The mode input and the strobe input are connected to receive mode control signal M and strobe signal SS, respectively, from the mode output and the strobe output, respectively, of controller 504. The accumulation sum input is connected to receive the respective accumulation sum AS or depleted accumulation sum DAS generated by accumulator 508 for each detection event from the accumulation sum output of the accumulator. The intensity accumulation input is connected to receive the respective intensity accumulation IA or depleted intensity accumulation DIA generated by accumulator 508 for each allowed TOF linked to each detection event from the intensity accumulation output of the accumulator. The probability output is connected to provide a respective probability P determined by probability calculator 508 for each allowed TOF linked to each detection event to the probability input of apportioner 506. Probability P is an initial probability or a revised probability.

Referring additionally to FIG. 1, at the beginning of each measurement run, controller 160 provides start signal S to controller 504 and to time of flight calculator 130. Start signal S resets event count EC. During the measurement run, time of flight calculator 130 operates in response to detection signal DS received at its detection signal input, transients T received at its transient input and elapsed time signal TS received at its elapsed time input to calculate the respective allowed times of flight for each detection event represented by detection signal DS. Time of flight calculator 130 additionally counts the number of detection events represented by detection signal DS to generate event count EC, and counts the number of allowed times of flight AT generated for each detection event to generate a respective allowed TOF count TC. Finally, time of flight calculator 130 extracts the intensity I of the detection event from detection signal DS. For each detection event, time of flight calculator 130 assembles intensity I, allowed TOF count TC, each allowed TOF AT and a respective zero-value intensity apportionment to form an initial event record IER for the detection event, and outputs the initial event record to the event record input 520 of intensity apportioner 500 for input to the event record input of detection event memory 502.

Throughout the measurement run, controller 504 sets function designator FD to a write mode that causes detection event memory 502 to operate in response to each event flag EF received from time of flight calculator 130 to write a respective initial event record IER received at its event record input to a respective storage location therein. During the measurement run, detection event memory 502 operates in response to event designator ED and read/write signal R/W received from controller 504 to store the initial event record IER for each detection event in a respective storage location therein designated by event designator ED received from controller 504. Controller 504 uses the value of event counter EC received from time of flight calculator 130 as event designator ED and uses each event flag EF also received from the time of flight calculator as read/write signal R/W during the measurement run. At the end of the measurement run, controller 504 stores the final value of event count EC received from time-of-flight calculator 130 for use in indexing the per-detection-event processes that are performed for each detection event represented by detection signal DS and whose respective initial event record is stored in a respective storage location in detection event memory 502.

In the example shown, intensity apportioner 500 performs the initial intensity apportionments at the end of the measurement run. In another example, intensity apportioner 500 performs the initial intensity apportionments concurrently with the measurement run. In such example, controller 504 employs a write event designator and a read event designator. The write event designator tracks the detection events as their respective initial event records are stored in detection event memory 502. The read event designator tracks the event records as they are read from detection event memory 502. The following description applies to both examples. References below to event designator ED are to be taken to refer to the read event designator in the example having two event designators.

At the start of the initial intensity apportioning process, controller 504 resets event designator ED to cause detection event memory 502 to read the event record of the first detection event from its respective storage location. Controller 504 additionally causes accumulator 508 to reset accumulation sum AS the event record for the first detection event, and that for each subsequent detection event, is read out from detection event memory 502. Detection event memory 502 outputs the intensity I and allowed TOF count TC from the event record pertaining to the first detection event at its intensity output and allowed TOF count output, respectively. Additionally, controller 504 provides to detection event memory 502 a value of TOF index TI that causes the detection event memory to output the first allowed TOF AT of the first detection event at its allowed TOF output. Detection event memory 502 supplies intensity I to apportioner 506, allowed TOF count TC to controller 504 and the first allowed TOF AT to memory address output 534. Allowed TOF count TC supplied to controller 504 defines the number of per-allowed-TOF operations to be performed for the first detection event. The first allowed TOF supplied to spectrum memory 150 provides the address of a first TOF bin in the spectrum memory linked to the detection event.

Additionally, detection event memory 502 supplies allowed TOF count TC to probability calculator 510 for possible use in determining an initial probability P for the allowed TOFs linked to the detection event, as will be described in greater detail below with reference to FIG. 15. As noted above, detection event memory 502 outputs the first allowed TOF AT linked the first detection event to the memory address output 534 of intensity apportioner 500 for input to spectrum memory 150. Controller 504 supplies memory control signal MC to spectrum memory 150 via memory control signal output 528. Memory control signal MC causes spectrum memory 150 to read out the intensity accumulation (if any) stored in the TOF bin addressed by allowed TOF AT. Accumulator 508 receives the intensity accumulation IA read out from spectrum memory 150 via read input 530.

Controller 504 then supplies mode control signal M and strobe signal SS to accumulator 508. In the initial apportioning operation, these control signals cause accumulator 508 to cache first intensity accumulation IA and to add first intensity accumulation IA to accumulation sum AS.

Controller 504 then successively increments TOF index TI by one until the TOF index is equal to allowed TOF count TC for the first detection event. Each time TOF index TI is incremented, detection event memory 502, controller 504, accumulator 508 and spectrum memory 150 repeat the operations just described to cache the respective intensity accumulation IA read from the TOF bin addressed by the allowed TOF corresponding to TOF index TI, and to add the respective intensity accumulation IA to accumulation sum AS.

Once respective intensity accumulations read out from the TOF bins linked to the first detection event have been cached and have been added to accumulation sum AS, controller 504 supplies mode control signal M and strobe signal SS to accumulator 508 to cause the accumulator to output accumulation sum AS to probability calculator 510. The value of accumulation sum AS determines the operations performed by probability calculator 510 to determine initial probabilities for apportioning the intensity of the detection event among the TOF bins linked thereto. A value of zero causes the probability calculator to generate equal probabilities by dividing unity by allowed TOF count TC. A value greater than zero causes the probability calculator to generate non-equal probabilities by dividing the respective intensity accumulation IA by accumulation sum AS. Unless a previously-generated time-of-flight spectrum is used to generate the initial probabilities, as described above with reference to FIG. 7D, the value of accumulation sum AS generated for the first detection event will be zero since no apportionments of the intensity of the first detection event have previously be made.

Controller 504 then resets TOF index TI, leaves event designator ED unchanged and sets function designator FD to a rewrite state in which the function designator causes detection event memory 502 to write an updated version of the event record pertaining to the first detection event in the storage location addressed by event designator ED. The new value of TOF index TI causes detection event memory 502 once more to output the first allowed TOF AT linked to the first detection event to spectrum memory 150 via memory address output 534.

Controller 504 additionally provides mode control signal M and strobe signal SS to accumulator 508 and to probability calculator 510. The control signals cause probability calculator 510 to calculate an initial probability for the first allowed TOF. As noted above, the initial probabilities are equal probabilities for the first detection event, but may be unequal for subsequent detection events. Probability calculator 510 outputs the initial probability for the first allowed TOF to apportioner 506 and the apportioner multiplies intensity I for the first detection event by the initial probability for the first allowed TOF to generate a respective new intensity apportionment NIP for the first allowed TOF linked to the first detection event. Apportioner 506 outputs the new intensity apportionment NIP to the new intensity apportionment inputs of detection event memory 502 and accumulator 508. In response to TOF index TI, detection event memory 502 inserts new intensity apportionment NIP into the first intensity apportionment field of the event record in the detection event memory pertaining to the first detection event, where the new intensity apportionment becomes a previous intensity apportionment PIP.

Controller 504 again supplies mode control signal M and strobe signal SS to accumulator 508. The control signals cause accumulator 508 to perform an accumulation operation in which it sums new intensity apportionment NIP received from apportioner 506 and intensity accumulation IA cached linked to the first allowed TOF to generate a new intensity accumulation IAW. Accumulator 508 outputs intensity accumulation IAW to spectrum memory 150 via write output 532. Controller 504 supplies memory control signal MC to spectrum memory 150 via memory control signal output 528. Memory control signal MC causes spectrum memory 150 to write intensity accumulation IAW to the TOF bin addressed by the first allowed TOF linked to the first detection event.

Controller 504 then successively increments TOF index TI by one until the TOF index is equal to allowed TOF count TC for the first detection event. Each time TOF index TI is incremented, detection event memory 502, controller 504, apportioner 506, accumulator 508, probability calculator 510 and spectrum memory 150 repeat the operations just described to generate a probability P, a new intensity apportionment NIP and an intensity accumulation IAW for the respective allowed TOF corresponding to TOF index TI, to write intensity accumulation IAW to the TOF bin in spectrum memory 150 addressed by the allowed TOF, and to insert the new intensity apportionment as a previous intensity apportionment into the respective intensity apportionment field of the event record in detection event memory 502 pertaining to the first detection event.

Once the above-described operations have been performed for all the allowed times of flight linked to the first detection event, controller 504 again provides read/write control signal R/W to detection event memory 502. The read/write control signal causes the detection event memory to write the updated event record pertaining to the first detection event in the storage location therein designated by event designator ED.

Controller 504 then successively increments event designator ED by one until the event designator is equal to event count EC received from time of flight calculator 130 at the end of the measurement run. Each time event designator ED is incremented, detection event memory 502, controller 504, apportioner 506, accumulator 508, probability calculator 510 and spectrum memory 150 repeat the operations just described to apportion the intensity of the respective detection event among the allowed TOFs linked to the detection event, to accumulate the intensity apportionments linked to the allowed TOFs, to write the resulting intensity accumulations to the respective TOF bins addressed by the allowed TOFs, and to update the event record pertaining to the detection event in detection event memory 502.

After initial intensity apportionments have been performed for all the detection events for which an event record is stored in detection event memory 502, intensity apportioner 500 uses the intensity accumulations stored in the respective TOF bins corresponding to the allowed TOFs linked to each detection event to determine revised probabilities for use in reapportioning the intensity of the detection event among the allowed TOFs linked to the detection event. Controller 504 resets event designator ED to cause detection event memory 502 once more to read out the event record for the first detection event. Controller 504 additionally causes accumulator 508 to reset depleted accumulation sum DAS as the event record for the first detection event, and for each subsequent detection event, is read out from detection event memory 502. Detection event memory 504 outputs the intensity I and allowed TOF count TC from the event record pertaining to the first detection event at its intensity output and allowed TOF count output, respectively. Additionally, controller 504 provides to detection event memory 502 a value of TOF index TI that causes the detection event memory to output the first allowed TOF AT linked to the first detection event at its allowed TOF output and to output the previous intensity apportionment PIP linked to the first allowed TOF at its previous intensity apportionment output. Detection event memory 502 outputs the first allowed TOF for the first detection event to memory address output 534 for input to spectrum memory 150. Detection event memory 502 additionally outputs previous intensity apportionment PIP to the previous intensity apportionment input of accumulator 508.

Controller 504 then provides memory control signal MC to spectrum memory 150 via memory control signal output 528. The memory control signal causes spectrum memory 150 to read out the intensity accumulation stored in the TOF bin addressed by allowed TOF AT received from detection event memory 502. Accumulator 508 receives the intensity accumulation IA read out from spectrum memory 150 via read input 530. Accumulator 508 additionally receives previous intensity apportionment PIP from detection event memory 502 at its previous intensity apportionment input. Controller 504 provides mode control signal M and strobe signal SS to accumulator 508. In the intensity reapportioning operation, these signals cause accumulator 508 to subject intensity accumulation IA to a depletion operation in which it subtracts previous intensity apportionment PIP from intensity accumulation IA to generate depleted intensity accumulation DIA. Accumulator 508 additionally caches depleted intensity accumulation DIA, and also adds the depleted intensity accumulation to depleted accumulation sum DAS (which has a value of zero) to generate a new depleted accumulation sum.

Controller 504 then successively increments TOF index TI by one until the TOF index is equal to allowed TOF count TC for the first detection event. Each time TOF index TI is incremented, detection event memory 502, controller 504, accumulator 508 and spectrum memory 150 repeat the operations just described to subject each intensity accumulation IA received from a respective TOF bin in spectrum memory 150 to a depletion operation, to cache the resulting depleted intensity accumulation DIA linked to TOF index TI, and to add the respective depleted intensity accumulation DIA to depleted accumulation sum DAS.

Once respective depleted intensity accumulations DIA for all the allowed times of flight linked to the first detection event have been cached and have been added to depleted accumulation sum DAS, controller 504 supplies mode control signal M and strobe signal SS to accumulator 508 to cause the accumulator to output the final depleted accumulation sum DAS to probability calculator 510 for use in determining revised probabilities. Controller 504 then resets TOF index TI, leaves event designator ED unchanged and maintains function designator FD in its rewrite state in which it causes detection event memory 504 to write an updated version of the event record pertaining to the first detection event in the storage location therein addressed by event designator ED. The new value of TOF index TI causes detection event memory 502 once more to output the first allowed TOF AT linked to the first detection event to spectrum memory 150 via memory address output 534.

Controller 504 additionally provides mode control signal M and strobe signal SS to accumulator 508 and to probability calculator 510. The control signals cause probability calculator 510 to calculate a revised probability for the first allowed TOF linked to the first detection event by dividing the depleted intensity accumulation DIA cached linked to the first allowed TOF by the final depleted accumulation sum DAS for the first detection event. Probability calculator 510 outputs the revised probability for the first allowed TOF to apportioner 506 and the apportioner multiplies intensity I for the first detection event by the revised probability for the first allowed TOF to generate a respective revised intensity apportionment NIP for the first allowed TOF linked to the first detection event. Apportioner 506 outputs revised intensity apportionment NIP to the new intensity apportionment inputs of detection event memory 502 and accumulator 508. In response to TOF index TI, detection event memory 502 inserts the revised intensity apportionment NIP as a previous intensity apportionment into the first intensity apportionment field of the event record pertaining to the first detection event to update the first intensity apportionment field. Alternatively, as described above, the event record may be updated with the revised probability linked to the first allowed TOF.

Controller 504 additionally supplies mode control signal M and strobe signal SS to accumulator 508. The control signals cause accumulator 508 to perform an accumulation operation in which it adds the revised intensity apportionment NIP received from apportioner 506 to depleted intensity accumulation DIA cached linked to the first allowed TOF to generate a revised intensity accumulation IAW. Accumulator 508 outputs revised intensity accumulation IAW to spectrum memory 150 via write output 532. Controller 504 supplies memory control signal MC to spectrum memory 150 via memory control signal output 528. Memory control signal MC causes spectrum memory 150 to write revised intensity accumulation IAW in the TOF bin addressed by the first allowed TOF AT linked to the first detection event.

Controller 504 then successively increments TOF index TI by one until the TOF index is equal to allowed TOF count TC for the first detection event. Each time TOF index TI is incremented, detection event memory 502, controller 504, apportioner 506, accumulator 508, probability calculator 510 and spectrum memory 150 repeat the operations just described to generate a revised probability P, a revised intensity apportionment NIP and a revised intensity accumulation IAW for the respective allowed TOF corresponding to the TOF index, to store revised intensity accumulation IAW in the respective TOF bin addressed by the allowed TOF, and to update the respective intensity apportionment field of the event record pertaining to the first detection event with the revised intensity apportionment. Once the above-described revised probability determining and intensity reapportioning operations have been performed for all the allowed times of flight linked to the first detection event, controller 504 provides read/write control signal R/W to detection event memory 502. The read/write control signal causes the detection event memory to write the updated event record pertaining to the first detection event to the storage location therein designated by event designator ED.

Controller 504 then successively increments event designator ED by one until the event designator is equal to event count EC received from time of flight calculator 130 at the end of the measurement run. Each time event designator ED is incremented, detection event memory 502, controller 504, apportioner 506, accumulator 508, probability calculator 510 and spectrum memory 150 repeat the operations just described to determine revised probabilities, to reapportion the intensity of the respective detection event among the allowed TOFs linked to the detection event using the revised probabilities, to revise the intensity accumulations linked to the detection event using the revised intensity apportionments, to store the revised intensity accumulations in the respective TOF bins in spectrum memory 150 addressed by the allowed TOFs linked to the detection event, and to update the respective event record in detection event memory 502 pertaining to the detection event.

Once the respective intensities of all of the detection events represented by detection signal DS have been reapportioned as just described, controller 504 performs a test to determine whether a termination condition has been met. In an embodiment, the termination condition is that the intensity reapportioning process has been performed a pre-determined number of times. In another embodiment, controller 504 performs a test on data generated by accumulator 508 during the revised probability determining and intensity reapportioning processes to determine whether a statistical criterion has been met, as described above with reference to FIG. 8. Such data represent changes in the intensity apportionments or the probabilities between successive executions of the revised probability determining and intensity reapportioning processes. When the termination condition is not met, controller 504 causes intensity apportioner 500 and spectrum memory 150 to perform an additional iteration of the revised probability determining and intensity reapportioning processes. When the termination condition is met, controller 504 provides memory control signal MC to spectrum memory 150. The memory control signal MC causes the spectrum memory to output the time-of-flight spectrum TS accumulated therein via spectrum output 628 (FIG. 12).

FIG. 12 is a block diagram showing an example 600 of spectrum memory 150. Referring to FIG. 12 and additionally to FIG. 1, in the example shown, spectrum memory 600 is composed of memory 610. Spectrum memory 600 additionally has an address input 620, a write input 622, a read output 624, a memory control input 626 and a spectrum output 628.

An example of memory 610 has one storage location for every period of clock signal CS generated by clock 170 during the above-mentioned maximum time of flight $TOF_{MAX}$ of mass spectrometer 100. An exemplary storage location is indicated by reference numeral 612 and the storage locations are labelled TOF $BIN_1$ through TOF $BIN_N$, where N is the above-described number of periods of clock signal CS in the maximum time of flight. Reference numeral 612 will additionally be used to refer to the storage locations collectively. Storage locations 612 are structured such that each is capable of storing a value greater than the maximum intensity accumulation that can reasonably accumulate during the intensity reapportioning operations performed by intensity apportioner 140 and spectrum memory 150. Another example has one storage location 612 for every period of clock signal CS generated by clock 170 between the above-mentioned minimum time of flight $TOF_{MIN}$ and the above-mentioned maximum time of flight $TOF_{MAX}$ of mass spectrometer 100. In such an example, the number of storage locations 612 is reduced, but the allowed TOFs have to be mapped to the address space of the memory. Memory 610 additionally has a write bus 614 coupled to write input 622, and a read bus 616 coupled to read output 624 and to spectrum output 628. Each storage location 612 of memory 610 has a respective input coupled to write bus 614 and a respective output coupled to read bus 616.

Memory 610 additionally has an address input and a control input. Other implementations of memory 610 have a single read/write bus and/or a separate read address input and a separate write address input. Since memory 610 is addressed randomly, implementing memory 610 using static random access memory increases operational speed compared with using dynamic random access memory. Memory structures different from that exemplified may alternatively be used as spectrum memory 150.

In response to a WRITE command received as memory control signal MC at memory control input 626, and allowed time of flight AT received at address input 620, spectrum memory 600 stores an intensity accumulation IAW received at write input 622 in the storage location 612 of memory 610 addressed by allowed TOF AT. In response to a READ command received as memory control signal MC at memory control input 626 and an address signal TC received at address input 620, spectrum memory 600 reads an intensity accumulation IA from the storage location 612 of memory 610 addressed by allowed TOF AT and outputs the read-out intensity accumulation IA at read output 624. Moreover, in response to a sequence of allowed TOFs AT and respective READ commands collectively received as memory control signal MC at memory control input 626, spectrum memory 600 sequentially reads the intensity accumulations respectively stored in the storage locations 612 of memory 610 and outputs the resulting time-of-flight spectrum TS at spectrum output 628.

Intensity apportioner 500 described above with reference to FIG. 11 will now be described in greater detail with reference to the simplified block diagrams shown in FIGS. 13, 14, 15 and 16. FIGS. 13, 14, 15 and 16 are simplified in that conventional initialization, control, timing and buffering circuitry is omitted. The following description additionally refers to FIGS. 1 and 11.

Figure 13:
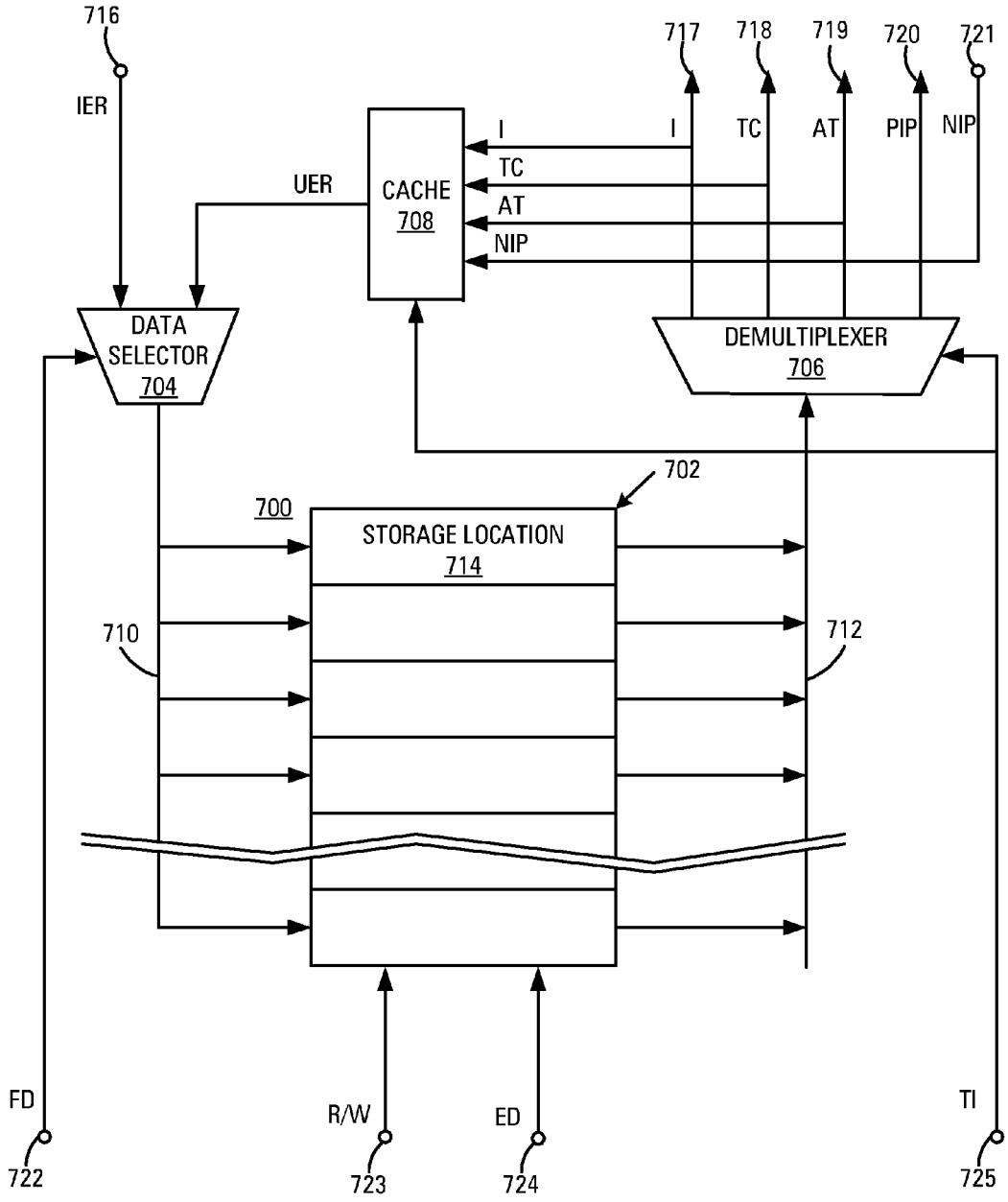
FIG. 13 is a block diagram showing a simplified example of the detection event memory of the intensity apportioner shown in FIG. 11.

FIG. 13 is a block diagram showing a simplified example 700 of detection event memory 502 described above with reference to FIG. 11. Detection event memory 700 is composed of memory 702, a data selector 704, a demultiplexer 706, a cache 708, a write bus 710 and a read bus 712. Memory 702 is coupled to write bus 710 and to read bus 712, and has a structure that provides a storage location for storing the event record for each detection event represented by detection signal DS (FIG. 1). An exemplary storage location is indicated by reference numeral 714. Reference numeral 714 will additionally be used to refer to the storage locations collectively. Each of the storage locations has a structure similar to that described above with reference to FIG. 5 or below with reference to FIG. 21. Other storage structures are possible and may be used. Detection event memory 700 additionally has an event record input 716, an intensity output 717, an allowed TOF count output 718, an allowed TOF output 719, a previous intensity apportionment output 720, a new intensity apportionment input 721, a function designator input 722, a read/write input 723, an event designator input 724 and a TOF index input 725.

Memory 702 has input ports, output ports, a memory address input and a read-write input. The input ports are connected to write bus 710. The output ports are connected to read bus 712. The read/write input is connected to receive read/write signal R/W from read/write input 723. The memory address input is connected to receive event designator ED, or an address generated by mapping event designator ED to the address space of memory 702, from event designator input 724. Alternatively, memory 702 may have combined input/output ports (not shown). In this case, a single read/write bus to which the output of data selector 704 and the input of demultiplexer 706 are connected is substituted for write bus 710 and read bus 712.

Data selector 704 has a first input, a second input, a control input and a bus output. The first input is connected to receive the initial event records IER generated by time of flight calculator 130 from event record input 716. The control input is connected to receive function designator FD from function designator input 722. The bus output is connected to write bus 710.

Demultiplexer 706 has a bus input, a selector input, an intensity output, an allowed TOF count output, an allowed TOF output and a previous intensity apportionment output. The bus input is connected to read bus 712. The selector input is connected to receive TOF index TI from TOF index input 725. TOF index TI designates the one of the allowed TOF fields and the one of the intensity apportionment fields in the event record read out from memory 702 whose contents are output to the allowed TOF output and the previous intensity apportionment output, respectively. The intensity output, the allowed TOF count output, the allowed TOF output and the previous intensity apportionment output are respectively connected to intensity output 717, allowed TOF count output 718, allowed TOF output 719 and previous intensity apportionment output 720.

Cache 708 is structured to store each event record read out from memory 702 while the intensity apportionment field(s) of the event record are updated. Cache 708 has an intensity input, an allowed TOF count input and an allowed TOF input respectively connected to the like-named outputs of demultiplexer 706. Cache 708 additionally has a new intensity apportionment input connected to new intensity apportionment input 721. Cache 708 additionally has an event record output connected to provide an updated event record UER to the second input of data selector 704. Finally, cache 708 has a selector input connected to receive TOF index TI from TOF index input 725. TOF index TI received at the selector input designates the one of the allowed TOF fields and the one of the intensity apportionment fields of the updated event record stored in cache 708 in which are stored allowed TOF AT received at the allowed TOF input and new intensity apportionment IP received at the new intensity apportionment input, respectively, of the cache. Cache 708 and new intensity apportionment input 721 collectively perform the function of allowing each respective previous intensity apportionment linked to the detection event to be updated by a respective revised intensity apportionment generated using a respective one of the revised probabilities. In an embodiment in which detection event memory 700 stores previous probabilities instead of previous intensity apportionments, cache 708 and new intensity apportionment input 721 collectively perform the function of allowing each respective previous probability linked to the detection event to be updated by a respective one of the revised probabilities.

Detection event memory 700 operates during the above-described initial intensity apportioning process to receive a respective initial event record IER for each detection event from time of flight calculator 130 and to store such initial event record in memory 702. Detection event memory 700 additionally operates during the above-described revised probability determining and intensity reapportioning processes to read each event record stored in memory 702, to provide allowed TOFs and respective previous intensity apportionments to spectrum memory 150 and accumulator 508, respectively, to receive new intensity apportionments from apportioner 506 (FIG. 11), to update the event record with the new intensity apportionments, and to store the updated event record in memory 702. The event records read from memory 702 are initial event records IER or previously-updated event records UER.

As noted above with reference to FIG. 5, the event record pertaining to each detection event is composed of a field for intensity I, a field for allowed TOF count TC, TC fields for allowed times of flight $AT_1$-$AT_{TC}$ and a respective field for a respective previous intensity apportionment PIP linked to each allowed TOF field. The storage location at which the event record is written or from which the event record is read is defined by event designator ED received at event designator input 724.

In the example shown, intensity I, allowed TOF count TC, only one of the allowed times of flight AT selected by TOF index TI and previous intensity apportionment PIP linked to the allowed TOF are output at one time. In another example, the detection event memory has multiple allowed TOF outputs and multiple previous intensity apportionment outputs (not shown) that enable the detection event memory to output the entire event record at once.

During the measurement run, detection event memory 700 operates to store the initial event record IER pertaining to each detection event represented by detection signal DS as follows. Detection event memory receives function designator FD, read/write signal R/W and event designator ED from controller 504 via function designator input 722, read/write signal input 723 and event designator input 724, respectively. Function designator FD is in its write state that causes data selector 704 to connect its first input to its bus output. With data selector 704 so configured, each initial event record IER received at event record input 716 is presented to write bus 710. Event designator ED defines the storage location in which initial event record IER is to be written. Typically, the current value of event count EC output by allowed time of flight calculator 130 provides event designator ED. Read/write signal R/W is provided in a write state that causes memory 702 to write initial event record IER at the storage location 714 designated by event designator ED.

During the initial intensity apportioning process described above, the initial event records IER are sequentially read from memory 702. Detection event memory 700 receives function designator FD, read/write signal R/W, event designator ED and TOF index TI from controller 504 via function designator input 722, read/write signal input 723, event designator input 724 and TOF index input 725, respectively. Function designator FD is provided in its rewrite state that causes data selector 704 to connect the output of cache 708 to write bus 710. Event designator ED defines the storage location from which the event record will be read. Read/write signal R/W is provided in its read state that causes memory 702 to read out onto read bus 712 the initial event record IER from the storage location 714 designated by event designator ED.

From read bus 712, initial event record IER passes to demultiplexer 706. Demultiplexer 706 extracts intensity I and allowed TOF count TC from the event record, outputs intensity I to apportioner 506 via intensity output 717, and outputs allowed TOF count TC to controller 504 and probability calculator 510 via allowed TOF count output 718. Demultiplexer 706 additionally outputs intensity I and allowed TOF count TC to the intensity input and allowed TOF count input, respectively, of cache 708, and the cache stores the intensity and the allowed TOF count in respective fields of an updated event record UER. Additionally, during the initial intensity apportioning process, in response to successive values of TOF index TI, demultiplexer 706 extracts each allowed TOF AT from the initial event record and outputs the allowed TOF to memory address output 534 via allowed TOF output 719. Demultiplexer 706 additionally outputs each allowed TOF AT to the allowed TOF input of cache 708. The cache stores each allowed TOF AT in updated event record UER in a respective allowed TOF field designated by TOF index TI.

For each allowed TOF AT output to memory address output 534, detection event memory 700 receives from apportioner 506 a respective new intensity apportionment NIP at new intensity apportionment input 721. In the initial intensity apportioning process, each new intensity apportionment is an initial intensity apportionment. From new intensity apportionment input 721, each new intensity apportionment passes to the intensity apportionment input of cache 708. Cache 708 stores each new intensity apportionment NIP in updated event record UER in a respective intensity apportionment field designated by TOF index TI. Once new intensity apportionments for all the allowed times of flight linked to the detection event have been received and cached in cache 708, cache 708 outputs the updated event record UER pertaining to the detection event to data selector 704. Updated event record UER contains an initial intensity apportionment linked to each allowed TOF linked to the detection event. The updated event record passes through data selector 704 to write bus 710. Controller 504 then provides read/write signal R/W in its write state to cause memory 702 to write updated event record UER to the storage location 714 designated by event designator ED. The updated event record overwrites the initial event record previously stored at the storage location.

Detection event memory 700 operates in a manner similar to that just described during the revised probability determining and intensity reapportioning processes described above. The updated event records are again read from memory 702, each is demultiplexed and its constituents are output in a manner similar to that described above. In addition, cache 708 caches the intensity, allowed TOF count and each allowed TOF output by demultiplexer 706 as part of a further-updated event record UER. Since the updated event record read from memory 702 now includes a respective previous intensity apportionment linked to each allowed TOF, demultiplexer 706 additionally outputs a respective previous intensity apportionment PIP linked to each allowed TOF at its previous intensity apportionment output. Previous intensity apportionment PIP is output to the previous intensity apportionment input of accumulator 508 via previous intensity apportionment output 720.

For each allowed TOF output to memory address output 534, detection event memory 700 receives from apportioner 506 a respective revised intensity apportionment as a new intensity apportionment NIP at new intensity apportionment input 721. Cache 708 stores each revised intensity apportionment NIP in further-updated event record UER in a respective field designated by allowed TOF index TI. When a respective revised intensity apportionment has been received for each allowed TOF linked to the detection event, further-updated event record UER is stored in memory 702 in a manner similar to that described above.

Figure 14:
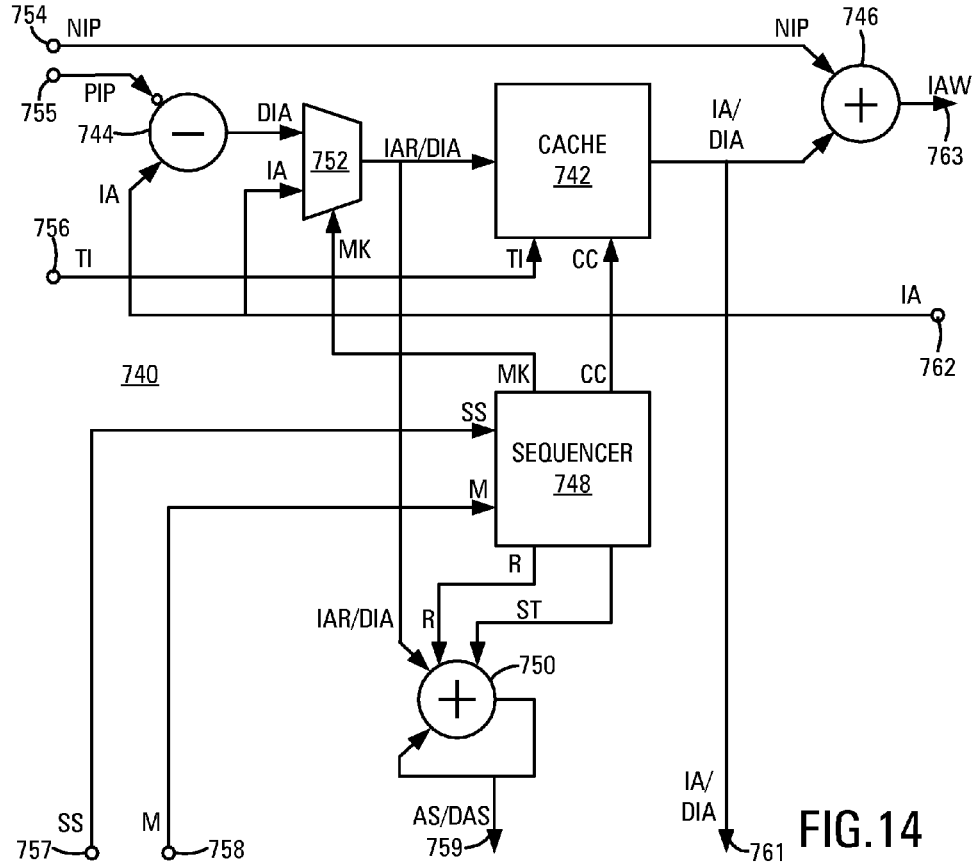
FIG. 14 is a block diagram showing a simplified example of the accumulator of the intensity apportioner shown in FIG. 11.

FIG. 14 is a block diagram showing a simplified example 740 of accumulator 508 described above with reference to FIG. 11. Accumulator 740 is composed of a cache 742, a differencing circuit 744, a summing circuit 746, a sequencer 748, an accumulating circuit 750 and a multiplexer 752. Accumulator 740 additionally has a new intensity apportionment input 754, a previous intensity apportionment input 755, a TOF index input 756, a strobe input 757, a mode input 758, an accumulation sum output 759, an accumulation output 761, a read input 762 and a write output 763.

Cache 742 has an accumulation input, an output, an address input and a control input. Cache 742 has one storage location for the maximum number S of allowed times of flight that can be linked to a detection event. The address input is connected to receive TOF index TI from TOF index input 756. TOF index TI defines the respective storage location to which an intensity accumulation received at the accumulation input is written or from which an intensity accumulation is read. Depending on the operational mode of accumulator 740, the intensity accumulation is an intensity accumulation IA received from read input 742 or a depleted intensity accumulation DIA generated by differencing circuit 744. The output is connected to provide each intensity accumulation read from cache 742 to accumulation output 761.

Cache 742 may additionally be structured to store the respective allowed TOF to which each intensity accumulation stored therein is linked. In this case, cache 742 has an additional input (not shown) connected to receive allowed TOFs AT from the allowed TOF output of detection event memory 502, and an additional output (not shown) via which the cache provides allowed TOFs AT to the address output 534 (FIG. 11) of intensity apportioner 500. The allowed TOFs are written and read by cache 742 in response to the same TOF index TI and cache control signal CC as the intensity accumulations IA or depleted intensity accumulations DIA. Caching the allowed TOFs allows the allowed TOFs linked to each detection event to be read from detection event memory once instead of twice during the revised probability determining and intensity reapportioning processes for the detection event.

Differencing circuit 744 performs the function of subtracting the respective previous intensity apportionment linked to each allowed TOF linked to the detection event from the respective intensity accumulation linked to the allowed TOF to generate the respective depleted intensity accumulation linked to the allowed TOF. Differencing circuit 744 has an inverting input, a non-inverting input and an output. The inverting input is connected to receive the previous intensity apportionment PIP for each allowed TOF linked to each detection event from previous intensity apportionment input 755. The non-inverting input is connected to receive from read input 762 intensity accumulation IA read from the TOF bin addressed by the allowed TOF in spectrum memory 150.

Summing circuit 746 performs the function of summing the intensity accumulations IA linked to the detection event and respective intensity apportionments NIP to generate respective new intensity accumulations. Summing circuit 746 has a first input, a second input and an output. The first input is connected to receive the new intensity apportionment NIP for each allowed TOF linked to each detection event from new intensity apportionment input 752. The second input is connected to the output of cache 742 to receive each intensity accumulation IA or depleted intensity accumulation DIA read out from the cache. The output is connected to provide a revised intensity accumulation IAW generated by summing circuit 746 to write output 763 for writing in spectrum memory 150.

Sequencer 748 has a strobe input, a mode input, a multiplexer control output, a cache control output, a reset output and a strobe output. The strobe input and the mode input are respectively connected to receive strobe signal SS and mode control signal M from strobe input 757 and mode input 758, respectively. The cache control signal output is connected to provide cache control signal CC to the control input of cache 742. Cache control signal CC defines the read/write mode of the cache and the timing of such reading or writing.

Accumulating circuit 750 initially performs the function of accumulating the intensity accumulations IA linked to each detection event to generate a respective accumulation sum AS. Accumulating circuit 750 later performs the function of accumulating the depleted intensity accumulations DIA linked to all of the allowed TOFs linked to the detection event to generate a depleted accumulation sum DAS. Accumulating circuit 750 has a first input, a second input, a reset input, a strobe input and an output. The reset input and the strobe input are connected to receive a reset signal R and a strobe signal ST, respectively, from the strobe output and reset output, respectively, of sequencer 748. The output is connected to the second input and to accumulation sum output 759. In response to strobe signal ST, accumulating circuit 750 adds the intensity accumulation IA present at its first input to the accumulation sum present at its second input and transfers the resulting new accumulation sum to its output. The accumulation sum is accumulation sum AS or depleted accumulation sum DAS.

Multiplexer 752 has a first input, a second input, a control input and an output. The first input is connected to the output of differencing circuit 744 to receive each depleted intensity accumulation DIA generated by the differencing circuit. The second input is connected to receive each intensity accumulation IA received from spectrum memory 150 via read input 762. The output is connected to provide each depleted intensity accumulation DIA or each intensity accumulation IA received by the multiplexer to the accumulation input of cache 742 and to the first input of accumulating circuit 750. The control input is connected to receive multiplexer control signal MK from the multiplexer control output of sequencer 748. The state of multiplexer control signal MK determines whether multiplexer 752 outputs depleted intensity accumulation DIA or intensity accumulation IA to the accumulation input of cache 742.

The mode control signal M provided to sequencer 748 by controller 504 selects one of two operational modes in which accumulator 740 operates in response to receiving strobe signal SS from controller 504. The operational modes are (1) an initial accumulation mode in which accumulator 740 operates when it accumulates the initial intensity apportionments, as described above with reference to block 210 of FIG. 3; and (2) a reapportioning mode in which accumulator 740 operates during the intensity reapportioning process described above with reference to block 214 of FIG. 3.

In the initial accumulation mode, accumulator 740 receives an intensity accumulation IA from a TOF bin in spectrum memory 150 addressed by each of the allowed TOFs linked to each detection event, caches the intensity accumulation linked to the allowed TOF and adds the intensity accumulation to an accumulation sum AS. The accumulator outputs the accumulation sum to probability calculator 510 for use in determining probabilities for apportioning the intensity of the detection event among the allowed TOFs linked to the detection event. Accumulator 740 also sums a respective new intensity apportionment NIP received from apportioner 506 for the allowed TOF and the cached intensity accumulation IA linked to the allowed TOF to generate a new intensity accumulation IAW and outputs new intensity accumulation IAW to the spectrum memory for writing back in the TOF bin addressed by the allowed TOF.

In the reapportioning mode, accumulator 740 subtracts a respective previous intensity apportionment PIP received from detection event memory 502 for each allowed TOF linked to each detection event from the intensity accumulation IA received from a TOF bin in spectrum memory 150 addressed by the allowed TOF to generate a depleted intensity accumulation DIA. Accumulator 740 additionally caches depleted intensity accumulation DIA linked to the allowed TOF and adds the depleted intensity accumulation to a depleted accumulation sum DAS. The accumulator outputs the depleted accumulation sum to probability calculator 510 for use in determining revised probabilities for apportioning the intensity of the detection event among the allowed TOFs. Finally, the accumulator adds a respective revised intensity apportionment NIP received from apportioner 506 and cached depleted intensity accumulation DIA to generate a revised intensity accumulation IAW and outputs revised intensity accumulation IAW to the spectrum memory for writing back in the defined TOF bin. In the reapportioning mode, accumulator 740 changes the intensity accumulation stored in the defined TOF bin.

Sequencer 748 operates in response to strobe signal SS to cause accumulator 740 to operate in its initial accumulation mode in which the accumulator sums the initial apportionments of the intensity of an exemplary detection event and the respective intensity accumulations stored in the TOF bins of spectrum memory 150 addressed by the allowed TOFs linked to the detection event to generate respective new intensity accumulations that are output to spectrum memory 150 for storage. The accumulator performs the operations just described, and described in more detail below, for each of the detection events represented by detection signal DS. Controller 504 sets TOF index TI to an initial value corresponding to the first allowed TOF linked to the detection event. This causes detection event memory 502, when commanded, to output the first allowed TOF AT to memory address output 534 (FIG. 11) for input to spectrum memory 150. Controller 504 then commands spectrum memory 150 to read out the intensity accumulation IA stored in the TOF bin addressed by the first allowed TOF AT. Accumulator 740 receives intensity accumulation IA at read input 762.

Sequencer 748 provides reset signal R to accumulating circuit 750. Reset signal R sets accumulation sum AS output by accumulating circuit 750 to zero. Sequencer 748 also provides multiplexer control signal MK to multiplexer 752. Multiplexer control signal MK is in a state that causes the multiplexer to connect read input 762 to the accumulation input of cache 742 and the first input of accumulating circuit 750 so that intensity accumulation IA received from read input 762 is provided to the accumulation input of cache 742 and to the first input of accumulating circuit 750. Cache 742 operates in response to cache control signal CC to cache intensity accumulation IA at the memory location defined by TOF index TI. Optionally, as noted above, accumulator 740 additionally receives the first allowed TOF from detection event memory 502, and cache 742 operates in response to cache control signal CC to cache intensity accumulation IA for the first allowed TOF and the first allowed TOF itself at respective memory locations therein defined by TOF index TI.

Sequencer 748 additionally provides strobe signal ST to accumulating circuit 750. The strobe signal causes accumulating circuit 750 to perform a summing operation in which it sums intensity accumulation IA received at its first input and accumulation sum AS received at its second input to generate a new accumulation sum AS. Accumulating circuit 750 outputs the new accumulation sum to the second input of accumulating circuit 750 and to probability calculator 510 via accumulation sum output 759.

Controller 504, detection event memory 502, spectrum memory 150 and accumulator 748 then repeat the operations just described. On each repetition, controller 504 increments TOF index TI by one, which causes detection event memory 502, when commanded, to output the next allowed TOF linked to the detection event. The operations are repeated until intensity accumulations IA for all of the allowed times of flight linked to the detection event (and, optionally, the allowed times of flight in addition) have been cached in cache 742 and accumulation sum AS output by accumulating circuit 750 at accumulation sum output 759 is the sum of the intensity accumulations IA received from the respective TOF bins in spectrum memory 150 addressed by all the allowed TOFs linked to the detection event. The final value of accumulation sum AS is output to probability calculator 510 via accumulation sum output 759, where it is available for use in calculating the initial probabilities for apportioning the intensity of the detection event.

Controller 504 then resets TOF index TI to its initial value. This causes detection event memory 502, when commanded, to output the first allowed TOF AT linked to the detection event to memory address output 534 (FIG. 11). Controller 504 additionally outputs strobe signal SS to sequencer 748. Sequencer 748 operates in response to strobe signal SS to output cache control signal CC to cache 742. Cache 742 operates in response to cache control signal CC to read the intensity accumulation IA from the memory location therein defined by TOF index TI, and to output intensity accumulation IA to probability calculator 510 via accumulation output 761. Optionally, in an embodiment in which cache 742 additionally stored the allowed TOFs linked to the detection event, instead of reading first allowed TOF AT from detection event memory 502, cache control signal CC additionally causes cache 742 to read the first allowed TOF AT linked to the detection event and to output the first allowed TOF to memory address output 534 (FIG. 11). This is typically faster than reading the first allowed TOF from detection event memory 502.

In probability calculator 510, intensity accumulation IA is available, together with accumulation sum AS, for use in calculating an initial probability for the first allowed TOF AT linked to the detection event. Controller 504 then commands probability calculator 510 to generate an initial probability for the first allowed TOF linked to the detection event, and apportioner 506 calculates an initial apportionment of the intensity of the detection event to the first allowed TOF linked to the detection event using the initial probability received from probability calculator 510. Accumulator 740 receives the initial intensity apportionment generated by apportioner 506 as a new intensity apportionment NIP at new intensity apportionment input 754. From the new intensity apportionment input, new intensity apportionment NIP passes to the first input of summing circuit 746.

Summing circuit 746 receives new intensity apportionment NIP at its first input and intensity accumulation IA read out from cache 742 at its second input. Summing circuit 746 sums new intensity apportionment NIP and intensity accumulation IA to generate a new intensity accumulation IAW. Summing circuit 746 outputs the new intensity accumulation to spectrum memory 150 via write output 763.

Spectrum memory 150 receives new intensity accumulation IAW from write output 763, and receives memory control signal MC from controller 504. Memory control signal MC commands the spectrum memory to write new intensity accumulation IAW to the TOF bin addressed by allowed TOF AT read out from detection event memory 504 or from cache 742.

Controller 504, probability calculator 510, apportioner 506, spectrum memory 150 and accumulator 748 repeat the operations just described. On each repetition, controller 504 increments TOF index TI by one, which causes detection event memory 502, when commanded, to output the next allowed TOF linked to the detection event. Optionally, the next allowed TOF linked to the detection event is read from cache 742 instead of from detection event memory 502, as described above. The operations are repeated until respective new intensity accumulations IAW have been written to the respective TOF bins addressed by all the allowed times of flight AT linked to the detection event.

Sequencer 748 operates in response to strobe signal SS to cause accumulator 740 to operate in its reapportioning mode in which the accumulator subtracts the previous intensity apportionments linked to an exemplary detection event from the respective intensity accumulations stored in the respective TOF bins of spectrum memory 150 addressed by the allowed TOFs linked to the detection event to generate respective depleted intensity accumulations. The accumulator caches the depleted intensity accumulations and generates a depleted accumulation sum from the depleted intensity accumulations for probability calculator 510 to use in determining revised probabilities. Then, accumulator 508 adds the revised intensity apportionments generated using the revised probabilities to the cached depleted intensity accumulations to generate respective revised intensity accumulations that are written to the respective TOF bins addressed by the allowed TOFs linked to the detection event. Accumulator 508 performs the operations just described, and described in more detail below, for each of the detection events represented by detection signal DS.

Sequencer 748 provides reset signal R to accumulating circuit 750. Reset signal R sets depleted accumulation sum DAS output by accumulating circuit 750 to zero. Sequencer 748 additionally provides multiplexer control signal MK to multiplexer 752. Multiplexer control signal MK is in a state that causes the multiplexer to connect the output of differencing circuit 744 to the accumulation input of cache 742 and to the first input of accumulating circuit 750.

Controller 504 resets TOF index TI to its initial value. This causes detection event memory 502, when commanded, to output the first allowed TOF AT linked to the detection event to memory address output 534 (FIG. 11) and to output the respective previous intensity apportionment PIP linked to first allowed TOF AT to accumulator 740. Controller 504 then commands spectrum memory 150 to read out intensity accumulation IA stored in the TOF bin addressed by the first allowed TOF AT. Accumulator 740 receives intensity accumulation IA at read input 762. Intensity accumulation IA passes from read input 762 to the non-inverting input of differencing circuit 744. Accumulator 740 receives previous intensity apportionment PIP output by detection event memory 502 at previous intensity apportionment input 755. Previous intensity apportionment PIP passes from previous intensity apportionment input 755 to the inverting input of differencing circuit 744.

Differencing circuit 744 subtracts previous intensity apportionment PIP from intensity accumulation IA to generate depleted intensity accumulation DIA. Differencing circuit 744 outputs depleted intensity accumulation DIA to the accumulation input of cache 742 and the first input of accumulating circuit 750 via multiplexer 752. Cache 742 operates in response to cache control signal CC to cache depleted intensity accumulation DIA at the memory location therein defined by TOF index TI. Optionally, accumulator 740 additionally receives the first allowed TOF from detection event memory 502, and cache 742 operates in response to cache control signal CC to cache intensity accumulation IA for the first allowed TOF and the first allowed TOF itself at respective memory locations therein defined by TOF index TI.

Sequencer 748 additionally provides strobe signal ST to accumulating circuit 750. Strobe signal ST causes accumulating circuit 750 to perform an accumulating operation in which it adds depleted intensity accumulation DIA received at its first input and depleted accumulation sum DAS received at its second input to generate a new depleted accumulation sum. Accumulating circuit 750 outputs the new depleted accumulation sum to the second input of accumulating circuit 750 and to accumulation sum output 759.

Controller 504, detection event memory 502 spectrum memory 150 and accumulator 748 then repeat the operations just described. On each repetition, controller 504 increments TOF index TI by one, which causes detection event memory 502, when commanded, to output the next allowed TOF linked to the detection event and the previous intensity apportionment linked to the allowed TOF. The operations are repeated until depleted intensity accumulations DIA for all of the allowed times of flight linked to the detection event (and, optionally, the allowed times of flight in addition) have been cached in cache 742 and the depleted accumulation sum DAS output by accumulating circuit 750 at accumulation sum output 759 is the sum of all the respective depleted intensity accumulations generated by differencing circuit 744 for the detection event. The final value of depleted accumulation sum DAS is output from accumulation sum output 759 to probability calculator 510, where it is used to calculate revised probabilities for the detection event.

Controller 504 then resets TOF index TI to its initial value. This causes detection event memory 502, when commanded, to output once again the first allowed TOF AT linked to the detection event to memory address output 534 (FIG. 11). Controller 504 additionally outputs strobe signal SS to sequencer 748. Sequencer 748 operates in response to strobe signal SS to output cache control signal CC to cache 742. Cache 742 operates in response to cache control signal CC to read the depleted intensity accumulation DIA for the first allowed TOF from the memory location therein defined by TOF index TI. Cache 742 outputs depleted intensity accumulation DIA to the second input of summing circuit 746 and to probability calculator 510 via accumulation output 761. Optionally, instead of reading first allowed TOF AT from detection event memory 502, cache control signal CC additionally causes cache 742 to read the first allowed TOF AT linked to the detection event and to output the first allowed TOF to memory address output 534 (FIG. 11).

Controller 504 commands probability calculator 510 to calculate a revised probability for the first allowed TOF AT linked to the detection event using depleted intensity accumulation DIA and depleted accumulation sum DAS. Apportioner 506 then generates a revised apportionment of the intensity of the detection event to the first allowed TOF using the revised probability received from probability calculator 510. Accumulator 740 receives the revised intensity apportionment generated by apportioner 506 as a new intensity apportionment NIP at new intensity apportionment input 754. From the new intensity apportionment input, new intensity apportionment NIP passes to the first input of summing circuit 746.

Summing circuit 746 receives new intensity apportionment NIP at its first input and depleted intensity accumulation DIA read out from cache 742 at its second input. Summing circuit 746 sums new intensity apportionment NIP and depleted intensity accumulation DIA to generate a new intensity accumulation IAW. Summing circuit 746 outputs new intensity accumulation IAW to spectrum memory 150 via write output 763. Spectrum memory 150 operates in response to memory control signal MC received from controller 504 to write new intensity accumulation IAW to the TOF bin addressed by allowed TOF AT read out from detection event memory 504 or from cache 742.

Controller 504, probability calculator 510, apportioner 506, spectrum memory 150 and accumulator 748 repeat the operations just described. On each repetition, controller 504 increments TOF index TI by one, which causes detection event memory 502, when commanded, to output the next allowed TOF linked to the detection event and the previous intensity apportionment linked to the next allowed TOF. Optionally, the next allowed TOF linked to the detection event is read from cache 742 instead of from detection event memory 502, as described above. The operations are repeated until respective new intensity accumulations IAW have been written to the respective TOF bins addressed by all the allowed times of flight AT linked to the detection event.

In embodiments of mass spectrometer 100 in which only a common initial probability is used in the initial intensity apportioning process described above with reference to block 208 of FIG. 3 to determine apportionments of the intensity of each detection event among the respective allowed TOFs linked to the detection event, accumulator 740 is reconfigured as follows: the output of differencing circuit 744 is connected to the accumulation input of cache 752, and the first input of multiplexer 752 is connected to the output of cache 742. The second input of multiplexer 752 remains connected to read input 762. Probability calculator 510 provides the common initial probability to apportioner 506 and apportioner 506 provides the common initial intensity apportionment NIP to the new intensity apportionment input 754 of accumulator 740. In the initial intensity apportioning process, the respective intensity accumulation IA read out from the respective TOF bin addressed by each allowed TOF linked to the detection event is received at read input 762 and passes through multiplexer 752 to the second input of summing circuit 746. Summing circuit 746 sums the common initial intensity apportionment received at the first input of the summing circuit and the intensity accumulation IA received at the second input of the summing circuit to generate a respective new intensity accumulation IAW. New intensity accumulation IAW is then output to spectrum memory 150 via write output 763. Operation of differencing circuit 744 is inhibited during this process and therefore differencing circuit 744 generates no intensity accumulation IA from the intensity apportionments IA received from spectrum memory 150. Consequently, accumulating circuit 750 generates an accumulation sum AS of zero for the detection event.

Figure 15:
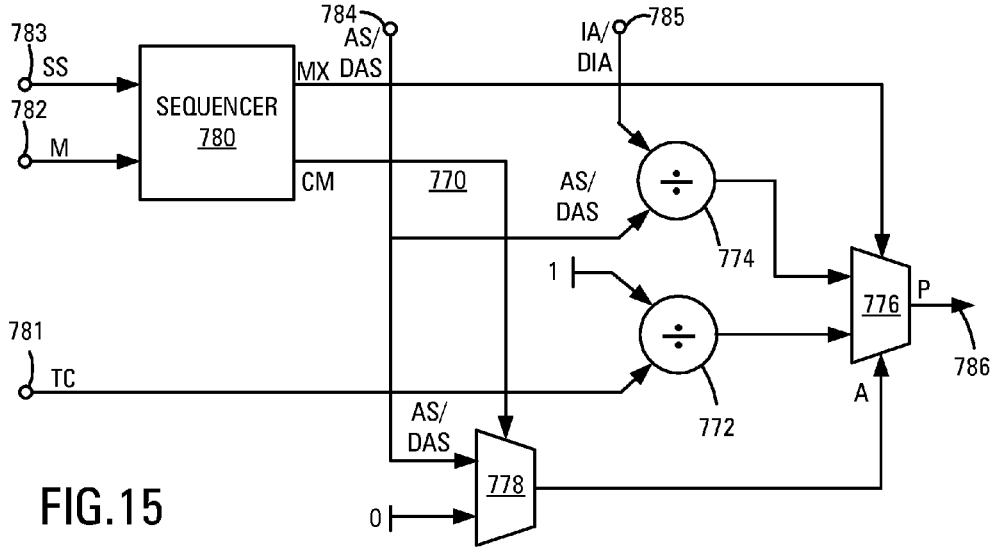
FIG. 15 is a block diagram showing a simplified example of the probability calculator of the intensity apportioner shown in FIG. 11.

FIG. 15 is a block diagram showing a simplified example 770 of probability calculator 510 described above with reference to FIG. 11. Probability calculator 770 is composed of a first divider 772, a second divider 774, a multiplexer 776, a comparator 778 and a sequencer 780. Probability calculator 770 additionally has an allowed TOF count input 781, a mode input 782, a strobe input 783, an accumulation sum input 784, an accumulation input 785 and a probability output 786.

During the initial intensity apportioning process in which an apportionment of the intensity of each detection event among the allowed TOFs linked thereto is determined using initial probabilities, as described above with reference to block 208 of FIG. 3, for a detection event whose accumulation sum AS is zero, first divider 772 generates a common initial probability IP that is used to generate a common intensity apportionment for all the allowed times of flight linked to the detection event. Thus first divider 772 performs the function of generating equal initial probabilities that depend on the number of allowed TOFs linked to the detection event. First divider 772 has a dividend input, a divisor input and an output. The dividend input is connected to receive a numerical representation of unity. The divisor input is connected to receive the allowed TOF count TC from allowed TOF count input 781.

In an alternative implementation, first divider 772 is replaced by a look-up table (not shown) in which is stored a respective reciprocal value for each of the S possible values of allowed TOF count TC. Such look-up table also performs the function of determining equal initial probabilities that depend on the number of allowed TOFs linked to the detection event. Upon receiving the allowed TOF count TC for the detection event from allowed TOF count input 781, the look-up table outputs the reciprocal of allowed TOF count TC to multiplexer 776 as the common initial probability.

During the above-mentioned initial intensity apportioning process, for a detection event whose accumulation sum AS is greater than zero, second divider 774 performs the function of determining, for each allowed TOF linked to the detection event, a respective initial probability for each allowed TOF linked to the detection event. The initial probability depends on the respective intensity accumulation IA linked to the allowed TOF. Moreover, during the revised probability determining process described above with reference to block 212 of FIG. 3, for each detection event, second divider 774 performs the function of generating a respective revised probability for each allowed TOF linked to the detection event from (a) the intensity accumulation linked to the allowed TOF, and (b) the respective intensity accumulations linked to all of the allowed TOFs linked to the detection event. Specifically, second divider 774 performs the function of dividing the respective depleted intensity accumulation linked to each allowed TOF linked to the detection event by the depleted accumulation sum to generate the respective revised probability linked to the allowed TOF.

Second divider 774 has a dividend input, a divisor input and an output. The dividend input is connected to receive a respective intensity accumulation linked to the allowed TOF. The intensity accumulation is received from cache 742 in accumulator 508 via accumulation input 785. The cached accumulation is an intensity accumulation IA during the initial intensity apportioning process and a depleted intensity accumulation DIA during the revised probability determining process. The divisor input is connected to receive an accumulation sum for the detection event from accumulation sum input 784. The accumulation sum is an accumulation sum AS during the initial intensity apportioning process and a depleted accumulation sum DAS during the revised probability determining process.

Multiplexer 776 has a first input, a second input, an address input, a control input and an output. The first input is connected to the output of first divider 772. The second input is connected to the output of second divider 774. The output is connected to probability output 786.

Comparator 778 has a comparison input, a reference input, a control input and an output. The comparison input is connected to receive the above-described accumulation sum from accumulation sum input 784. The reference input is connected to receive a representation of zero. The output is connected to provide an address signal A to the address input of multiplexer 776.

Sequencer 780 has a mode input, a strobe input, a multiplexer control output and a comparator control output. The mode input is connected to receive mode control signal M from mode input 782. The strobe input is connected to receive strobe control signal SS from strobe input 783. The multiplexer control output is connected to provide a multiplexer control signal MX to the control input of multiplexer 776. The comparator control output is connected to provide a comparator control signal CM to the control input of comparator 778.

Another example of probability calculator 770 has a single divider and two multiplexers (not shown). The divider has a dividend input, a divisor input and an output. The output is connected to probability output 786. One of the multiplexers has an output connected to the dividend input of the divider, and inputs connected to accumulation input 785 and a representation of unity, respectively. The other of the multiplexers has an output connected to the divisor input of the divider, and inputs connected to accumulation sum input 784 and allowed TOF count input 781, respectively. Both multiplexers operate in response to address signal A and multiplexer control signal MX.

During the initial intensity apportioning process described above with reference to block 208 of FIG. 3, probability calculator 770 outputs to apportioner 506 a respective initial probability for each allowed TOF linked to each detection event. As noted above in the description of FIG. 7C, when accumulation sum AS is zero, the initial probability is a common probability that is the same for all the allowed times of flight linked to the detection event. Alternatively, when accumulation sum AS is greater than zero, the initial probability is a respective initial probability for each allowed TOF linked to the detection event.

First divider 772 calculates the common initial probability by dividing a probability of unity by allowed TOF count TC, which represents the number of allowed times of flight linked to the detection event. First divider 772 receives at its divisor input the allowed TOF count TC read out of detection event memory 502 for the detection event. The divisor input receives allowed TOF count TC from allowed TOF input 781. First divider 772 additionally receives a numerical representation of unity at its dividend input. First divider 772 divides unity by allowed TOF count TC to generate a single initial probability IP for the detection event.

During the initial intensity apportioning process, second divider 774 calculates a respective initial probability for each allowed TOF linked to the detection event by dividing a respective intensity accumulation IA by accumulation sum AS for the detection event. Second divider 774 receives intensity accumulation IA for the allowed TOF at its dividend input and accumulation sum AS for the detection event at its divisor input, and divides intensity accumulation IA by accumulation sum AS to generate the respective initial probability.

To determine whether probability calculator 770 outputs the common initial probability calculated by first divider 772 for all allowed times of flight linked to the detection event or a respective initial probability calculated by second divider 774 for each allowed TOF linked to the detection event, sequencer 780 provides comparator control signal CM to the control input of comparator 778 after probability calculator 770 has received a final accumulation sum AS for the detection event from accumulator 508. In response to comparator control signal CM, comparator 778 compares accumulation sum AS received at its comparison input with a representation of zero received at its reference input. A value of accumulation sum AS equal to zero causes comparator 778 to output address signal A in a state that causes multiplexer 776 to connect the output of first divider 772 to probability output 786. Then, in response to multiplexer control signal MX, multiplexer 776 outputs the common initial probability calculated by first divider 772 to apportioner 506 as probability P. A value of accumulation sum AS greater than zero causes comparator 778 to output address signal A in a state that causes multiplexer 776 to connect the output of second divider 774 to probability output 786. Then, in response to multiplexer control signal MX, multiplexer 776 outputs the respective initial probability calculated by second divider 774 for each allowed TOF linked to the detection event to apportioner 506 as a respective probability P.

In an embodiment in which a single initial probability for each detection event is exclusively applied during the initial intensity apportioning process described above with reference to block 208 of FIG. 3, and as described above with reference to FIG. 7B, accumulator 508 receives no intensity accumulations from spectrum memory 150 and therefore generates an accumulation sum AS of zero. Such an accumulation sum input to comparator 778 causes multiplexer 776 to connect the output of first divider 774 to probability output 786 throughout the initial intensity apportioning process.

Probability calculator 770 operates as follows as intensity apportioner 140 performs the revised probability determining process described above with reference to block 212 of FIG. 3 for each detection event. The following operations are performed after accumulator 508 has subjected the intensity accumulations received from the respective TOF bins addressed by all of the allowed times of flight linked to the detection event to respective depletion operations to generate respective depleted intensity accumulations DIA, has cached the depleted intensity accumulations DIA, and has summed the depleted intensity accumulations to generate a depleted accumulation sum DAS for the detection event. Probability calculator 770 then receives from accumulator 508 depleted accumulation sum DAS at accumulation sum input 784. Depleted accumulation sum DAS is fed to the divisor input of second divider 774. Additionally, probability calculator 770 sequentially receives from accumulator 508 at accumulation input 784 the depleted intensity accumulations DIA for the detection event. Each of the depleted intensity accumulations corresponds to a respective one of the allowed times of flight linked to the detection event and was stored in cache 742 (FIG. 14). Each depleted intensity accumulation DIA is fed to the dividend input of second divider 774. Second divider 774 divides each depleted intensity accumulation DIA by depleted accumulation sum DAS to generate a respective revised probability. Second divider 774 outputs the revised probability to multiplexer 776.

During the revised probability determining process, for most detection events, at least one of the depleted intensity accumulations received from accumulator 508 is greater than zero and therefore the corresponding depleted accumulation sum will be greater than zero. In this case, comparator 778 generates address signal A in a state that causes multiplexer 776 to connect the output of second divider 774 to probability output 786. In response to multiplexer control signal MX, multiplexer 776 outputs the revised probability calculated by second divider 774 as a respective probability P for the allowed TOF linked to the detection event. Multiplexer 776 outputs the probability to apportioner 506 via probability output 786. Probability calculator 770 outputs to apportioner 506 a revised probability P for each allowed TOF linked to the detection event.

Occasionally, all of the depleted intensity accumulations received from accumulator 508 are equal to zero and therefore the corresponding depleted accumulation sum will be equal to zero. In this case, comparator 778 generates address signal A in a state that causes multiplexer 776 to connect the output of first divider 772 to probability output 786. In response to multiplexer control signal MX, multiplexer 776 outputs the revised probability calculated by first divider 774 as a respective probability P for the allowed TOF linked to the detection event. In this case, the revised probability is the same as the initial probability since it depends only on the number of allowed times of flight linked to the detection event. Multiplexer 776 outputs the unchanged revised probability to apportioner 506 via probability output 786. Probability calculator 770 outputs to apportioner 506 an unchanged revised probability P for each allowed TOF linked to the detection event.

Figure 16:
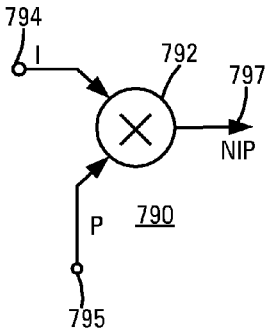
FIG. 16 is a block diagram showing a simplified example of the apportioner of the intensity apportioner shown in FIG. 11.

FIG. 16 is a block diagram showing a simplified example 790 of apportioner 506 described above with reference to FIG. 11. Apportioner 790 performs the function of multiplying the intensity of the detection event by the probability linked to the allowed TOF to generate a revised intensity apportionment linked to the allowed TOF. In the initial intensity apportioning process, the probability is an initial probability. In the intensity reapportioning process, the probability is a revised probability. Apportioner 790 is composed of a multiplier 792. Apportioner 790 additionally has an intensity input 794, a probability input 795 and an output 797. Multiplier 792 has a multiplicand input, a multiplier input and an output. The multiplicand input is connected to receive intensity I for the detection event from intensity input 794, and the multiplier input is connected to receive the respective probability P for the allowed TOF linked to the detection event from probability input 795. Probability P is an initial probability or a revised probability. The output is connected to intensity apportionment output 797.

With reference to an exemplary detection event, during the initial intensity apportioning process or the intensity reapportioning process described above with reference to block 208 and block 214, respectively, of FIG. 3, apportioner 790 receives the intensity I for the detection event from detection event memory 502 at intensity input 794. Additionally, apportioner 790 receives a probability P for the allowed TOF from probability calculator 510 at probability input 795. Probability P is an initial probability or a revised probability. Multiplier 792 multiplies intensity I by probability P to generate a respective new intensity apportionment NIP and outputs new intensity apportionment NIP to intensity apportionment output 797. New intensity apportionment NIP passes from intensity apportionment output 797 to the new intensity apportionment inputs of accumulator 508 and detection event memory 502.

During an example of the above-described initial intensity apportioning process performed when accumulation sum AS (FIG. 14) is equal to zero, probability P received at probability input 795 and new intensity apportionment NIP output at apportionment output 797 remain the same for each allowed TOF AT output from detection event memory 502 for the detection event and supplied to spectrum memory 150 as the address of a respective TOF bin. During an example of the above-described initial intensity apportioning process performed when accumulation sum AS is greater than zero and during the above-described intensity reapportioning process, for each allowed TOF output from detection event memory 502 for the detection event and supplied to spectrum memory 150 as the address of a respective TOF bin, apportioner 790 receives a respective probability P at probability input 795 and outputs a respective new intensity apportionment NIP at apportionment output 797 to the new intensity apportionment inputs of accumulator 508 and detection event memory 502.

Time of flight calculator 130, intensity apportioner 140 and spectrum memory 150 may be implemented in ways that differ from those exemplified above. Moreover the demarcation of circuitry among time of flight calculator 130, intensity apportioner 140 and spectrum memory 150 and among the constituent modules of time of flight calculator 130, intensity apportioner 140 and spectrum memory 150 may be different from that exemplified above. In one example, at least part of accumulator 508 is combined with spectrum memory 150. In another example, spectrum memory 150 constitutes part of intensity apportioner 140. Alternatively, circuitry different from that exemplified may be used to implement the processes described above with reference to FIGS. 3, 4, 6, 7A-7E, 8 and 9 and those described below with reference to FIGS. 22-24.

Time of flight calculator 130, intensity apportioner 140, spectrum memory 150 and their constituent elements can be implemented in hardware such as one or more integrated circuits having bipolar, N-MOS, P-MOS or CMOS devices. Design libraries comprising designs for implementing the above-described circuit elements in hardware are commercially available and can be used to design such hardware implementations.

Time of flight calculator 130, intensity apportioner 140, spectrum memory 150 and their constituent elements can alternatively be implemented in one or more pre-fabricated hardware devices such as application-specific integrated circuits (ASICs) or field-programmable gate arrays (FPGAs). Design libraries comprising designs for implementing the above-described circuit elements in such pre-fabricated hardware devices are commercially available and can be used to configure such pre-fabricated hardware devices to implement the above-described circuit elements.

Moreover, the above-mentioned time of flight calculator 130, intensity apportioner 140, spectrum memory 150 and their constituent elements can alternatively be implemented at least in part in software running on a suitable computational device such as a microprocessor, a digital signal processor (DSP) or a multi-thread graphics processor. The above-mentioned circuit elements may additionally constitute part of a digital signal processor that performs functions in addition to those described. Programming modules capable of programming a computational device to perform the operations performed by the above-described circuit elements are commercially available and may be used to program a computational device to provide a software implementation of the above-mentioned circuit elements. In such software implementations, the various circuit elements described in this disclosure are typically ephemeral, and exist only temporarily as the program executes.

Figure 17:
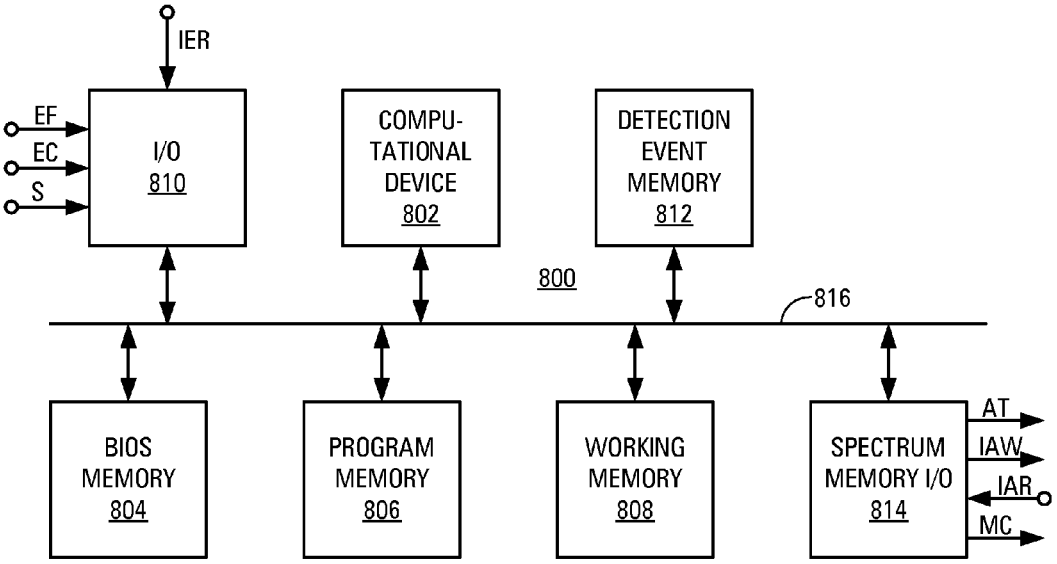
FIG. 17 is a block diagram showing a simplified example of the intensity apportioner of the mass spectrometer shown in FIG. 1 implemented using a computational device.

FIG. 17 is a block diagram showing a simplified example 800 of intensity apportioner 140 described above with reference to FIG. 1 in accordance with another embodiment of the invention implemented using a computational device. Intensity apportioner 800 is composed of a computational device 802, a basic input/output system (BIOS) memory 804, a program memory 806, a working memory 808, an input/output (I/O) module 810, a detection event memory 812, a spectrum memory I/O module 814 and a bus 816. Intensity apportioner 800 performs the function of determining, in accordance with initial probabilities, initial apportionments of the respective intensity of each of the detection events among the allowed TOFs linked thereto; accumulating the initial apportionments of the intensities to each one of the allowed times of flight to generate a respective intensity accumulation for storage in a respective one of the TOF bins corresponding to the one of the allowed times of flight; iteratively determining revised probabilities for each detection event using the intensity accumulations stored in the respective TOF bins corresponding to the allowed times of flight linked to the detection event; and reapportioning the respective intensity among the TOF bins corresponding to the allowed times of flight using the revised probabilities.

BIOS memory 804 is a read-only memory that stores a program that causes computational device 802 to perform basic input/output operations. Program memory 806 is a memory in which a program that causes computational device 802 to perform the operations described above with reference to FIG. 3, and in more detail with reference to FIGS. 4, 6, 7A-7E, 8 and 9, and those described below with reference to FIGS. 22-24. Such operations, performed in cooperation with time of flight calculator 130 and spectrum memory 150, transform detection signal DS output by ion detector 120 (FIG. 1) into a time-of-flight spectrum. In some embodiments, program memory 806 is non-volatile memory in which the program is permanently stored. In other embodiments, program memory 806 is random-access memory into which the program is loaded from another non-volatile memory (not shown), such as a hard disk, prior to the first measurement run. Such non-volatile memory is additionally coupled to bus 816. Working memory 808 is random-access memory in which intermediate results, such as depleted accumulation sum DAS, generated by the operation of computational device 802 are stored. Working memory 808 may alternatively be implemented using a cache that constitutes part of computational device 802. Input/output module 810 provides an interface by means of which intensity apportioner 800 receives event count EC and an initial event record IER and an event flag EF for each detection event from time of flight calculator 130, and additionally receives start signal S from controller 160. Detection event memory 812 is random-access memory in which a respective event record for each detection event represented by detection signal DS is stored as described above. In some embodiments, the structure of detection event memory 812 is similar to the examples shown in FIGS. 5 and 21. Spectrum memory I/O module 814 provides an interface by means of which intensity apportioner 800 provides allowed times of flight AT, intensity accumulations IAW, and memory control signal MC to spectrum memory 150, and receives intensity accumulations IA from spectrum memory 150. Bus 816 interconnects computational device 802, BIOS memory 804, program memory 806, working memory 808, input/output module 810, detection event memory 812 and spectrum memory input/output I/O module 814.

Computational device 802 operates in response to a program stored in program memory 806 to transform the respective event records received from time of flight calculator 130 as described herein to generate a time-of-flight spectrum stored in spectrum memory 150.

In another embodiment, spectrum memory 150 or memory 610 (FIG. 12) that constitutes part of spectrum memory 150 constitutes part of intensity apportioner 800. In such embodiment, spectrum memory 150 or memory 610 (FIG. 12) replaces spectrum memory I/O module 814. Two or more of program memory 806, working memory 808 and detection event memory 812 may share common memory devices, or may constitute part of computational device 802.

In yet another embodiment, computational device 802 in intensity apportioner 800 additionally performs the operations described above as being performed by time of flight calculator 130 or, in more detail, by time of flight calculator 400 (FIGS. 12A and 12B). In this case, I/O module 810 receives detection signal DS, transients T, start signal S and elapsed time signal ET instead of the signals described above. In such embodiment, computational device 802 operates in response to a program stored in program memory 806 to transform detection signal DS as described herein to generate a time-of-flight spectrum stored in spectrum memory 150.

A desirable performance parameter for mass spectrometers is that at least the time-of-flight spectrum be generated more or less in real time. In mass spectrometer 100, useful information regarding the chemical composition of the sample cannot be discerned directly from detection signal DS. The processes described above with reference to blocks 206, 208 and 210 of FIG. 3 and several iterations of the operations described above with reference to blocks 212 and 214 of FIG. 3 are performed to transform detection signal DS into a time-of-flight spectrum that conveys useful information regarding the chemical composition of the sample. Intensity apportioner 140 is advantageously constructed in a manner that reduces the time needed to perform the revised probability determining and intensity reapportioning processes described above with reference to blocks 212 and 214 of FIG. 3.

One way to speed up the transformation of the detection signal is to use parallel processing. While the descriptions above of the transformation operations assume the each detection event is processed before the next, nothing fundamental precludes multiple detection events being processed in parallel. In one exemplary implementation of parallel processing, intensity apportioner 140 is divided into a number of intensity apportioning modules that operate in parallel. Each intensity apportioning module is similar to intensity apportioner 140. The detection event records IER generated by time of flight calculator 130 are assigned to the intensity apportioning modules more or less equally. The intensity accumulations generated by the intensity apportioning modules are summed and the results are stored in spectrum memory 150, which is common to all the intensity apportioning modules.

One concern with parallel processing implementations is read and write conflicts and memory bandwidth in spectrum memory 150. Although such conflicts are typically rare because the time-of-flight spectrum is typically sparse, they should nevertheless be avoided. Spectrum memory 150 can be implemented using multiport memory that allows the intensity apportioning modules to read the spectrum memory simultaneously. However, lockouts are needed to prevent two or more intensity apportioning modules from simultaneously attempting to modify the intensity accumulation stored in a given TOF bin of the spectrum memory. In an implementation of such lockouts, each allowed TOF would have an in-use indicator and an intensity apportioning module would check the state of the respective in-use indicators of all the allowed TOFs linked to the detection event before performing an operation that would modify the contents of a TOF bin addressed by any one of the allowed TOFs. In the event that the in-use indicators of none of the allowed TOFs were set, the intensity apportioning module would then set the in-use indicators of all the allowed TOFs linked to the detection event before performing such modifying operation, and would release the in-use indicators once it had completed the operation. Any intensity apportioning module that found an allowed TOF with a set in-use indicator would have to wait until the in-use indicator was released. Rather than waiting, the intensity apportioning module could process another detection event whose allowed TOFs were available for processing before returning to process the detection event having one or more allowed TOFs that were in use. The need to check the status of the in-use indicators of the allowed TOFs, the need to set and release such in-use indicators, and the need to wait or process other detection events decrease the processing time reduction provided by parallel processing. One way to avoid the spectrum memory lockout issue is not to write the revised intensity apportionments to the spectrum memory until each above-described iteration of the revised probability determining and intensity reapportioning processes has been completed.

Figure 18:
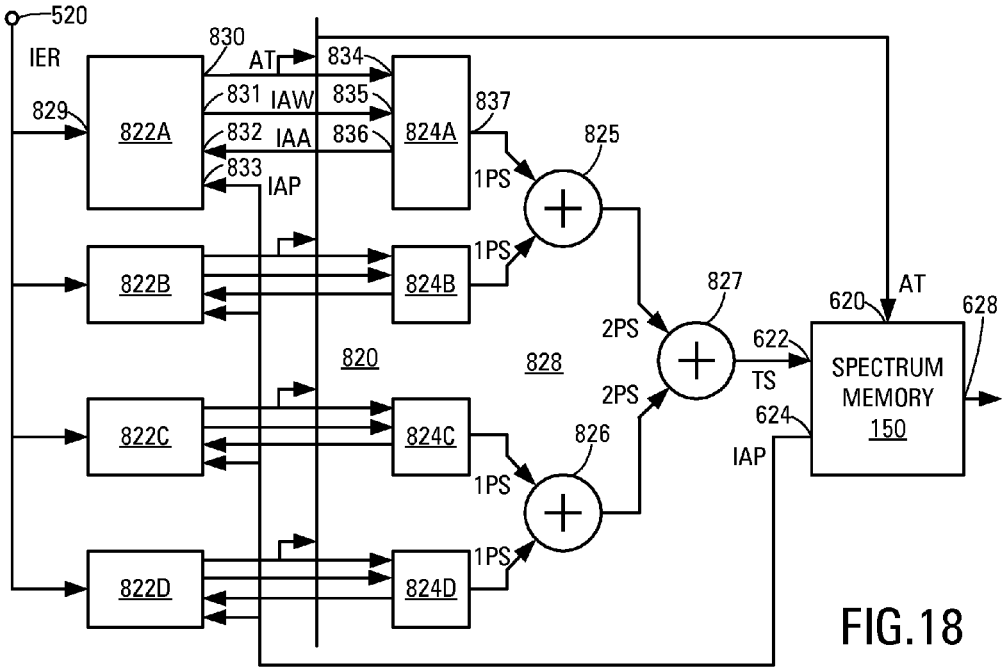
FIG. 18 is a block diagram showing an example of the intensity apportioner of the mass spectrometer shown in FIG. 1 implemented using multiple intensity apportioning modules.

FIG. 18 is a block diagram showing a simplified example 820 of an implementation of intensity apportioner 140 that has multiple intensity apportioning modules and that does not employ in-use indicators. Intensity apportioner 820 is composed of intensity apportioning modules 822A-822D, partial spectrum caches 824A-824D and a summing system 828. Intensity apportioner 820 is shown connected to spectrum memory 150. In the example shown, summing system 828 is composed of summing circuits 825, 826 and 827. The numbers of intensity apportioning modules, partial spectrum caches and summing circuits may differ from those shown. The vertical extent of the blocks representing intensity apportioning module 822A and partial spectrum cache 824A is increased to allow the inputs and outputs of these modules to be labelled. Spectrum memory 150 is implemented using multiport memory so that intensity apportioning modules 822A-822D can all read probability intensity accumulations IAP from it. Probability intensity accumulations are intensity accumulations read from spectrum memory 150 that are used by intensity apportioning modules 822A-822D only to determine revised probabilities.

Intensity apportioning module 822A will now be described. The remaining intensity apportioning modules are similar and will not be described. As will be described in greater detail below, intensity apportioning module 822A generates revised intensity apportionments NIP using probability intensity accumulations IAP read from spectrum memory 150 and generates revised accumulation intensity accumulations IAW using accumulation intensity accumulations IAA. Accumulation intensity accumulations IAA are intensity accumulations read from partial spectrum cache 824A that intensity apportioning module 822A subjects to accumulation operations. Intensity apportioning module 822A is substantially similar in structure and operation to intensity apportioner 500 described above with reference to FIG. 11. Intensity apportioning module 822A differs from intensity apportioner 500 in that the detection event memory of intensity apportioning module 822A is about 1/P the size of that of detection event memory 502 (FIG. 11), where P is the number of intensity apportioning modules, and the accumulator of intensity apportioning module 822A differs from accumulator 740 described above with reference to FIG. 14 in ways that will be described below with reference to FIG. 19.

Intensity apportioning module 822A has inputs and outputs similar to those of above-described intensity apportioner 500. To simplify FIG. 18, only an event record input 829, a memory address output 830, a write output 831 and a read input 832 are shown. Intensity apportioning module 822A additionally has a probability read input 833. To avoid confusion between the read inputs, read input 832 will be called accumulation read input 832 in this description.

Figure 19:
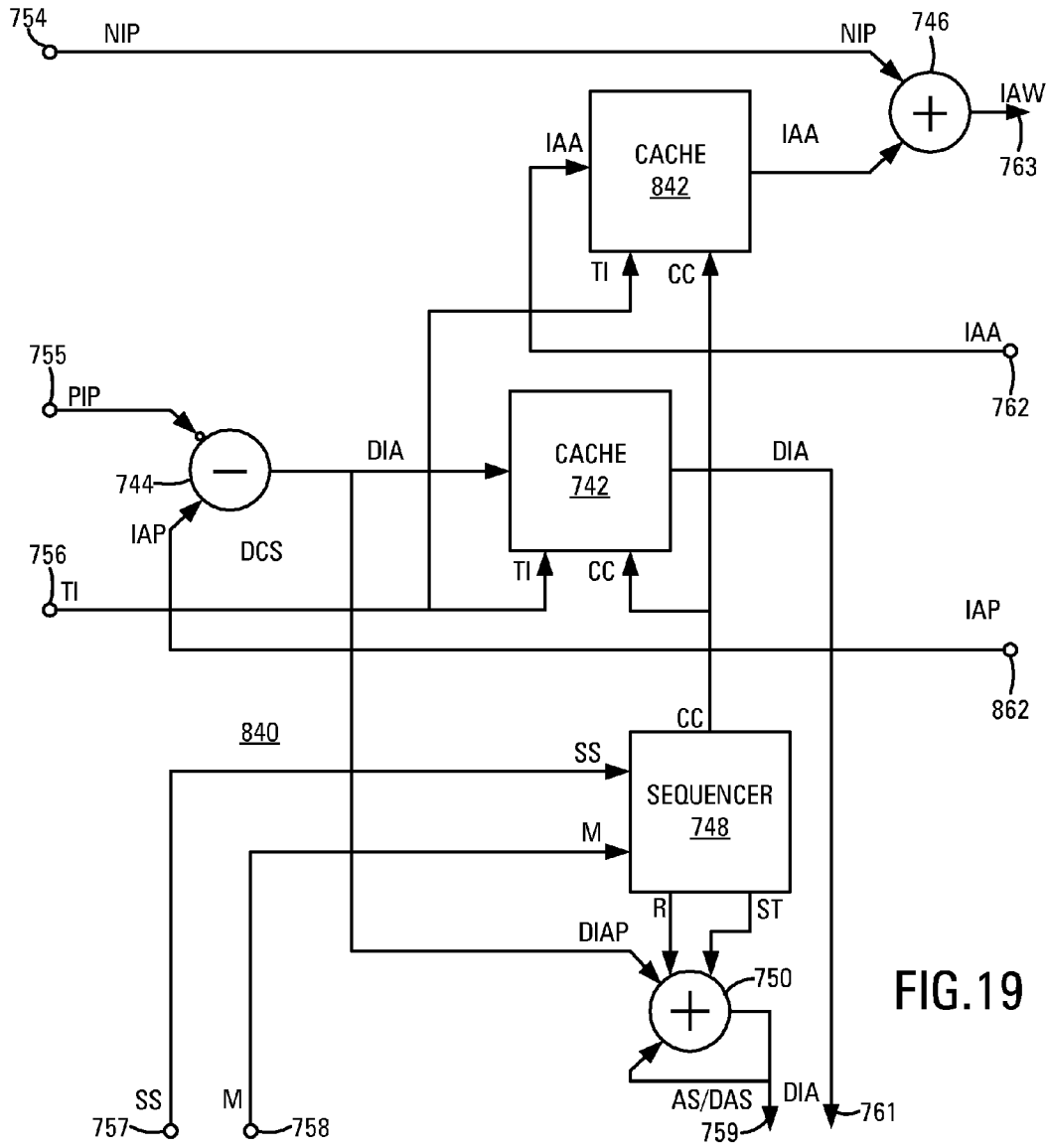
FIG. 19 is a block diagram showing a simplified example of an accumulator suitable for use in the intensity apportioning modules shown in FIGS. 18 and 20.

FIG. 19 is a block diagram showing an example 840 of an accumulator suitable for use in intensity apportioning module 822A. Accumulator 840 is based on accumulator 508 described above with reference to FIG. 11 and the example 740 of accumulator 508 described above with reference to FIG. 14. Elements of accumulator 840 that correspond to elements of accumulator 740 are indicated using the same reference numerals and will not be described in detail again. Accumulator 840 generates probability depleted intensity accumulations DIAP for use in determining revised probabilities from probability intensity accumulations IAP read from spectrum memory 150 and performs reapportionments by accumulating the new intensity apportionments generated using the revised probabilities. Each new intensity apportionment is accumulated by summing the new intensity apportionment and a respective accumulation intensity accumulation IAA read out from partial spectrum cache 824A to generate a revised intensity accumulation that is then written back to the same TOF bin in the partial spectral cache.

Accumulator 840 is composed of cache 742, differencing circuit 744, summing circuit 746, sequencer 748 and accumulating circuit 750 described above with reference to FIG. 14. Multiplexer 752 (FIG. 14) is omitted. Accumulator 840 is additionally composed of a cache 842, and additionally has a probability read input 862.

Differencing circuit 744 has an inverting input, a non-inverting input and an output. The inverting input is connected to receive via previous intensity apportionment input 755 the previous intensity apportionment PIP for each allowed TOF linked to each detection event. The non-inverting input is connected to receive via probability read input 862 the probability intensity accumulation IAP read from the TOF bin in spectrum memory 150 addressed by the allowed TOF. The output is connected to provide a depleted intensity accumulation DIA to the accumulation input of cache 742 and to the first input of accumulating circuit 750.

Cache 842 is identical to cache 742 and has an accumulation input, an output, an address input and a control input. The accumulation input is connected to accumulation read input 762 to receive the accumulation intensity accumulations IAA read out from the respective TOF bins in partial spectrum cache 824A addressed by the allowed TOFs linked to the detection event. The address input is connected to receive TOF index TI from TOF index input 756. TOF index TI defines the respective storage location in cache 842 to which an accumulation intensity accumulation IAA received at the accumulation input is written or from which an accumulation intensity accumulation IAA is read. The control input is connected to receive cache control signal CC from the cache control output of sequencer 748. The output is connected to provide each accumulation intensity accumulation IAA read from cache 842 to the second input of summing circuit 746.

Referring once again to FIG. 18, the event record input 829 of intensity apportioning module 822A is connected to receive a share of the initial event records IER from event record input 520. Event records IER are distributed substantially equally among the intensity apportioning modules 822A-822D. Possible distribution methods include changing the destination intensity apportioning module at uniformly-spaced times during the measurement run. In such an implementation, event records for consecutive detection events are located in consecutive storage locations in the respective detection event memories of the intensity apportioning modules. In this implementation, memory conflicts are minimized by reading the event records from each detection event memory in a random order instead of a sequential order. Other distribution methods include assigning the event records to the intensity apportioning modules randomly with each intensity apportioning module having a 1/P chance of receiving the next event record, and distributing consecutive event records among the intensity apportioning modules using a round-robin distribution scheme. In such implementations, event records for consecutive detection events are not located in consecutive storage locations in the respective detection event memories of the intensity apportioning modules. Operating speed is optimized by reading the event records from each detection event memory in sequential order.

Each partial spectrum cache 824A-824D is similar in structure, size and operation to spectrum memory 150 described above with reference to FIG. 1 and in greater detail with reference to FIG. 12. Partial spectrum cache 824A will now be described. The remaining partial spectrum caches are similar and will not be described. Partial spectrum cache 824A has inputs and outputs similar to those of above-described spectrum memory 150. To simplify FIG. 18, only an address input 834, a write input 835 and a read output 836 and a spectrum output 837 are shown. To avoid confusion between read output 836 and the read output of spectrum memory 150, read output 836 will be called accumulation read output 836 in this description. Address input 834 is connected to receive each allowed TOF AT from the memory address output 830 of intensity apportioning module 822A. Write input 835 is connected to the write output 831 of intensity apportioning module 822A to receive therefrom revised accumulation intensity accumulations IAW for writing to partial spectrum cache 824A. Accumulation read output 836 is connected to accumulation read input 832 of intensity apportioning module 822A to provide accumulation intensity accumulations IAA read out from partial spectrum cache 824A thereto for use in accumulation operations.

Summing system 828 is composed of summing circuits 825, 826 and 827. When the intensities of all the detection events represented by detection signal DS have been initially apportioned or reapportioned, summing system 828 receives a respective partial time-of-flight spectrum 1PS, referred to herein as a 1/P partial spectrum, from each partial spectrum cache 824A-824D and sums the partial spectra to generate a full time of flight spectrum TS that is output to spectrum memory 150. Summing circuits 825, 826 and 827 each have two inputs and an output. The inputs of summing circuit 825 are connected to the respective spectrum outputs of partial spectrum caches 824A and 824B from which each receives a respective 1/P partial time-of-flight spectrum 1PS. The spectrum output of intensity apportioning module 824A is shown at 837. The inputs of summing circuit 826 are connected to the respective spectrum outputs (corresponding to spectrum output 837 of intensity apportioning module 824A) of intensity apportioning modules 824C and 824D from which each receives a respective 1/P partial spectrum 1PS. The inputs of summing circuit 827 are connected to the respective outputs of summing circuits 825 and 826 from which each receives a respective partial time-of-flight spectrum 2PS, referred to herein as a 2/P partial spectrum.

Spectrum memory 150 has inputs and outputs similar to those of the example of spectrum memory 150 described above with reference to FIG. 10. To simplify FIG. 18, only address input 620, write input 622, read output 624 and spectrum output 628 are shown. To avoid confusion between read output 624 and the accumulation read output 836 of partial spectrum cache 824A, read output 624 will be called probability read output 624 in this description. Address input 620 is connected by a suitable bus structure to receive the allowed times of flight AT output by the memory address outputs of all of the intensity apportioning modules 822A-822D, including those output by the memory address output 830 of intensity apportioning module 822A. Other addressing schemes mapped to the allowed TOFs may alternatively be used, as described above. Write input 622 is connected to the output of summing circuit 827 from which it receives a full time-of-flight spectrum TS.

Probability read output 624 is connected to provide the probability intensity accumulations IAP read out from spectrum memory 150 to the probability read inputs of all of the intensity apportioning modules 822A-822D, including the probability read input 833 of intensity apportioning module 822A.

Each partial time-of-flight spectrum output by partial spectrum caches 824A-824D, respectively, is referred to herein as a 1/P partial spectrum since it is generated from approximately 1/P of the detection events represented by detection signal DS. Similarly, each partial time-of-flight spectrum output by summing circuits 825, 826, respectively, is referred to herein as a 2/P partial spectrum since it is generated from approximately 2/P of the detection events represented by detection signal DS. Full time-of-flight spectrum TS output by summing circuit 827 is full in the sense that it is generated from all of the detection events represented by detection signal DS. However, full time-of-flight spectrum TS is composed of no more intensity accumulations than the above-mentioned 1/P and 2/P partial spectra.

As noted above, the event records IER generated by time of flight calculator 130 during the measurement run are distributed substantially equally among intensity apportioning modules 822A-822D during the measurement run and are stored in the respective detection event memory (not shown) of each intensity apportioning module. In the initial intensity apportioning and apportionment accumulating processes described above with reference to blocks 208 and 210 of FIG. 3, intensity apportioning module 822A operates to determine apportionments of the intensities of the detection events whose respective event records are stored therein among the allowed TOFs linked thereto, to accumulate the apportionments of the intensities to each of the allowed times of flight to generate respective accumulation intensity accumulations, and to store the accumulation intensity accumulations in respective TOF bins of partial spectrum cache 824A. For example, for each detection event whose respective event record is stored in the detection event memory of intensity apportioning module 822A, intensity apportioning module 822A receives the accumulation intensity accumulations IAA read out from the respective TOF bins in partial spectrum cache 824A addressed by the allowed TOFs linked to the detection event, sums each accumulation intensity accumulation IAA and a respective initial intensity apportionment NIP and outputs the resulting new accumulation intensity accumulation IAW to partial spectrum cache 824A for writing therein in the TOF bin addressed by the respective allowed TOF. The operations just described, when performed for all the detection events whose respective event records are stored in intensity apportioning module 822A generate a respective partial spectrum 1PS that is stored in partial spectrum cache 824A. The remaining intensity apportioning modules 822B-822D operate similarly to and concurrently with intensity apportioning module 822A with respect to the event records distributed to them to generate respective 1/P partial spectra 1PS that are stored in partial spectrum caches 824B-824D, respectively.

Once intensity apportioning modules 822A-822D have collectively subjected the intensities of all the detection events represented by detection signal DS to initial intensity apportioning, partial spectrum caches 824A, 824B output the respective 1/P partial spectra 1PS stored therein to summing circuit 825 and summing circuit 825 sums the 1/P partial spectra to generate a respective 2/P partial spectrum 2PS. Similarly, partial spectrum caches 824C, 824D output the respective 1/P partial spectra stored therein to summing circuit 826 and summing circuit 826 sums the 1/P partial spectra to generate a respective 2/P partial spectrum 2PS. Summing circuit 827 then sums the respective 2/P partial spectra generated by summing circuits 825, 826 to generate full time-of-flight spectrum TS. Summing circuit 827 outputs full time-of-flight spectrum TS to spectrum memory 150, which stores the full time-of-flight spectrum. Since the operations performed by partial spectrum caches 824A-824D and spectrum memory 150 in generating full time-of-flight spectrum TS from partial spectra 1PS and 2PS involve sequentially reading, summing and writing large blocks of accumulation intensity accumulations, these operations can be performed much more quickly than the random read and write operations performed by partial spectrum caches 824A-824D. Moreover, each of the partial spectrum caches 824A-824D is written to only by its respective intensity apportioning module 822A-822D and spectrum memory 150 is only written to by summing circuit 827. Consequently, write conflicts are avoided without the need for in-use indicators. Once full time-of-flight spectrum TS has been stored in spectrum memory 150, partial spectrum caches 824A-824D are cleared, e.g., a value of zero is written to each TOF bin in each of the partial spectrum caches.

Operation of intensity apportioning module 822A and respective partial spectrum cache 824A to perform the revised probability determining and intensity reapportioning processes described above with reference to block 212 and block 214, respectively, of FIG. 3 will now be described. The remaining intensity apportioning modules 822B-822D and partial spectrum caches 824B-824D operate similarly with respect to the event records distributed to them. Intensity apportioning module 822A operates to generate revised probabilities for use in re-apportioning the intensities of the detection events whose respective event records are stored therein among the TOF bins of partial spectrum cache 824A. For each detection event, intensity apportioning module 822A outputs at memory address output 830 the allowed times of flight AT linked to the detection event. Each allowed time of flight addresses a respective TOF bin in spectrum memory 150. Each allowed time of flight additionally addresses a respective TOF bin in partial spectrum cache 822A. In response to the allowed times of flight AT linked to the detection event, intensity apportioning module 822A receives at probability read input 833 the probability intensity accumulations IAP read out from the TOF bins in spectrum memory 150 addressed by the allowed TOFs, and additionally receives at accumulation read input 832 the accumulation intensity accumulations IAA read out from the TOF bins in partial spectrum cache 824A addressed by the allowed TOFs. The respective first accumulation intensity accumulation IAA read out from each TOF bin of partial spectrum cache 824A during each revised probability determining and intensity reapportioning iteration has a value of zero as a result of the partial spectrum caches being reset before the beginning of each iteration.

In the following description, the elements of accumulator 840 described above with reference to FIG. 19 that perform the operations are set forth in parentheses. Intensity apportioning module 822A operates in a manner similar to that described above with reference to FIG. 9A to generate and cache a respective depleted intensity accumulation DIA for each allowed TOF linked to the detection event using the probability intensity accumulations IAP received from spectrum memory 150 (differencing circuit 744) and to generate depleted accumulation sum DAS for the detection event by summing the depleted intensity accumulations DIA (accumulating circuit 750) linked to the detection event. The depleted intensity accumulations are cached in cache 742. Additionally, in parallel, as intensity apportioning module 822A receives each probability intensity accumulation at probability read input 833 from spectrum memory 150, intensity apportioning module 822A additionally receives an accumulation intensity accumulation IAA at accumulation read input 832 from the corresponding TOF bin of partial spectrum cache 824A. Intensity apportioning module 822A caches each accumulation intensity accumulation in cache 842.

Once it has received probability intensity accumulations IAP and accumulation intensity accumulations IAA for all the allowed times of flight linked to the detection event, intensity apportioning module 822A operates in a manner similar to that described above with reference to block 360 of FIG. 9B to generate a revised probability for the first allowed TOF linked to the detection event from depleted accumulation sum DAS and the respective cached depleted intensity accumulation DIA. Further, intensity apportioning module 822A operates is a manner similar to that described above with reference to blocks 362, 364 of FIG. 9B to generate and to save a revised intensity apportionment NIP for the each allowed TOF AT linked to the detection event (apportioner 506, detection event memory 502). Finally, intensity apportioning module 822A operates in a manner similar to that described above with reference to block 366 of FIG. 9B to sum (summing circuit 746) the revised intensity apportionment and the respective accumulation intensity accumulation IAA (read from cache 842) to generate a revised intensity accumulation IAW. The revised intensity accumulation is output to write output 763 for writing to the TOF bin in partial spectrum cache 824A addressed by the allowed TOF. Intensity apportioning module 822A then performs the operations just described for the remaining allowed times of flight AT linked to the detection event.

The operations just described, when performed for all the event records stored in intensity apportioning module 822A, generate a respective revised partial spectrum 1PS in partial spectrum cache 824A. The remaining intensity apportioning modules 822B-822D operate similarly to and concurrently with intensity apportioning module 822A with respect to the event records distributed to them to generate respective revised partial spectra 1PS in partial spectrum caches 824B-824D, respectively.

Once intensity apportioning modules 822A-822D have performed revised probability determining and intensity reapportioning processes for all the detection events represented by detection signal DS, partial spectrum caches 824A-824D output the respective revised 1/P partial spectra 1PS stored therein to summing circuits 825-827 for summing and the resulting revised full time-of-flight spectrum TS is stored in spectrum memory 150. Revised full time-of-flight spectrum TS overwrites the previous time-of-flight spectrum stored in spectrum memory 150. Partial spectrum caches 824A-824D are once again cleared, as described above.

Intensity apportioning modules 822A-822D then perform iterations of the revised probability determining process and the intensity reapportioning process for all the detection events as just described until the above-described termination condition is met. At the end of each iteration, the partial spectra 1PS stored in partial spectrum caches 824A-824D are summed to generate a revised full time-of-flight spectrum TS, the revised full time-of-flight spectrum TS is stored in spectrum memory 150 and the partial spectrum caches are cleared. The iteration repeats as described above until the termination condition is met.

Figure 20:
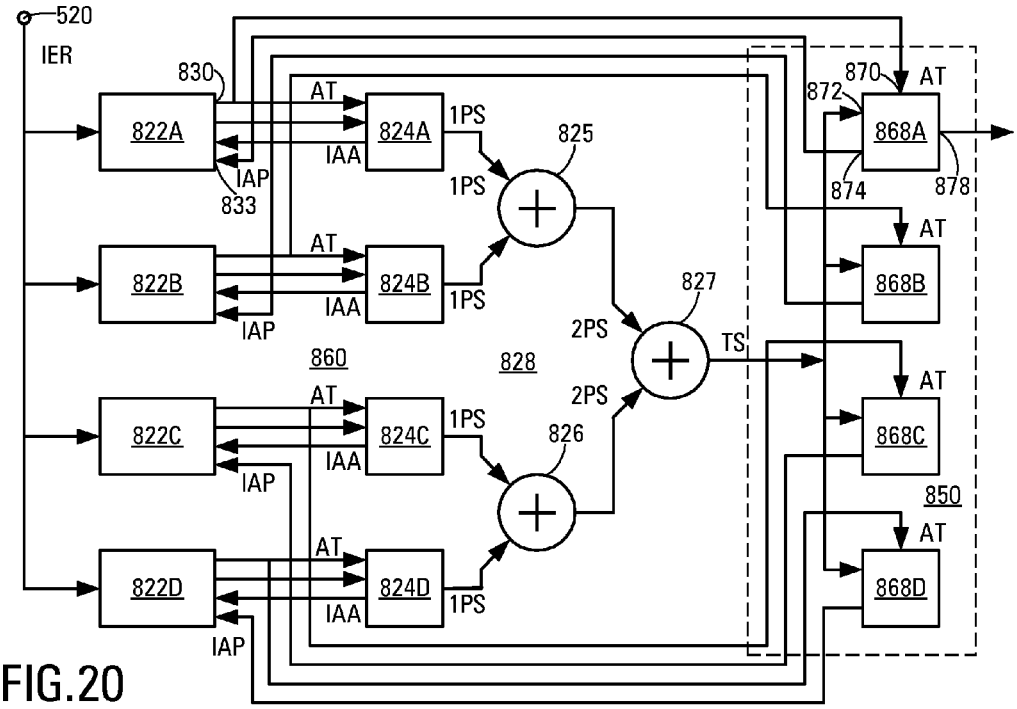
FIG. 20 is a block diagram showing another example of the intensity apportioner of the mass spectrometer shown in FIG. 1 implemented using multiple intensity apportioning modules.

FIG. 20 is a block diagram showing a simplified example 860 of another implementation of intensity apportioner 140 that has multiple intensity apportioning modules and that uses conventional single-port memory in which read conflicts and write conflicts are avoided without using in-use indicators. Elements of intensity apportioner 860 that correspond to elements of intensity apportioner 820 described above with reference to FIG. 18 are indicated using the same reference numerals and will not be described again.

In intensity apportioner 860, a spectrum memory 850 is composed of P spectrum memory modules 868A-868D, where P is the number of intensity apportioning modules 822A-822D. Spectrum memory module 868A will now be described. Except as noted below, the remaining spectrum memory modules 868B-868D are similar and will therefore not be described. Spectrum memory module 868A is similar in structure and operation to spectrum memory 150 described above with reference to FIG. 1 and in greater detail with reference to FIG. 12. Spectrum memory module 868A has inputs and outputs similar to those of above-described spectrum memory 150. To simplify FIG. 20, only an address input 870, a write input 872, a read output 874 and a spectrum output 878 are shown. To avoid confusion between read output 874 and accumulation read output 836 of partial spectrum cache 824A, read output 874 will be called probability read output 874 in this description. Spectrum memory modules 868B-868D do not have respective spectrum outputs.

Address input 870 is connected to receive allowed times of flight AT from the address output 830 of intensity apportioning module 822A. The respective address inputs of spectrum memory modules 868B-868D are connected to the address outputs of intensity apportioning modules 822B-822D, respectively. Write input 872 is connected to the output of summing circuit 827 from which it receives full time-of-flight spectrum TS, described above. The respective write inputs 872 of spectrum memory modules 868B-868D are also connected to the output of summing circuit 827. Thus, each of the spectrum memory modules 868A-868D receives a respective copy of full time-of-flight spectrum TS, described above, output by summing circuit 827. Probability read output 874 is connected to provide probability intensity accumulations IAP read out from spectrum memory module 868A to the probability read input 833 of intensity apportioning module 822A. The respective probability read outputs of spectrum memory modules 868B-868D are connected to provide probability intensity accumulations IAP read out from spectrum memory modules 868B-868D, respectively, to the probability read inputs of intensity apportioning modules 822B-822D, respectively. Providing each intensity apportioning module 822A-822D with its own copy of full time-of-flight spectrum TS stored in spectrum memory modules 868A-868D, respectively, reduces the bandwidth demands on spectrum memory modules 868A-868D compared with spectrum memory 150 in FIG. 18 since each spectrum memory module is read from by only one of intensity apportioning modules 822B-822D instead of by all of the intensity apportioning modules.

Intensity apportioner 860 operates similarly to intensity apportioner 820 described above with reference to FIG. 18 except that each intensity apportioning module 822A-822D reads probability intensity accumulations IAP from its respective copy of full time-of-flight spectrum TS stored in spectrum memory module 868A-868D, respectively. Since each intensity apportioning module 822A-822D reads exclusively from its respective one of the spectrum memory modules 868A-868D, the spectrum memory modules are not subject to read or write conflicts even though they are implemented without using multiport memory.

The time-of-flight spectra generated by intensity apportioner 820 and intensity apportioner 860 described above with respect to FIGS. 18 and 20 require more iterations of the revised probability determining and intensity reapportioning processes to reach a defined termination condition than intensity apportioner 500 described above with reference to FIG. 11. This is because intensity apportioner 500 uses the revised intensity accumulations generated using the revised probabilities immediately, whereas intensity apportioners 820 and 860 do not use revised probability intensity accumulations until after revised accumulation intensity accumulations have been generated for all the detection events. However, a relatively small number greater than unity of intensity apportioning modules will reach the termination condition more quickly than a single intensity apportioner notwithstanding the slower convergence on the termination condition.

In addition to or instead of the intensity apportioners operating in parallel, the operational speed of mass spectrometer 100 can be increased by using parallel circuitry within each intensity apportioner. Parallel circuitry allows operations that are described above as being performed sequentially to be performed more or less simultaneously. In an example in which detection event memory 502 is configured to output all of the contents of a single event record at once, apportioner 506 is configured with multiple instances of multiplier 792; accumulator 508 is configured with a multi-channel instance of cache 742, multiple instances of differencing circuit 744, multiple instances of summing circuit 746, and a multi-input implementation of accumulating circuit 750; and probability calculator 510 is configured with multiple instances of first divider 772, multiple instances of second divider 774, and multiple instances of multiplexer 776 and multiple instances of comparator 778. When the number of instances of the circuit elements is equal to or greater than the maximum allowed TOF count TC, such an embodiment of intensity apportioner 140 can concurrently perform depletion operations for all the allowed times of flight linked to the detection event. Similarly, the revised probability determining operations, the revised intensity apportioning and the apportionment accumulating operations for all the allowed times of flight linked to the detection event can each be performed concurrently. Moreover, the intensity accumulations for the next detection event can be read from spectrum memory 150 and can be cached in a parallel-output cache within intensity apportioner 140 before the revised intensity accumulations for the current detection event are written to the spectrum memory. This ensures that the revised probability determining and intensity reapportioning processes performed on the next detection event do not have to wait while the intensity accumulations they need are read from spectrum memory 150. Similarly, as the revised intensity accumulations for the current detection event are generated, they can be cached in a parallel input cache and can be written to spectrum memory 150 while the revised probability determining and intensity reapportioning processes are performed for the next detection event.

Another way to reduce the time required to generate the time-of-flight spectrum or to reduce the speed at which intensity apportioner 140 has to operate to generate the time-of-flight spectrum in a specified time is to reduce the number of iterations of the revised probability determining and intensity reapportioning processes described above with reference to blocks 212 and 214 of FIG. 3 that have to be performed to read the termination condition. One way to reduce the number of iterations is to amplify the changes in the probabilities, or the changes in the intensity apportionments, between consecutive iterations. In an example, additional operations are performed between blocks 362 and 364 described above with reference to FIG. 9B. In the additional operations, the previous intensity apportionment read in block 346 of FIG. 9A is subtracted from the revised intensity apportionment generated in block 362 to generate an intensity apportionment difference. The intensity apportionment difference is then multiplied by an amplification factor typically greater than unity, and the resulting amplified difference is added to the previous intensity apportionment to generate an amplified revised intensity apportionment that is saved in block 364 and summed in block 366 instead of the revised intensity apportionment. This changes the apportionment of the intensity of the detection event to each allowed TOF linked to the detection event proportionally to an amplified change between one iteration and the next in the revised probability linked to the allowed TOF. In mass spectrometer 100, a subtraction circuit, a multiplier and a summing circuit can be interposed between new intensity apportionment input 754 and the new intensity apportionment input of summing circuit 746 of accumulator 740 (FIG. 14) to implement this example of probability change amplification.

In an embodiment in which previous probabilities are saved instead of previous intensity apportionments, the previous probability read in block 346 of FIG. 9A is subtracted from the revised probability generated in block 362 to generate a probability difference. The probability difference is then multiplied by an amplification factor greater than unity, the resulting amplified probability difference is multiplied by the intensity linked to the detection event to generate an amplified intensity difference, and the amplified intensity difference is added to the previous intensity apportionment to generate an amplified revised intensity apportionment that is saved in block 364 and summed in block 366 instead of the revised intensity apportionment. Mass spectrometer 100 can be modified to implement this example of probability change amplification.

To ensure that the revised probability determining and intensity reapportioning processes converge gracefully on the termination condition, an upper limit equal to intensity I of the detection event and a lower limit of zero should be imposed on the revised intensity apportionment before it is used in blocks 364 and 366. In an embodiment in which previous probabilities are saved instead of previous intensity apportionments, and the difference between the revised probability and the previous probability is multiplied by the amplification factor and the result is added to the previous probability to generate an amplified revised probability, the upper and lower limits imposed on the amplified revised probability are unity and zero.

The larger the amplification factor, the fewer the iterations of the revised probability determining and intensity reapportioning processes that are needed to converge on the termination condition but the greater the risk that the revised probability determining and intensity reapportioning processes will become unstable. The unamplified revised probability determining and intensity reapportioning processes described above with reference to FIG. 9 are a special case of the amplified revised probability determining and intensity reapportioning processes just described in which the amplification factor is equal to unity, and the respective apportionment of the intensity of the detection event among the allowed TOFs linked to the detection event is changed proportionally to respective changes between one iteration and the next in the respective probabilities linked to the allowed TOFs.

In FIG. 2 and in the description of mass spectrometer 100 set forth above, each detection event is regarded as a momentary event having a duration no longer than one period of clock signal CS generated by clock 160, i.e., the sampling period of ion detector 120. More typically, for each detection event, the intensity of detection signal DS remains greater than a threshold intensity for several consecutive sampling periods of ion detector 120 before it falls below the threshold intensity. In this case, the set of consecutive samples whose intensity exceeds the threshold intensity can be regarded as constituting a single detection event. When a set of consecutive samples, each of which has a respective intensity greater than the threshold, is regarded as constituting a detection event, there is no longer a one-to-one relationship between a detection event and a single allowed time of flight corresponding to each transition time. In an example, the detection events have durations of about seven periods of clock signal CS. In such example, a detection event caused by the incidence of ions of a single ion species on ion detector 120 has about seven allowed times of flight for each transition time. The allowed times of flight are consecutive, i.e., adjacent ones of them differ by one period of clock signal CS. Other ways of defining a multi-sample detection event exist and can be used.

Ways of adapting the above-described processing of detection signal DS generated by ion detector 120 to deal with multi-sample detection events will now be described. A first way is to regard every sample of detection signal DS whose intensity I is greater than the threshold intensity as a separate detection event and to apply the above-described processing to such detection event. This approach will be referred to as a one sample, one detection event approach. In the example described above, the seven consecutive samples whose intensities I are greater than the threshold intensity would be treated as seven respective detection events. The process of initially apportioning the consecutive samples in the sets among the allowed times of flight would result in the samples being apportioned to blocks of seven consecutive allowed times of flight, the different blocks corresponding to respective transient times. The revised probability determining and intensity reapportioning processes would increase the apportionments to the block of real times of flight at the expense of the apportionments to the blocks of alias times of flight. Then, when the time-of-flight spectrum generated by the above-described revised probability determining and intensity reapportioning processes is processed to generate a respective mass spectrum, the intensity accumulations linked to the allowed TOFs in each block of consecutive allowed TOFs are processed to determine the respective mass they represent. Processes for making such determinations when conventional time-of-flight spectra are converted to respective mass spectra are known in the art and may be used.

Compared with treating a multi-sample detection event as a single detection event, the one sample, one detection event approach just described multiplies the number of detection events by the average number of samples with respective intensities greater than the threshold intensity resulting from the incidence of ions of a given ion species on the ion detector. The processing resources required to process a given detection event are proportional to the number of samples constituting the detection event plus a small overhead. Hence the processing resources needed to transform detection signal DS in accordance with the one sample, one detection event approach would not increase dramatically over those needed to process the samples constituting each detection event as a respective single detection event. The one sample, one detection event approach also has the advantage that there is no need to separate overlapped detection events. However, by treating each sample whose intensity is greater than a threshold intensity as a respective independent detection event instead of as a member of a set of samples representing the same detection event, the one sample, one detection event approach gives rise to an intrinsic information loss. Each block of consecutive allowed TOFs to which are linked the intensity accumulations relating to the same multi-sample detection event contains statistical information about the abundance of the ions of a given ion species that the one-sample, one detection event approach does not make use of to determine the revised probabilities during the above-described revised probability determining and intensity reapportioning processes.

A process that recognizes the statistical information carried by multi-sample detection events involves performing the revised probability determining process using the respective intensity accumulations linked to the block of consecutive allowed TOFs that includes an allowed TOF linked to an intensity accumulation that represents a peak in the time-of-flight spectrum. Such block of consecutive allowed TOFs will be referred to herein as an allowed TOF block. In an example, the detection event has a duration equal to seven periods of clock signal CS, and detection event memory 502 contains a respective event record that includes the respective intensities of seven consecutive samples of detection signal DS. The samples are numbered 1-7 with sample 4 having the peak intensity. The nominal detection event would be associated with sample 4, but the processing to which the multi-sample detection event is subject encompasses the set of samples that extends from three samples before to three samples after the peak sample. In practice, the detection event is typically associated with the first sample constituting the detection event and the duration of the detection event defines the last sample associated with the detection event. The intensities of the samples in the set of samples are apportioned among allowed TOF blocks linked to the detection event. Each allowed TOF block is composed of consecutive allowed TOFs equal in number to the samples in the set. The allowed TOFs in only one of the allowed TOF blocks are real allowed TOFs: the allowed TOFs in the remaining allowed TOF blocks are alias allowed TOFs.

A number of M consecutive samples constituting a detection event will be referred to herein as a sample set. Each sample set has a number of allowed TOFs linked to it, one corresponding to each transient within the allowed time of flight range (FIG. 2) of the detection event. Such allowed times of flight be referred to as block times of flight, abbreviated as block TOFs. Each block TOF is a respective allowed TOF linked to what will be referred to as a reference sample in the sample set and will be used to identify the respective allowed TOF block of which the allowed TOF is a member. Typically, the reference sample is the first (earliest) sample in the set of samples. Alternatively, the reference sample is a sample in the sample set other than the first sample. Each block TOF is akin to the allowed TOF described above but, whereas each allowed TOF is the time of flight pertaining to a single sample, a block TOF is one allowed time of flight in a respective block of consecutive allowed TOFs, namely, that of the reference sample.

The number M of consecutive allowed TOFs in each of the allowed TOF blocks linked to the detection event is equal to the number M of samples in the sample set constituting the detection event. Because of this 1:1 correspondence between samples in the sample set and allowed times of flight in the allowed TOF blocks, the term block size will be used to describe both the number M of consecutive allowed TOFs in the allowed TOF blocks and the number M of samples in the sample set.

In an example in which the reference sample is the first sample in the sample set of M samples constituting the detection event, the remaining M−1 samples in the sample set have allowed times of flight greater than the block TOF by increments corresponding to 1 through M−1, respectively, clock periods of clock signal CS (FIG. 1). A sample index m is used together with the block TOF to generate the allowed times of flight to which the respective intensities of the remaining samples in the set are apportioned. A TOF block index a will be used to track the allowed TOF blocks linked to each detection event.

In mass spectrometer 100, whereas each allowed TOF addresses a single TOF bin in spectrum memory 150, a block TOF addresses a block of M TOF bins in the spectrum memory. Typically, the block of M TOF bins is a block of M consecutive TOF bins, but other arrangements of TOF bins are possible and may be used. In an example in which the reference sample is the earliest sample in the sample set and a reference TOF bin is the first TOF bin of a block of M consecutive TOF bins addressed by the block TOF, the address of the respective TOF bin that corresponds to each of the allowed TOFs in the allowed TOF block is calculated by combining the block TOF that provides addresses the reference TOF bin of the block and above-described sample index m that represents the offset between the TOF bin being addressed and the reference TOF bin of the block. Sample index m denotes the position of the respective sample within the set of samples and also the position of the TOF bin within the block of TOF bins.

In the allowed times of flight determining process described above with reference to block 206 of FIG. 3, each set of consecutive samples in detection signal DS having an intensity greater than a threshold intensity is identified as a respective multi-sample detection event. Other multi-sample detection event detection techniques are known and may be used. Then, for each multi-sample detection event, the allowed times of flight determining process counts the number of samples constituting the detection event to provide a block size M, extracts the intensities $I_1$-$I_M$ of the samples determined to constitute the detection event, determines a respective block TOF for each transient time in the allowed time of flight range (FIG. 2), and counts the number of block TOFs linked to the detection event to provide a block count KC. In an example, each block TOF is a respective allowed time of flight between a respective transient time and the event time of a defined one (e.g., the first) of the samples in the sample set. The allowed times of flight used as the block TOFs are determined in a manner similar to that described above with reference to FIG. 4. In an example, the allowed times of flight determining process generates an event record similar or equivalent to that described below with reference to FIG. 21 for each multi-sample detection event.

In the initial intensity apportioning and apportionment accumulating processes described above with reference to blocks 208 and 210 of FIG. 3, the intensities of the samples in the block of samples are apportioned among the allowed TOF blocks using initial probabilities. In the one sample, one detection event processing examples described above, the intensity of each sample is apportioned among the allowed TOFs linked to the detection event using a respective initial probability for each allowed TOF. In the example of processing a multi-sample detection event set forth below, the intensities of all the samples constituting the multi-sample detection event are apportioned among the allowed TOFs linked to the detection event using a respective initial probability for each block TOF. Each initial probability is applied to all the samples in the set of samples, and will therefore be referred to as an initial block probability. Initial block probabilities are determined in ways similar to those described above with reference to FIGS. 6 and 7A-7E for determining initial probabilities.

Figure 21:
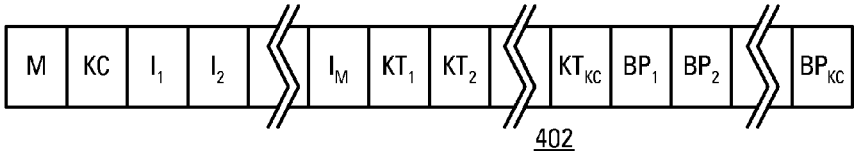
FIG. 21 is a schematic diagram showing an example of the structure of an event record pertaining to a single, multi-sample detection event.

FIG. 21 is a schematic diagram showing an example of an event record pertaining to a single multi-sample detection event. In the example shown, the event record is composed of the following fields: a block size field in which is stored a block size M that indicates the number of consecutive samples constituting the detection event, a block count field in which is stored a block count KC that indicates the number of block TOFs linked to the detection event, M intensity fields in which are stored the respective intensities $I_1$ through $I_M$ of the samples in the sample set; block TOF fields in which are stored the respective block TOFs $KT_1$ through $KT_{KC}$ of the allowed TOF blocks linked to the detection event, and block probability fields in each of which is stored a respective block probability $BP_1$ through $BP_{KC}$ linked to each block TOF linked to the detection event. The intensity fields are indexed by a sample index m, where m is an integer and $1 \leqq m \leqq M$. The block TOF fields and the block probability fields are addressed by a block index a, where a is an integer and $1 \leqq a \leqq KC$.

In the example shown in FIG. 21, the event record has block probability fields in preference to intensity apportionment fields. Using block probability fields reduces the size of the event record because the number of block probability fields in the event record is equal to the number of block TOF fields, whereas the number of intensity apportionment fields would be equal to the product of block count KC and block size M. Moreover, block probability fields are smaller than intensity apportionment fields because block probabilities can be represented using fewer bits than intensity apportionments. Finally, using block probability fields reduces memory bandwidth demands because the smaller number of block probability fields reduces the number of read and write operations that are needed. In other examples, intensity apportionment fields are used. In this case, the event record has an M by KC array of intensity apportionment fields in which respective intensity apportionments are stored as previous intensity apportionments.

An embodiment of detection event memory 502 (FIGS. 11 and 13) in which respective memory locations store event records having the structure shown in FIG. 21 performs the function of storing data comprising the intensity of each of the samples in the set, block times of flight (block TOFs) linked to the detection event and, linked to each of the block TOFs, a respective previous block probability, or previous intensity apportionments equal in number to the samples in the set of samples.

In the revised probability determining and intensity reapportioning processes described above with reference to blocks 212 and 214 of FIG. 3, for each block TOF linked to each detection event, the previous intensity apportionments of the samples constituting the sample set are respectively subtracted from the intensity accumulations respectively linked to the M consecutive allowed times of flight linked to the block TOF to generate respective depleted intensity accumulations. As will be described in more detail below with reference to FIGS. 22 and 23, each previous intensity apportionment is obtained by multiplying the intensity of the respective sample by the respective previous block probability linked to the block TOF. The resulting depleted intensity accumulations are summed to generate a respective block depleted intensity accumulation linked to the block TOF. Additionally, the block depleted intensity accumulations for all the block TOFs linked to the detection event are summed to generate an event depleted accumulation sum. A revised block probability linked to each block TOF is calculated by dividing the respective block depleted intensity accumulation by the event depleted accumulation sum. The revised block probabilities are then used to reapportion the intensities of all of the samples in the sample set constituting the detection event among the allowed times of flight linked to the detection event.

Figure 22:
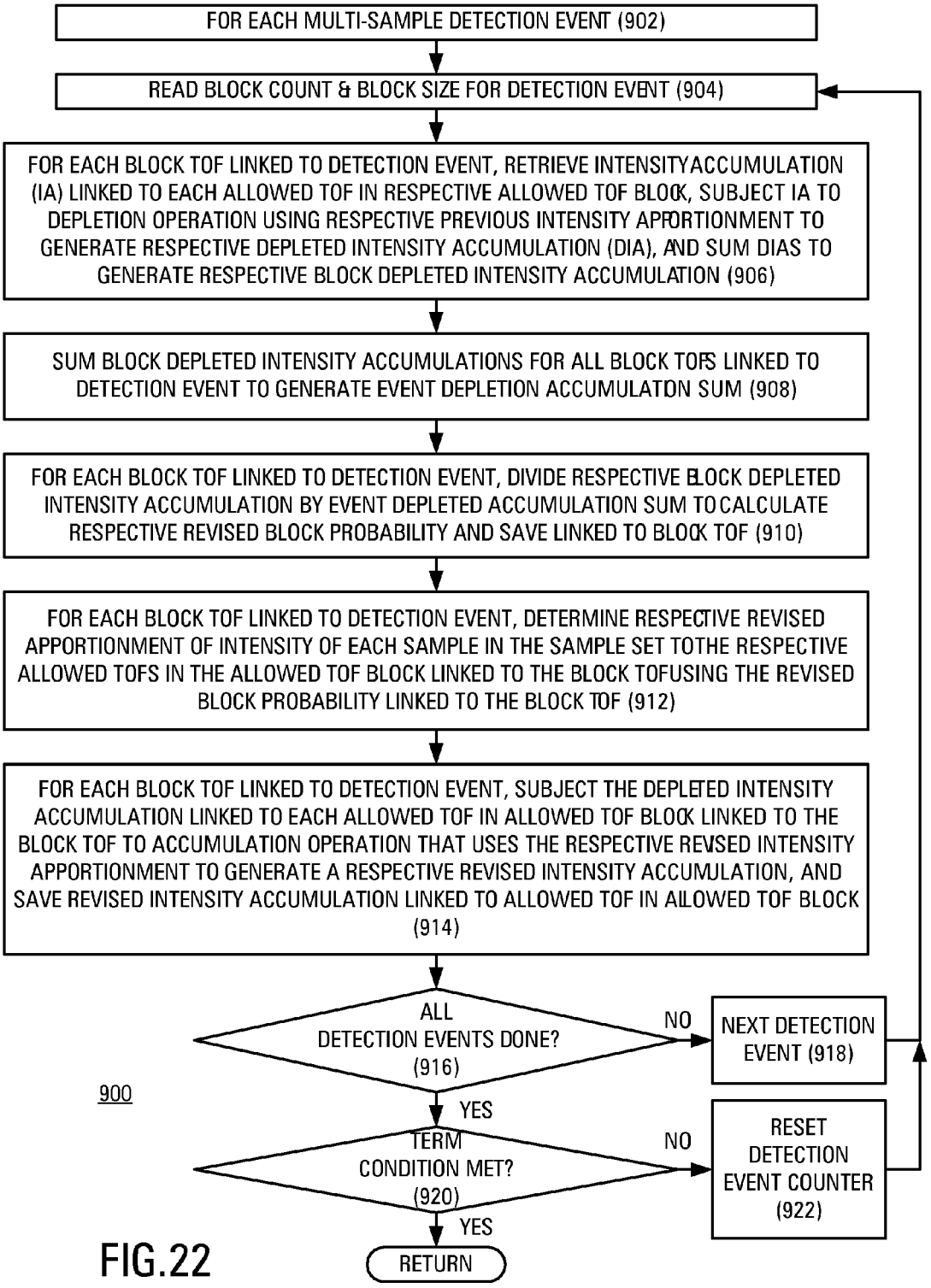
FIG. 22 is a flow chart showing an example of the processing performed in accordance with an embodiment of the invention to reapportion the intensities of multi-sample detection events.

FIG. 22 is a flow chart showing an example 900 of the processing performed in accordance with an embodiment of the invention to determine revised block probabilities for reapportioning the intensities of multi-sample detection event and to reapportion the intensities of such multi-sample detection event in accordance with such revised block probabilities. Revised block probability determining and intensity reapportioning process 900 will be described in greater detail below with reference to FIGS. 23 and 24. In revised block probability determining and intensity reapportioning process 900, blocks 902, 916 and 918 establish a per-detection-event loop composed of operations that are performed for each of the multi-sample detection events represented by the detection signal. In an example, respective event records pertaining to the detection events are stored in a detection event memory, such as one having the event record structure described above with reference to FIG. 21. A reference in the description of FIG. 22 to the detection event is a reference to the multi-sample detection event for which revised probabilities are determined and the intensities of whose samples are reapportioned in the current execution of the loop.

In block 904, block count KC and block size M for the detection event are read. In an example, block count KC is read from the block count field and block size M is read from the block size field of the event record in detection event memory 502 pertaining to the detection event.

In block 906, for each block TOF linked to the detection event, the respective intensity accumulation linked to each allowed TOF in the corresponding allowed TOF block is retrieved, each retrieved intensity accumulation is subject to a depletion operation using a respective previous intensity apportionment to generate a respective depleted intensity accumulation, and all the depleted intensity accumulations generated for the allowed TOF block linked to the block TOF are summed to generate a respective block depleted intensity accumulation linked to the block TOF. Block 906 will be described in greater detail below with reference to FIG. 23. In an example, the respective intensity accumulation is read out from the TOF bin addressed by each allowed TOF in the allowed TOF block linked to the block TOF, each intensity accumulation is subject to a depletion operation using a respective previous intensity apportionment to generate a respective depleted intensity accumulation and all the depleted intensity accumulations generated for the allowed TOF block linked to the block TOF are summed to generate a respective block depleted intensity accumulation linked to the block TOF. Each previous intensity apportionment is obtained by multiplying the intensity of the respective sample in the sample set by the previous block probability linked to the block TOF.

In block 908, the block depleted intensity accumulations for all the block TOFs linked to the detection event are summed to generate an event depleted accumulation sum.

In block 910, for each block TOF linked to the detection event, the respective block depleted intensity accumulation is divided by the event depleted accumulation sum to calculate a respective revised block probability, and the revised block probability is saved linked to the block TOF.

In block 912, for each block TOF linked to the detection event, a respective revised apportionment of the intensity of each of the samples in the sample set to the respective allowed TOFs in the allowed TOF block linked to the block TOF is determined using the revised probability linked to the block TOF.

In block 914, for each block TOF linked to the detection event, the respective depleted intensity accumulation for each allowed TOF in the allowed TOF block linked to the block TOF is subject to an accumulation operation using the respective revised intensity apportionment to generate a respective revised intensity accumulation and the revised intensity accumulation is saved linked to the respective allowed TOF in the allowed TOF block linked to the block TOF. The processing performed in blocks 912 and 914 will be described in greater detail below with reference to FIGS. 23 and 24.

In block 916, a test is performed to determine whether revised block probability determining and intensity reapportioning processes have been performed for all the multi-sample detection events represented by the detection signal. A NO result causes execution to return to block 904 via block 918. Block 918 causes block 904 to read the block count KC and block size M for the next detection event. A YES result causes execution to advance to block 920.

In block 920, a test is performed to determine whether a defined termination condition has been met, as described above. A NO result in block 920 causes execution to return to block 904 via block 922. Block 922 resets the detection event counter so that the block count and block size for the first detection event are read once more in block 904. However, due to the operations performed in blocks 906-914, many of the intensity accumulations stored in spectrum memory 150 differ in value from the previous time the block count and block size for the first detection event were read in block 904. A YES result in block 920 causes execution to stop.

Figure 23:
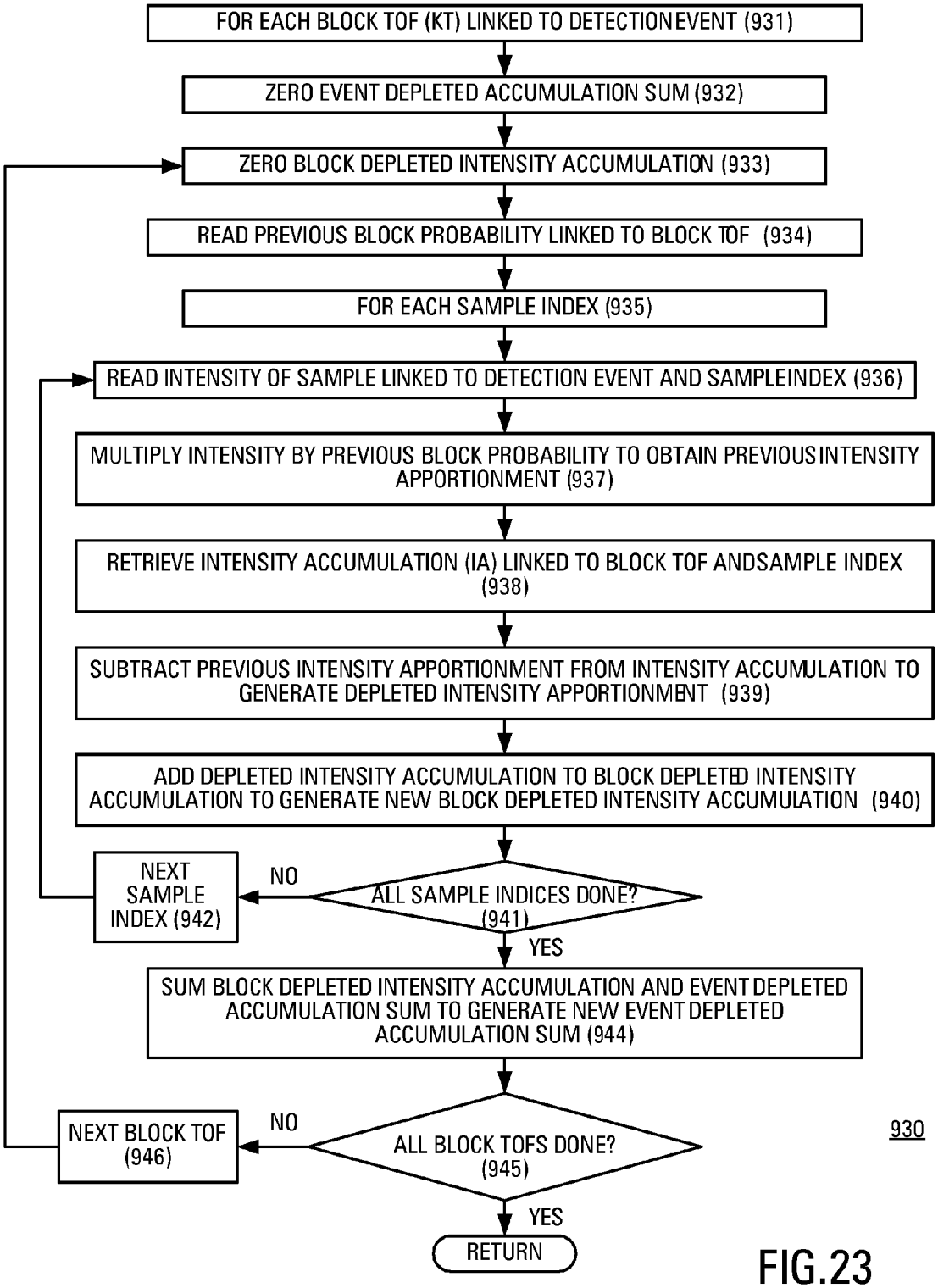
FIG. 23 is a flow chart showing an example of the operations shown in blocks 906 and 908 of FIG. 22.

FIG. 23 is a flow chart showing an example 930 of the operations described above with reference to blocks 906 and 908 of FIG. 22. Blocks 931, 945 and 946 establish a per-block-TOF loop that is performed for each block TOF linked to the detection event. The block TOFs are tracked by block index a whose value identifies the block TOF for which the loop is performed. A reference in the description of FIG. 23 to the block TOF is a reference to the block TOF for which a respective block depleted intensity accumulation is generated in the current execution of the loop. Within the per-block-TOF loop, in block 932, a respective event depleted accumulation sum linked to the detection event is set to zero. In block 933, a respective block depleted intensity accumulation linked to the block TOF is set to zero. In block 934, the previous block probability linked to the block TOF is read. In an example, the previous block probability linked to the block TOF is read from a block probability field of the event record in detection event memory 502 pertaining to the detection event. The block probability field from which the previous block probability is read is that addressed by block index a.

Blocks 935, 941 and 942 establish a per-sample loop that is performed for each sample in the sample set constituting the detection event. The samples are tracked by sample index m whose value indicates the position of each sample in the sample set and also indicates the position of the corresponding allowed TOF in the allowed TOF block addressed by the block TOF. A reference in the description of FIG. 23 to the sample is a reference to the sample identified by sample index m for which a depleted intensity accumulation is generated in the current execution of the loop. Within the per-sample loop, in block 936, the intensity of the sample linked to the detection event and the sample index is read. In an example, the intensity of the sample linked to the detection event and the sample index is read from an intensity field of the event record in detection event memory 502 pertaining to the detection event. The intensity field from which the intensity of the sample is read is that addressed by sample index m.

In block 937, the intensity read in block 936 is multiplied by the previous block probability linked to the TOF block and read in block 934.

In block 938, the intensity accumulation linked to the block TOF and the sample index is retrieved. In an example, the block TOF and sample index m are summed to generate an allowed TOF in the allowed TOF block, and the intensity accumulation is read out from the TOF bin in spectrum memory 150 addressed by the allowed TOF. The TOF bin is the one in which is stored the intensity accumulation linked to the block TOF and the sample index. Additionally, the allowed TOF is cached to provide the address of the TOF bin to which the revised intensity accumulation generated from the intensity accumulation retrieved in block 938 will later be written, as will be described below with reference to block 972 of FIG. 24. Alternatively, the allowed TOF is not cached, but is generated from the block TOF and the sample index once more in block 972.

In block 939, the previous intensity apportionment calculated in block 937 is subtracted from the intensity accumulation retrieved in block 938 to generate a depleted intensity accumulation. The depleted intensity accumulation is linked through the block TOF and the sample index to the allowed TOF to which the intensity accumulation retrieved in block 938 is linked. In an example, the depleted intensity accumulation is cached linked to the block TOF and the sample index for later use in block 970 of FIG. 24, described below.

In block 940, the depleted intensity accumulation generated in block 939 is added to the block depleted intensity accumulation linked to the block TOF to generate a new block depleted intensity accumulation. The block depleted intensity accumulation generated in the final execution of block 940 for the block TOF is a block depleted intensity accumulation linked to the block TOF.

In block 941, a test is performed to determine whether depletion operations have been performed for all of the samples in the sample set constituting the detection event. A NO result causes execution to return to block 936 via block 942. Block 942 causes block 936 to read the intensity of the sample linked to the detection event and the next value of the sample index. A YES result causes execution to advance to block 944.

In block 944, the block depleted intensity accumulation generated in the final execution of block 940 linked to the block TOF and the event depleted accumulation sum are summed to generate a new event depleted accumulation sum. The event depleted intensity accumulation sum generated in the final execution of block 944 for the detection event is the event depleted intensity accumulation linked to the detection event.

In block 945, a test is performed to determine whether respective block depleted intensity accumulations for all the block TOFs linked to the detection event have been summed with the event depletion accumulation sum. A NO result causes execution to return to block 933 via block 946. Block 946 causes block 933 to zero the block depleted intensity accumulation for the next block TOF. A YES result causes execution to return to the main routine.

Figure 24:
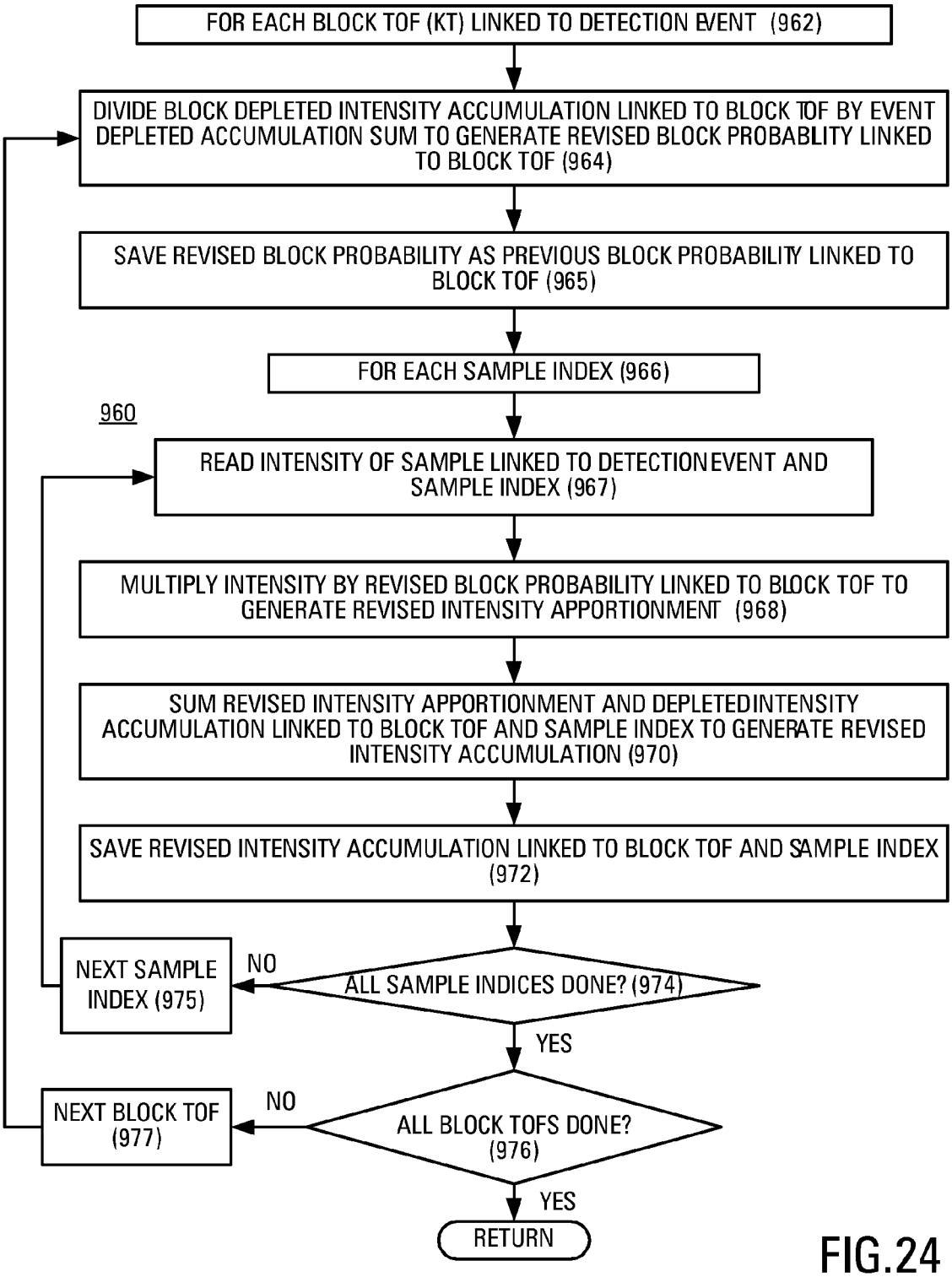
FIG. 24 is a flow chart showing an example of the operations shown in blocks 912 and 914 of FIG. 22.

FIG. 24 is a flow chart showing an example 960 of the operations described above with reference to blocks 912 and 914 of FIG. 22. Blocks 962, 976 and 977 establish a per-block-TOF loop that is performed for each block TOF linked to the detection event. The block TOFs are tracked by block index a whose value identifies the block TOF for which the loop is performed. A reference in the description of FIG. 24 to the block TOF is a reference to the block TOF for which a respective revised block probability determined in the current execution of the loop. Within the loop, in block 964, the block depleted intensity accumulation linked to the block TOF is divided by the event depleted accumulation sum linked to the detection event to generate a revised block probability linked to the block TOF. The revised block probability will be used to apportion the intensities of the samples constituting the sample set to the respective allowed TOFs in the allowed TOF block identified by the block TOF. Performing the operations within the per-block-TOF loop for all the block TOFs linked to the multi-sample detection event reapportions the intensities of the detection event among the allowed TOF blocks linked to the block TOFs linked to the detection event. In block 965, the revised block probability is saved as a previous block probability linked to the block TOF.

Blocks 966, 974 and 975 establish a per-sample loop that is performed for each sample in the sample set constituting the detection event. The samples are tracked by sample index m whose value indicates the position of each sample in the sample set. A reference in the description of FIG. 24 to the sample is a reference to the sample identified by the sample index and whose intensity is reapportioned in the current execution of the loop. Within the per-sample loop, in block 967, the intensity I of the sample linked to the detection event and the sample index is read. In an example, the intensity is read from the intensity field addressed by the sample index in the event record in detection event memory 502 pertaining to the detection event. In block 968, the intensity read in block 967 is multiplied by the revised block probability calculated for the block TOF in block 964 to generate a revised intensity apportionment.

In block 970, the revised intensity apportionment generated in block 968 and the depleted intensity accumulation linked to the block TOF and the sample index are summed to generate a revised intensity accumulation. In an example, the depleted intensity accumulation cached linked to the block TOF and the sample index in block 939 of FIG. 23 is read from the cache and is summed with the revised intensity apportionment generated in block 968.

In block 972, the revised intensity accumulation generated in block 970 is saved linked to the allowed TOF identified by the block TOF and the sample index. In an example, the allowed TOF cached linked to the block TOF and the sample index in block 938 is read out from the cache and is output to spectrum memory 150. In another example, the block TOF is read from the block TOF field in the event record in detection event memory 502 pertaining to the detection event. The block TOF field is that addressed by allowed TOF block index a. The block TOF read from the detection event memory and the sample index are summed to generate an allowed TOF that addresses the TOF bin in spectrum memory in which the revised intensity accumulation is to be written, and the allowed TOF is output to spectrum memory 150. The revised intensity accumulation is saved in the TOF bin of spectrum memory 150 addressed by the allowed TOF.

In block 974, a test is performed to determine whether the per-sample loop has been performed for all the samples in the sample set constituting the detection event. A NO result causes execution to return to block 967 via block 975. Block 975 causes the per-sample loop to be performed for the next sample in the sample set. A YES result causes execution to advance to block 976.

In block 976, a test is performed to determine whether the per-block-TOF loop has been performed for all the block TOFs linked to the detection event. A NO result causes execution to return to block 964 via block 977. Block 977 causes the per-block-TOF loop to be performed for the next block TOF linked to the detection event. A YES result causes execution to return to the main routine.

Modifications to intensity apportioner 140 described above with reference to FIG. 11, specifically to detection event memory 502, accumulator 508 and probability calculator 510, and to intensity apportioners 820 and 840 described above with reference to FIGS. 18 and 20, respectively, to enable such intensity apportioners to operate with multi-sample detection events will be apparent from the above description and therefore will not be separately described.

This disclosure describes the invention in detail using illustrative embodiments. However, the invention defined by the appended claims is not limited to the precise embodiments described.

We claim:

1. A mass spectrometer, comprising:

an ion pulser operable to accelerate ions in response to temporally-irregular transients, the transients having an average repetition rate greater than a reference repetition rate that depends on a maximum time of flight of the mass spectrometer, each of the transients having a respective transient time;

an ion detector operable to generate a detection signal in response to the ions incident thereon, the detection signal representing detection events each comprising a respective intensity and a respective event time;

an allowed time of flight calculator operable in response to the transient times and the event time of the detection event to determine, for each detection event represented by the detection signal, respective allowed times of flight (TOFs) linked to the detection event;

a spectrum memory comprising time-of-flight (TOF) bins each corresponding to a respective one of the allowed TOFs; and an intensity apportioner and accumulator operable to use initial probabilities to determine an apportionment of the respective intensity of each detection event among the allowed TOFs linked thereto and to accumulate the apportionments of the intensities to each allowed TOF to generate a respective intensity accumulation for output to the respective TOF bin corresponding to the allowed TOF, the intensity apportioner additionally iteratively operable, for each detection event, to determine revised probabilities using the intensity accumulations stored in the TOF bins corresponding to the allowed TOFs linked to the detection event, and to reapportion the respective intensity among the allowed TOFs linked to the detection event using the revised probabilities.

2. The mass spectrometer of claim 1, in which the intensity apportioner and accumulator comprises a detection event memory operable to store a respective event record pertaining to each of the detection events represented by the detection signal, the respective event record storing data comprising the intensity, the allowed TOFs linked to the detection event and, linked to each of the allowed TOFs, one of (a) a respective previous intensity apportionment, and (b) a respective previous probability.

3. The mass spectrometer of claim 2, in which:

each of the detection events comprises a set of consecutive samples each having a respective intensity; and the detection event memory is structured to store a respective event record pertaining to each of the detection events, the event record storing data comprising the intensity of each of the samples in the set, block TOFs linked to the detection event and, linked to each of the block TOFs, one of (a) a respective previous block probability, and (b) previous intensity apportionments equal in number to the samples in the set of samples.

4. The mass spectrometer of claim 2, in which the detection event memory is structured to allow the one of (a) each respective previous intensity apportionment, and (b) each respective previous probability linked to the detection event to be updated by a respective one of (a) a respective revised intensity apportionment generated using a respective one of the revised probabilities, and (b) the respective one of the revised probabilities.

5. The mass spectrometer of claim 1, in which:

the intensity apportioner and accumulator comprises a probability calculator operable to determine the probabilities in accordance with which the respective intensity of each of the detection events is apportioned among the allowed TOFs linked thereto;

the probability calculator is initially operable to calculate the respective initial probabilities; and the probability calculator is subsequently iteratively operable to calculate the revised probabilities using the intensity accumulations stored in the respective TOF bins corresponding to the allowed TOFs linked to the detection event.

6. The mass spectrometer of claim 5, in which the intensity apportioner and accumulator additionally comprises:

an apportioner operable in response to the intensity and the probabilities linked to each detection event to apportion the respective intensity of the detection event among the allowed TOFs linked thereto to generate the respective apportionments of the intensity among the allowed TOFs; and an accumulator operable to accumulate the intensity apportionments to each one of the allowed TOFs to generate a respective intensity accumulation for storage in a respective one of the TOF bins corresponding to the one of the allowed TOFs.

7. The mass spectrometer of claim 6, in which:

the accumulator comprises:

an accumulating circuit operable to sum the intensity accumulations linked to each detection event to generate a respective accumulation sum, and a summing circuit operable to subject the intensity accumulations linked to the detection event to respective accumulation operations to generate respective new intensity accumulations; and the probability calculator comprises:

a divider operable when the accumulation sum for the detection event is zero to generate, as the initial probabilities, equal probabilities that depend on the number of allowed TOFs linked to the detection event, and a divider otherwise operable to determine a respective initial probability for each allowed TOF linked to the detection event by dividing the intensity accumulation linked to the allowed TOF by the accumulation sum for the detection event.

8. The mass spectrometer of claim 5, in which the probability calculator comprises a divider operable to calculate equal initial probabilities that depend on the number of allowed TOFs linked to the detection event.

9. The mass spectrometer of claim 8, in which the probability calculator comprises a divider operable to calculate, for each allowed TOF linked to the detection event, a respective initial probability that depends on the respective intensity accumulation linked to the allowed TOF.

10. The mass spectrometer of claim 5, in which the probability calculator comprises a divider operable to determine equal initial probabilities that depend on the number of allowed TOFs linked to the detection event, and to determine, for each allowed TOF linked to the detection event, a respective initial probability that depends on the intensity accumulation linked to the allowed TOF, equal initial probabilities being determined when an intensity apportionment has previously been accumulated for none of the allowed TOFs linked to the detection event, respective initial probabilities being determined otherwise.

11. The mass spectrometer of claim 5, in which:

the ion detector operates to generate the detection signal during a current measurement run; and the probability calculator is operable to calculate, for each allowed TOF linked to the detection event, a respective initial probability that depends on a previous intensity accumulation obtained from a respective detection signal generated by the ion detector during a previous measurement run, the previous intensity accumulation linked to the allowed TOF.

12. The mass spectrometer of claim 5, in which the probability calculator is operable to generate a respective revised probability for each allowed TOF linked to the detection event from (a) the intensity accumulation linked to the allowed TOF, and (b) respective depleted intensity accumulations derived from the respective intensity accumulations linked to all of the allowed TOFs linked to the detection event.

13. The mass spectrometer of claim 12, in which:

the respective apportionment of the intensity to each allowed TOF linked to the detection event in a previous iteration is a previous intensity apportionment linked to the allowed TOF;

the intensity apportioner and accumulator additionally comprises:

a subtraction circuit operable to subtract the respective previous intensity linked to each allowed TOF linked to the detection event from the intensity accumulation linked to the allowed TOF to generate a respective depleted intensity accumulation linked to the allowed TOF, and an accumulation circuit operable to accumulate the depleted intensity accumulations linked to all the allowed TOFs linked to the detection event to generate a depleted accumulation sum; and the probability calculator comprises an divider operable to divide the respective depleted intensity accumulation linked to each allowed TOF linked to the detection event by the depleted accumulation sum to generate the respective revised probability linked to the allowed TOF.

14. The mass spectrometer of claim 5, in which the probability calculator is operable to generate, for each allowed TOF linked to the detection event, a respective revised probability proportional to a sum of the apportionments to the allowed TOF of the respective intensities of all the detection events, other than the detection event, whose intensities are apportioned to the allowed TOF.

15. The mass spectrometer of claim 1, in which the reapportioning of the respective intensity among the allowed TOFs linked to the detection event by the intensity apportioner and accumulator is, for each allowed TOF, proportional to a change between one iteration and the next in the probability linked to the allowed TOF.

16. The mass spectrometer of claim 1, in which the reapportioning of the respective intensity among the allowed TOFs linked to the detection event by the intensity apportioner and accumulator is, for each allowed TOF, proportional to an amplified change between one iteration and the next in the probability linked to the allowed TOF.

17. The mass spectrometer of claim 1, in which:

the respective apportionment of the intensity to each allowed TOF linked to the detection event in a previous iteration is a previous intensity apportionment linked to the allowed TOF; and the intensity apportioner and accumulator comprises:

a subtracting circuit operable to subtract the respective previous intensity apportionment linked to each allowed TOF linked to the detection event from the intensity accumulation linked to the allowed TOF to generate a depleted intensity accumulation linked to the allowed TOF, a multiplier operable to multiply the intensity linked to the detection event by the revised probability linked to the allowed TOF to generate a revised intensity apportionment linked to the allowed TOF, and a summing circuit operable to sum the depleted intensity accumulation linked to the allowed TOF and the revised intensity apportionment linked to the allowed TOF to generate the revised intensity accumulation linked to the allowed TOF.

18. The mass spectrometer of claim 1, in which:

the respective probability used in a previous iteration to apportion the intensity of the detection event to the allowed TOF is a previous probability linked to the allowed TOF; and the intensity apportioner and accumulator comprises:

a multiplier operable to multiply the intensity of the detection event by a difference between the revised probability linked to the allowed TOF and the previous probability linked to the allowed TOF to generate an intensity apportionment change linked to the allowed TOF; and a summing circuit operable to sum the intensity accumulation linked to the allowed TOF and the intensity apportionment change linked to the allowed TOF to generate the revised intensity accumulation linked to the allowed TOF.

19. The mass spectrometer of claim 1, in which:

the intensity apportioner and accumulator comprises:

P intensity apportioning and accumulating modules each of which is connected to receive a share of the detection events represented by the detection signal, a respective partial spectrum cache connected to each of the intensity apportioning modules to receive revised intensity accumulations therefrom and to provide accumulation intensity accumulations thereto, and a summing system connected to receive respective a respective partial spectrum from each of the partial spectrum caches and to provide a full time-of-flight spectrum to the spectrum memory; and the spectrum memory is connected to provide to each one of the intensity apportioning modules respective probability intensity accumulations linked to each detection event for the one of the intensity apportioning modules to use in generating the revised probabilities.

20. The mass spectrometer of claim 19, in which:

the spectrum memory comprises a respective spectrum memory module for each of the intensity apportioning modules; and each of the intensity apportioning modules is connected to receive the probability intensity accumulations from respective one of the spectrum memory modules.

21. The mass spectrometer of claim 1, in which:

the detection signal comprises a set of consecutive samples representing a respective one of the detection events;

the allowed time of flight calculator is operable to calculate allowed TOFs for a representative one of the samples in the set of samples as respective block times of flight (block TOFs) linked to the detection event; and the intensity apportioner and accumulator comprises:

a probability calculator operable to calculate a respective revised block probability for each block TOF linked to the detection event using respective intensity accumulations derived from the samples within the set of samples, and an apportioner operable to reapportion the intensity of each sample in the set of samples among the respective TOF bins corresponding to the allowed TOFs linked thereto using the respective revised block probability determined for the block TOFs of the block to which the allowed TOF belongs.

22. A mass spectrometer, comprising:

an ion pulser operable to accelerate ions in response to temporally-irregular transients, the transients having an average repetition rate greater than a reference repetition rate that depends on a maximum time of flight of the mass spectrometer, each of the transients characterized by a respective transient time;

an ion detector operable to generate a detection signal in response to the ions incident thereon, the detection signal representing detection events each comprising a respective intensity and a respective event time;

means for calculating, using the transient times and a respective event time, respective allowed times of flight (TOFs) linked to each of the detection events represented by the detection signal;

a spectrum memory comprising time-of-flight bins (TOF bins) each corresponding to a respective one of the allowed TOFs;

means for determining, in accordance with initial probabilities, initial apportionments of the respective intensity of each of the detection events among the allowed TOFs linked thereto; for accumulating the initial apportionments of the intensities to each one of the allowed TOFs to generate a respective intensity accumulation for storage in a respective one of the TOF bins corresponding to the one of the allowed TOFs; and iteratively for determining revised probabilities for each detection event using the intensity accumulations stored in the respective TOF bins corresponding to the allowed TOFs linked to the detection event, and reapportioning the respective intensity among the TOF bins corresponding to the allowed TOFs in accordance with the revised probabilities.

23. A mass spectrometry method, comprising:

accelerating ions in response to temporally-irregular transients having an average repetition rate greater than a reference repetition rate that depends on a maximum time of flight, the transients each having a respective transient time;

generating a detection signal in response to the ions, the detection signal representing detection events each comprising a respective intensity and a respective event time;

for each detection event represented by the detection signal, calculating respective allowed TOFs between the respective event time and the transient times;

for each detection event, using respective initial probabilities, determining initial apportionments of the intensity thereof among the allowed TOFs linked thereto;

for each of the allowed TOFs, accumulating the apportionments of the intensities thereto to generate an intensity accumulation linked thereto; and for each detection event, determining respective revised probabilities using the intensity accumulations linked to the allowed TOFs linked thereto, and reapportioning the respective intensity among the allowed TOFs linked thereto using the revised probabilities, the determining the revised probability and the reapportioning the respective intensity being performed iteratively.

24. A computer-readable medium in which is fixed a program operable to cause a computational device to transform a detection signal into a time-of-flight spectrum that provides information regarding a chemical composition of an analyte sample, the detection signal representing detection events each comprising a respective intensity and respective allowed TOFs linked thereto, the detection signal generated by an ion detector in response to incident ions accelerated at temporally-irregular intervals having an average repetition rate greater than a reference repetition rate that depends on a maximum time of flight, the program causing the computational device to transform the detection signal by a process comprising:

for each detection event represented by the detection signal, determining, in accordance with respective initial probabilities, initial apportionments of the respective intensity thereof among the allowed TOFs linked to the detection event;

for each of the allowed TOFs, accumulating the apportionments of the intensities thereto to generate an intensity accumulation linked thereto; and for each detection event, determining respective revised probabilities using the intensity accumulations linked to the allowed TOFs linked thereto, and reapportioning the respective intensity among the allowed TOFs linked thereto using the revised probabilities, the determining the revised probability and the reapportioning the respective intensity being performed iteratively.

* * * * *

UNITED STATES PATENT AND TRADEMARK OFFICE

CERTIFICATE OF CORRECTION

PATENT NO. : 8,080,782 B2
APPLICATION NO. : 12/511965
DATED : December 20, 2011
INVENTOR(S) : August Hidalgo et al.

It is certified that error appears in the above-identified patent and that said Letters Patent is hereby corrected as shown below:

In column 84, lines 39-40, in claim 19, delete "to receive respective a respective partial" and insert -- to receive a respective partial --, therefor.

Signed and Sealed this
Tenth Day of July, 2012

David J. Kappos

David J. Kappos
*Director of the United States Patent and Trademark Office*